US011125524B2

(12) United States Patent
Miele et al.

(10) Patent No.: US 11,125,524 B2
(45) **Date of Patent: *Sep. 21, 2021**

(54) SUPPRESSOR FOR FIREARM AND METHOD OF MAKING BAFFLE CUP THEREFOR

(71) Applicant: Smith & Wesson Inc., Springfield, MA (US)

(72) Inventors: Antonio Miele, Ludlow, MA (US); Robert Marsland, Hampden, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/915,860

(22) Filed: Jun. 29, 2020

(65) Prior Publication Data

US 2020/0326148 A1 Oct. 15, 2020

Related U.S. Application Data

(63) Continuation of application No. 16/179,652, filed on Nov. 2, 2018, now Pat. No. 10,724,817, which is a (Continued)

(51) Int. Cl.
*F41A 21/30* (2006.01)

(52) U.S. Cl.
CPC ..... *F41A 21/30* (2013.01)

(58) Field of Classification Search
CPC ..... F41A 21/28; F41A 21/30
See application file for complete search history.

(56) References Cited

U.S. PATENT DOCUMENTS 2,727,584 A 12/1955 Marx
4,167,987 A 9/1979 Turner
(Continued)

FOREIGN PATENT DOCUMENTS

EP 1338769 A1 8/2003
EP 2314976 A2 4/2011
(Continued)

OTHER PUBLICATIONS

NoiseLessClub, "Silencer Designs: K-Baffles Building Tutorial (Suppressor)", https://www.youtube.com/watch?v=wSUAc0QpkMM (Year: 2011).*

*Primary Examiner* — Joshua T Semick
(74) *Attorney, Agent, or Firm* — Stinson LLP

(57) ABSTRACT

A firearm suppressor includes a muzzle mount; blast, intermediate and distal baffle cups; a distal end cap; and a shroud. The muzzle mount, baffle cups, and end cap thread together at threaded interfaces. Each baffle cup has an externally threaded proximal segment threadably received in the proximally adjacent component. The distal baffle cup has an externally threaded distal segment received in the end cap. The components are shaped and arranged to form sealed interfaces upstream of the threaded interfaces along the flow path of gas through the suppressor. The baffle cups include baffle walls defining chambers sized and arranged to limit first round pop. The baffle walls define vent passages extending along axes oriented at skew angles with respect to the axes of the baffle cups. A distal baffle cup includes an annular recess for reducing the weight of the suppressor adjacent the distal end.

9 Claims, 37 Drawing Sheets

Related U.S. Application Data continuation of application No. 15/634,729, filed on Jun. 27, 2017, now Pat. No. 10,119,779.

(56) References Cited

U.S. PATENT DOCUMENTS 4,454,798 A 6/1984 Shea et al.
4,588,043 A 5/1986 Finn
5,136,923 A 8/1992 Walsh, Jr.
5,559,302 A 9/1996 Latka
5,679,916 A 10/1997 Weichert
5,685,102 A 11/1997 Latka
6,062,874 A 5/2000 Matsuda et al.
6,298,764 B1 10/2001 Sherman et al.
6,308,609 B1 10/2001 Davies
6,312,650 B1 11/2001 Fredricksen et al.
6,374,718 B1 4/2002 Rescigno et al.
6,425,310 B1 7/2002 Champion
6,575,074 B1 6/2003 Gaddini
6,796,214 B2 9/2004 Hausken et al.
6,837,139 B2 1/2005 Meyers
6,948,415 B2 9/2005 Matthews et al.
6,973,863 B1 12/2005 Jones
7,028,416 B1 4/2006 Dobie et al.
7,073,426 B1 7/2006 White
7,216,737 B2 5/2007 Sugiyama
7,237,467 B1 7/2007 Melton
7,302,774 B2 12/2007 Meyers
7,308,967 B1 12/2007 Hoel
7,412,917 B2 8/2008 Vais
7,516,690 B2 4/2009 McClellan
7,537,083 B2 5/2009 Frederiksen
7,587,969 B2 9/2009 Silvers
7,588,122 B2 9/2009 Brittingham
7,594,425 B2 9/2009 Lewnard et al.
7,594,464 B2 9/2009 Dueck
7,600,606 B2 10/2009 Brittingham
7,610,710 B2 11/2009 Brittingham
7,610,992 B2 11/2009 Brittingham
D610,221 S 2/2010 Brittingham
7,661,349 B1 2/2010 Brittingham
7,673,413 B2 3/2010 Bentley
7,676,976 B2 3/2010 Dueck et al.
7,677,150 B2 3/2010 Dater et al.
7,743,693 B1 7/2010 Brittingham
7,753,679 B1 7/2010 Schuetz
7,788,763 B2 9/2010 Hwang
7,789,008 B2 9/2010 Petersen
7,789,009 B1 9/2010 Brittingham
7,789,194 B2 9/2010 Lathrop et al.
7,823,314 B1 11/2010 Wheatley
7,832,323 B1 11/2010 Davies
7,836,809 B2 11/2010 Noveske
7,856,914 B2 12/2010 Shults et al.
7,861,636 B1 1/2011 Hoffman
7,874,238 B2 1/2011 Silvers
7,891,282 B1 2/2011 DeGroat
7,891,284 B1 2/2011 Barrett
7,905,170 B1 3/2011 Brittingham et al.
7,905,171 B1 3/2011 Brittingham
7,926,404 B2 4/2011 Brittingham
7,937,876 B1 5/2011 Graham
7,946,069 B2 5/2011 Dueck et al.
7,987,944 B1 8/2011 Brittingham et al.
8,002,047 B2 8/2011 DeCourcy et al.
8,002,080 B1 8/2011 Bingham
8,015,908 B2 9/2011 Kline et al.
8,042,448 B1 10/2011 Sylvester et al.
8,047,115 B2 11/2011 Noveske
8,051,948 B2 11/2011 Geyer, III
8,061,254 B2 11/2011 Heath
8,087,338 B1 1/2012 Hines
8,091,462 B2 1/2012 Dueck et al.
8,096,222 B2 1/2012 Silvers
8,100,224 B1 1/2012 Olson
8,100,244 B2 * 1/2012 Stapfer ..... G07D 11/40 194/206
8,104,394 B2 1/2012 Meyers
8,104,570 B2 1/2012 Miller et al.
8,109,362 B2 2/2012 Agrawal et al.
8,162,100 B2 4/2012 Shults et al.
8,167,084 B1 5/2012 Moore
8,171,840 B2 5/2012 Kline et al.
8,196,701 B1 6/2012 Oliver
8,209,895 B2 7/2012 Dueck et al.
8,210,087 B2 7/2012 Latka
8,210,309 B1 7/2012 Schlosser et al.
8,261,651 B2 9/2012 Casa Salva
8,272,306 B1 9/2012 Smith
8,292,025 B1 10/2012 Woodell et al.
8,307,946 B1 11/2012 Johnston
8,312,963 B2 11/2012 Ogawa et al.
8,316,752 B2 11/2012 Waddell, Jr. et al.
8,322,266 B2 12/2012 Presz, Jr. et al.
8,333,139 B2 12/2012 Addis
8,342,071 B2 1/2013 Hortobagyi
D677,357 S 3/2013 Dueck et al.
8,387,299 B1 3/2013 Brittingham et al.
8,397,615 B2 3/2013 Poling
8,397,862 B2 3/2013 Shand
8,418,803 B2 4/2013 Findlay
8,424,441 B2 4/2013 Brittingham et al.
8,424,635 B1 4/2013 Klawunn
D682,974 S 5/2013 Honigmann
D682,975 S 5/2013 Honigmann
8,439,155 B2 5/2013 Shults et al.
D683,806 S 6/2013 Dueck
8,453,789 B1 6/2013 Honigmann et al.
8,459,405 B1 6/2013 Dueck
8,459,406 B1 6/2013 Dueck
8,474,361 B2 7/2013 Brittingham
8,479,632 B2 7/2013 Kline et al.
8,479,878 B2 7/2013 Schlosser
8,490,535 B1 7/2013 Moore et al.
8,499,676 B1 8/2013 Moore et al.
8,505,431 B2 8/2013 Hines
8,505,680 B2 8/2013 Dueck
8,511,425 B2 8/2013 Larue
8,516,941 B1 8/2013 Oliver
8,522,662 B2 9/2013 Presz, Jr. et al.
8,528,458 B2 9/2013 Windauer
8,528,691 B1 9/2013 Carmichael et al.
8,555,765 B2 10/2013 Graham, II et al.
8,561,757 B1 10/2013 Edsall
8,567,556 B2 10/2013 Deck et al.
8,579,075 B2 11/2013 Brittingham et al.
8,584,794 B2 11/2013 Dueck
8,671,818 B1 3/2014 Oliver
8,701,543 B2 4/2014 Brinkmeyer et al.
8,714,300 B2 5/2014 Johansen
8,714,301 B2 5/2014 Shults
8,739,674 B1 6/2014 Huber et al.
8,739,922 B2 6/2014 Wirth et al.
8,769,852 B2 7/2014 Coleman
8,770,084 B2 7/2014 Young
8,794,376 B2 8/2014 Shults et al.
8,807,005 B2 8/2014 Moss et al.
8,807,006 B2 8/2014 Butler
8,807,272 B2 8/2014 Bladen
8,820,473 B1 9/2014 White
8,826,793 B2 9/2014 Oliver
8,833,512 B2 9/2014 Smith et al.
8,844,422 B1 9/2014 Klett
8,857,306 B1 10/2014 Edsall
8,857,307 B2 10/2014 Tresserras Torre et al.
8,863,639 B2 10/2014 Gomez
8,875,612 B1 11/2014 Klett et al.
8,881,862 B1 11/2014 Messer, Jr. et al.
8,887,616 B2 11/2014 Kenney
8,910,745 B2 12/2014 Latka
8,910,746 B1 12/2014 McKenzie
8,939,057 B1 1/2015 Edsall
8,950,310 B2 2/2015 Storrs et al.
8,950,313 B2 2/2015 Kenney

(56) References Cited

U.S. PATENT DOCUMENTS 8,950,546 B2 2/2015 Shults et al.
8,967,325 B1 3/2015 Cronhelm
8,967,326 B2 3/2015 Schlosser
8,973,481 B2 3/2015 Dueck et al.
8,978,818 B2 3/2015 Proske
8,991,550 B2 3/2015 Coley
8,991,551 B2 3/2015 Latka
8,991,552 B2 3/2015 Latka
8,997,621 B1 4/2015 Dater et al.
9,038,770 B1 5/2015 Morrison
9,038,771 B1 5/2015 Mueller
9,046,316 B1 6/2015 Young
9,052,152 B2 6/2015 Moss et al.
9,086,248 B2 7/2015 Young et al.
9,091,502 B1 7/2015 Morrison
9,097,482 B1 8/2015 Holden et al.
9,102,010 B2 8/2015 Wilson
9,103,618 B2 8/2015 Daniel et al.
9,109,851 B2 8/2015 Salva
9,115,949 B1 8/2015 Morrison
9,115,950 B2 8/2015 Bethlenfalvy
D737,922 S 9/2015 Pace
D738,982 S 9/2015 Silvers
9,121,656 B1 9/2015 McKenzie
9,140,511 B2 9/2015 Michal et al.
9,140,512 B2 9/2015 Witchel
9,146,068 B2 9/2015 Hodgson
9,146,069 B2 9/2015 Monti et al.
D741,443 S 10/2015 Cheney
9,151,560 B2 10/2015 Myers et al.
9,157,692 B2 10/2015 Salva
9,163,891 B1 10/2015 Dater et al.
D742,987 S 11/2015 Holden et al.
D742,988 S 11/2015 Holden et al.
D742,989 S 11/2015 Holden et al.
9,175,919 B2 11/2015 Russell et al.
9,175,920 B2 11/2015 Moore
9,182,187 B1 11/2015 Griffith
9,182,188 B2 11/2015 Gawencki
9,188,403 B1 11/2015 White
9,194,640 B2 11/2015 Wirth et al.
9,199,887 B2 12/2015 Hafner et al.
9,207,033 B2 12/2015 Vais
9,222,747 B1 12/2015 Morrison
9,228,786 B2 1/2016 Sullivan et al.
9,239,201 B1 1/2016 Reis Green
9,261,317 B2 2/2016 Daniel et al.
9,261,319 B1 2/2016 Palu
9,291,417 B2 3/2016 James
9,302,318 B2 4/2016 Griffin
9,322,607 B1 4/2016 Lau
9,328,984 B2 5/2016 Shults et al.
9,347,727 B1 5/2016 Cler
9,366,495 B1 6/2016 Coppinger et al.
9,395,137 B2 7/2016 Miller, III et al.
9,404,704 B2 8/2016 Packard et al.
9,410,761 B2 8/2016 Morris et al.
9,417,021 B2 8/2016 Pietila
9,417,023 B2 8/2016 Smith
9,429,380 B1 8/2016 Morrison
9,441,900 B1 9/2016 Parrish
9,459,065 B2 10/2016 Palu
9,464,857 B2 10/2016 Lessard
9,464,858 B2 10/2016 Lau
9,593,899 B2 3/2017 Coppinger et al.
9,746,267 B2 8/2017 Smith
10,119,779 B1 * 11/2018 Miele ..... F41A 21/30
10,267,586 B1 4/2019 Martione
10,458,739 B2 10/2019 Smith
10,619,962 B1 * 4/2020 Hatfield ..... F41A 21/44
2005/0115394 A1 6/2005 Matthews et al.
2006/0060076 A1 3/2006 Dueck et al.
2006/0143967 A1 7/2006 Smith
2007/0266844 A1 11/2007 Dueck
2010/0126334 A1 5/2010 Shults et al.
2010/0163336 A1 7/2010 Presz, Jr. et al.
2010/0199834 A1 8/2010 Dueck et al.
2010/0229712 A1 9/2010 Graham
2010/0313743 A1 12/2010 Dueck et al.
2011/0036233 A1 2/2011 DeGroat
2011/0072958 A1 3/2011 Brittingham et al.
2011/0088540 A1 4/2011 Brittingham et al.
2011/0203152 A1 8/2011 Dueck et al.
2011/0220434 A1 9/2011 Silvers
2011/0297477 A1 12/2011 Koumbis
2012/0145478 A1 6/2012 Brittingham
2012/0180354 A1 7/2012 Sullivan et al.
2012/0180623 A1 7/2012 Graham, II et al.
2012/0180624 A1 7/2012 Troy et al.
2012/0272818 A1 11/2012 Dueck et al.
2012/0273297 A1 11/2012 Schlosser
2013/0168181 A1 7/2013 Wirth et al.
2013/0180150 A1 7/2013 Dueck
2013/0180707 A1 7/2013 Dueck
2013/0180796 A1 7/2013 Dueck et al.
2013/0340313 A1 12/2013 Myers et al.
2014/0020976 A1 1/2014 Shults
2014/0020977 A1 1/2014 Shults
2014/0059913 A1 3/2014 Diamond et al.
2014/0076150 A1 3/2014 Brinkmeyer et al.
2014/0157640 A1 6/2014 Whelan
2014/0158249 A1 6/2014 Schlosser
2014/0158459 A1 6/2014 Shults et al.
2014/0224574 A1 8/2014 Latka
2014/0224575 A1 8/2014 Latka
2014/0231168 A1 8/2014 Dueck et al.
2014/0262605 A1 9/2014 Washburn, III et al.
2014/0318887 A1 10/2014 Latka
2014/0374189 A1 12/2014 Young et al.
2015/0001001 A1 1/2015 Wilson
2015/0001002 A1 1/2015 Wirth et al.
2015/0136519 A1 5/2015 Moore
2015/0159971 A1 6/2015 Salva
2015/0184968 A1 7/2015 Fischer et al.
2015/0226506 A1 8/2015 Shults et al.
2015/0241159 A1 8/2015 Michal et al.
2015/0241161 A1 8/2015 Hodgson
2015/0253099 A1 9/2015 Shults
2015/0260472 A1 9/2015 Smith
2015/0260473 A1 9/2015 Barney
2015/0267986 A1 9/2015 Sellars
2015/0267987 A1 9/2015 Gawencki
2015/0276340 A1 10/2015 Vais
2015/0285575 A1 10/2015 Sclafani
2015/0285576 A1 10/2015 Shults et al.
2015/0292825 A1 10/2015 Cassels
2015/0292829 A1 10/2015 Pietila
2015/0308764 A1 10/2015 Kenney
2015/0308772 A1 10/2015 James
2015/0308773 A1 10/2015 Daniel et al.
2015/0308776 A1 10/2015 Smith
2015/0308778 A1 10/2015 Vossler
2015/0323275 A1 11/2015 Lessard
2015/0323276 A1 11/2015 Myers et al.
2015/0337878 A1 11/2015 Schlosser
2015/0338183 A1 11/2015 Salvador
2015/0354422 A1 12/2015 Liskey et al.
2015/0354922 A1 12/2015 Carriere
2015/0362276 A1 12/2015 Fischer
2015/0377576 A1 12/2015 Salva
2015/0377577 A1 12/2015 Pappas et al.
2016/0003570 A1 1/2016 Tonkin
2016/0009412 A1 1/2016 Manasseh
2016/0010935 A1 1/2016 Clarke et al.
2016/0018178 A1 1/2016 Johansen
2016/0018179 A1 1/2016 Morris et al.
2016/0033224 A1 2/2016 Miller, III et al.
2016/0054087 A1 2/2016 Palu
2016/0061551 A1 3/2016 Petersen
2016/0076844 A1 3/2016 Miller, III
2016/0084602 A1 3/2016 Smith
2016/0109205 A1 4/2016 Coppinger et al.
2016/0161203 A1 6/2016 Wilson
2016/0187093 A1 6/2016 Barrett

(56) References Cited

U.S. PATENT DOCUMENTS

| | | | |
|---|---|---|---|
| 2016/0209149 | A1 | 7/2016 | Fischer |
| 2016/0209150 | A1 | 7/2016 | Smith |
| 2016/0209151 | A1 | 7/2016 | Smith |
| 2016/0209152 | A1 | 7/2016 | Dueck et al. |
| 2016/0209153 | A1 | 7/2016 | Dueck et al. |
| 2016/0238335 | A1 | 8/2016 | Bertschinger et al. |
| 2016/0290754 | A1 | 10/2016 | Davis |
| 2017/0160034 | A1 | 6/2017 | Parker |
| 2017/0205175 | A1 | 7/2017 | Garst et al. |
| 2017/0299313 | A1 | 10/2017 | Adamson, Jr. |

FOREIGN PATENT DOCUMENTS

| | | | |
|---|---|---|---|
| EP | 2977708 | A1 | 1/2016 |
| WO | 2009139803 | A1 | 11/2009 |
| WO | 2014135639 | A1 | 9/2014 |
| WO | 2014152947 | A2 | 9/2014 |
| WO | 2015000874 | A1 | 1/2015 |
| WO | 2015002567 | A1 | 1/2015 |
| WO | 2015016998 | A2 | 2/2015 |
| WO | 2015083110 | A1 | 6/2015 |
| WO | 2016079252 | A1 | 5/2016 |
| WO | 2016102534 | A1 | 6/2016 |
| WO | 2016141106 | A1 | 9/2016 |

* cited by examiner

SUPPRESSOR FOR FIREARM AND METHOD OF MAKING BAFFLE CUP THEREFOR

STATEMENT OF RELATED CASES

This application is a divisional of U.S. Ser. No. 16/179,652, filed Nov. 2, 2018, which is a continuation application of U.S. Ser. No. 15/634,729 filed Jun. 27, 2017, issued as U.S. Pat. No. 10,119,779 on Nov. 6, 2018, the entire contents of all of which are incorporated herein by reference.

FIELD

The present disclosure generally relates to a suppressor for suppressing a muzzle blast of a firearm and to baffle cups of the suppressor.

BACKGROUND

Suppressors are used to suppress the muzzle blast of a firearm. A typical suppressor is mounted on the distal end of the muzzle and defines a projectile passage extending along an axis. The projectile passage is aligned with the bore of the muzzle so that the fired round travels through the projectile passage after exiting the muzzle. A shroud typically encloses the projectile passage, and one or more baffle walls extend inward from the shroud and around the projectile passage. The baffle walls are oriented transverse to the axis of the projectile passage to define expansion chambers in fluid communication with the projectile passage. At least some of the blast gas associated with the fired round expands radially into the expansion chambers. The baffles thereby entrap and slow some of the blast gas so that the blast gas exits the suppressor at a lower velocity than it would have exited the muzzle of the firearm if no suppressor were used. The suppressor thereby reduces the energy of the blast gas to reduce the report (i.e., suppress the sound) of the round.

One type of suppressor includes a shroud, proximal and distal end caps secured to the shroud, and a plurality of baffle cups stacked together in the interior of the shroud between the proximal and distal end caps. Each baffle cup includes a baffle wall oriented transverse to the axis of the shroud and a spacer portion that extends axially from the baffle wall. When the baffle cups are stacked together inside the shroud, the spacer portion engages an adjacent baffle cup to maintain spacing between the baffle walls of the adjacent baffle cups. The baffle walls and the end caps define a plurality of expansion chambers along the length of the suppressor for receiving blast gas, which reduces the velocity at which the blast gas exits the suppressor and thereby reduces the report of the round.

BRIEF SUMMARY

In one aspect, a suppressor for suppressing a blast of a firearm has a proximal end portion and a distal end portion spaced apart along a suppressor axis. The suppressor comprises a muzzle mount forming the proximal end portion of the suppressor and comprises a proximal muzzle mounting fixture configured for securing the suppressor to a muzzle of the firearm and a distal receptacle portion defining a socket and having a distal end segment extending along the suppressor axis that is internally threaded. The suppressor also comprises a plurality of proximal baffle cups. Each of the proximal baffle cups comprises a proximal baffle wall extending generally around the suppressor axis and a distal spacer wall having a generally cylindrical shape extending along the suppressor axis from a proximal end segment adjacent the baffle wall to a distal end segment. The proximal end segment of the spacer wall of each proximal baffle cup is externally threaded and the distal end segment of the spacer wall of each proximal baffle cup is internally threaded. The proximal end segment of the spacer wall of one of the plurality of proximal baffle cups is threadably received in the internally threaded segment of the receptacle portion of the muzzle mount and the proximal end segment of the spacer wall of each of the other proximal baffle cups is threadably received in the distal end segment of a proximally adjacent one of the plurality of proximal baffle cups. A distal baffle cup comprises a proximal baffle wall extending generally around the suppressor axis and a distal spacer wall having a generally cylindrical shape extending along the suppressor axis from a proximal end segment adjacent the baffle wall to a distal end segment. The proximal end segment of the spacer wall of the distal baffle cup is externally threaded and threadably received in the distal end segment of the spacer wall of one of the plurality of proximal baffle cups, and the distal end segment of the spacer wall of the distal baffle cup is externally threaded. A distal end cap forms the distal end portion of the suppressor and includes a generally cylindrical receptacle portion extending along the suppressor axis. The receptacle portion of the distal end cap is internally threaded and threadably receives the distal end segment of the spacer wall of the distal baffle cup.

In another aspect, a suppressor for suppressing a blast of a firearm has a proximal end portion and a distal end portion spaced apart along a suppressor axis. The suppressor comprises a muzzle mount forming the proximal end portion of the suppressor and configured for securing the suppressor to a muzzle of the firearm. A distal end cap forms the distal end portion of the suppressor. At least first and second baffle cups are located between the muzzle mount and the distal end cap along the suppressor axis. Each of the first and second baffle cups comprises a baffle wall extending generally around the suppressor axis. A generally cylindrical spacer wall extends along the suppressor axis from a proximal end segment adjacent the baffle wall to an opposite distal end segment. The distal end segment of the spacer wall is internally threaded and the proximal end segment of the spacer wall of each of the first and second baffle cups is externally threaded. A first annular shoulder projects radially inwardly from the spacer wall adjacent the proximal end segment thereof and defines a proximally facing sealing surface oriented transverse to the suppressor axis. A second annular shoulder projects radially inwardly adjacent and proximal to the internally threaded distal end segment of the spacer wall and defines a distally facing sealing surface oriented transverse to the suppressor axis. The externally threaded proximal end segment of the spacer wall of the first baffle cup is threadably received in the internally threaded distal end segment of the second baffle cup to form a threaded interface between the first and second baffle cups, and the proximally facing sealing surface of the first baffle cup sealingly engages the distally facing sealing surface of the second baffle cup to form a sealed interface between the first and second baffle cups at a location proximal of the threaded interface.

In yet another aspect, a suppressor for suppressing a blast from a firearm, the suppressor comprises a perimeter wall having a proximal end portion and a distal end portion spaced apart along a suppressor axis and extending circumferentially around the suppressor axis to define a suppressor interior. A proximal end wall is connected to the proximal end portion of the perimeter wall. The proximal end wall defines an opening extending along the suppressor axis. A distal end wall is connected to the distal end portion of the perimeter wall. The distal end wall defines an opening extending along the suppressor axis. A plurality of baffle walls is arranged between the proximal end wall and the distal end wall. Each baffle wall extends in a direction generally around the suppressor axis to define a central opening extending along the suppressor axis. The plurality of baffle walls divide the suppressor interior into a plurality of chambers. Each chamber has a length along the suppressor axis. The plurality of chambers includes a proximal chamber adjacent the proximal end wall, a distal chamber adjacent the distal end wall, and at least one blast chamber between the proximal chamber and the distal chamber. The length of the proximal chamber is shorter than the lengths of each of the at least one blast chamber and the distal chamber.

In still another aspect, a baffle cup for use in a firearm suppressor comprises a generally conical baffle wall having a cone axis, a proximal end portion and a distal end portion spaced apart from one another along the cone axis, and a diameter. The diameter of the conical baffle wall increases as the conical baffle wall extends from adjacent the proximal end portion toward the distal end portion. The conical baffle wall defines a bore extending along the cone axis. A flange portion extends radially outward from the proximal end portion of the conical baffle wall and has a proximal end oriented transverse to the cone axis and an opposite distal end. A vent passage extends along a venting axis oriented at a skew angle with respect to the cone axis. The vent passage includes a first segment formed in the proximal end and a second segment formed in at least one of the flange portion and the conical baffle wall. The first and second segments of the vent passage each extend along the venting axis.

In another aspect, a method of forming a baffle cup for use in a firearm suppressor comprises forming a wall extending along a baffle cup axis and extending circumferentially around the baffle cup axis to define a cup passage along the baffle cup axis. A vent passage is formed in the wall having a first segment and a second segment disposed on an opposite side of the baffle cup passage from the first segment by inserting a material removing tool through the wall along a venting axis oriented at a skew angle with respect to the baffle cup axis.

In another aspect, a baffle cup has a proximal end and a distal end spaced apart along an axis for use in a suppressor for suppressing a muzzle blast. The baffle cup comprises a baffle wall extending generally around the axis and having an outer end margin. A spacer wall has a generally cylindrical shape and an interior surface defining a spacer interior and extends along the axis from a proximal end segment adjacent the outer end margin of the baffle wall to an opposite distal end segment. A radially outwardly extending annular recess is formed in the spacer wall and extends proximally along the axis from a location adjacent the distal end segment of the spacer wall.

In yet another aspect, a method of making a baffle cup for use in a suppressor for suppressing a blast of a firearm comprises forming a spacer wall having a generally cylindrical shape, an interior surface, an exterior surface, a wall thickness extending between the interior surface and the exterior surface, a proximal end segment and a distal end segment spaced apart along an axis, and a length extending along the axis from the proximal end segment to the distal end segment. A baffle wall connected to the proximal end segment of the spacer wall and extending generally around the axis is formed. Material is removed from the interior surface of the spacer wall along a portion of the length of the spacer wall to define an annular recess in the interior surface of the spacer wall.

Other features will be in part apparent and in part pointed out hereinafter.

BRIEF DESCRIPTION THE DRAWINGS

Corresponding reference characters indicate corresponding parts throughout the drawings.

DETAILED DESCRIPTION

Figure 1:
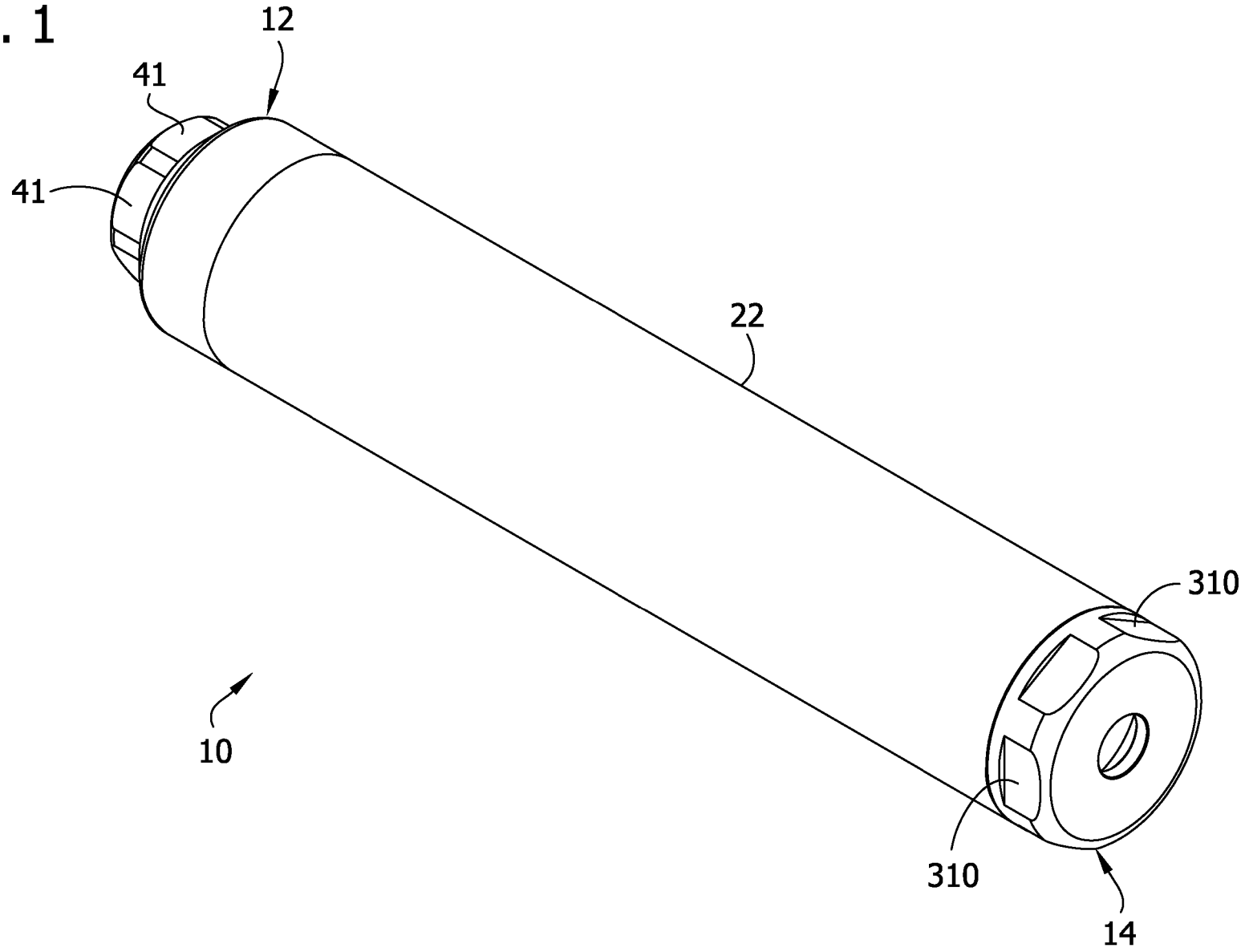
FIG. 1 is a perspective of a firearm suppressor.
Figure 2:
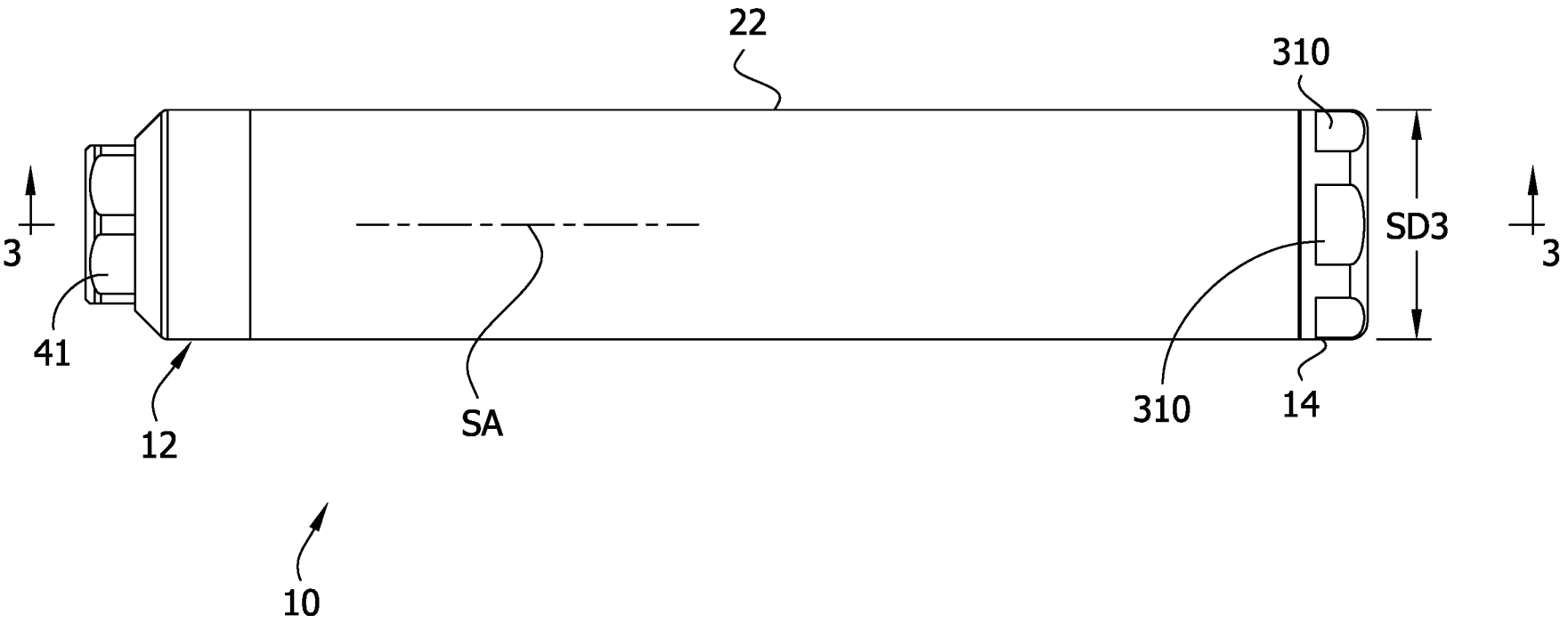
FIG. 2 is a top plan view of the suppressor.
Figure 3:
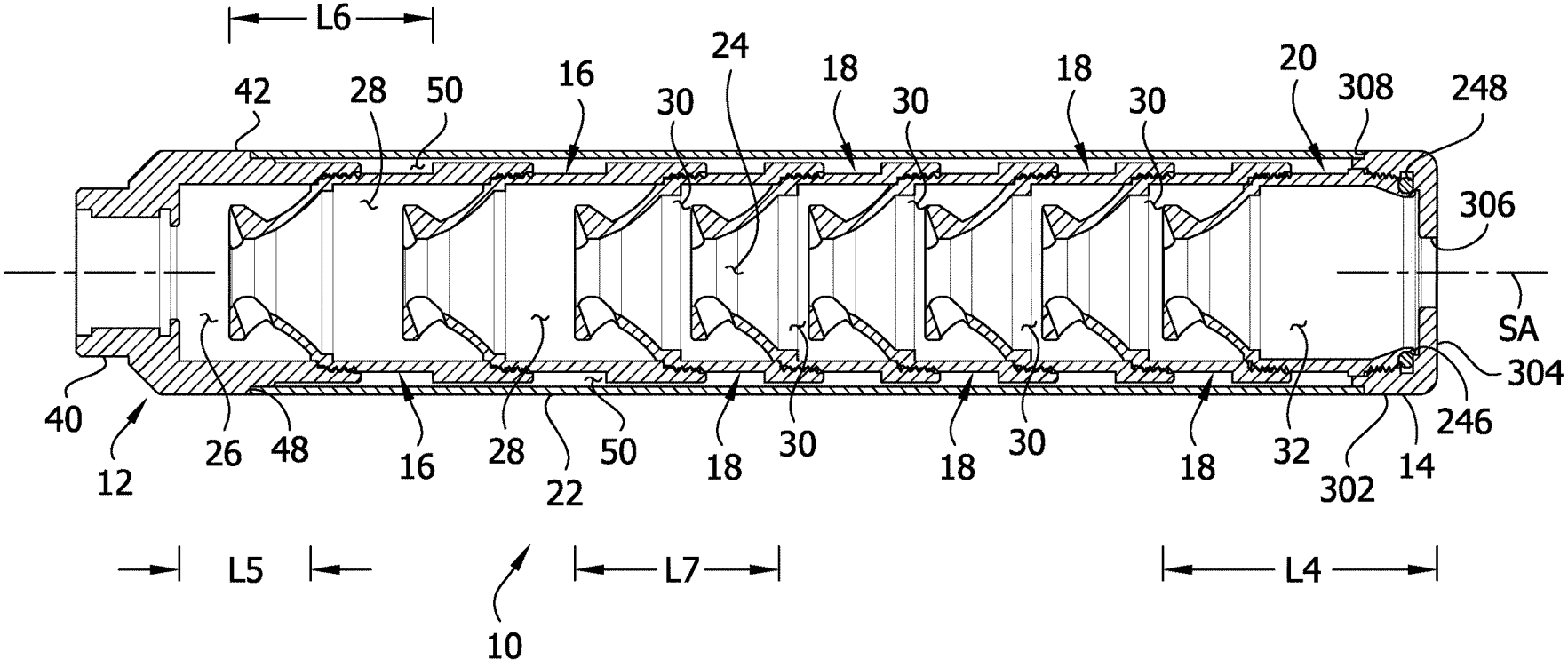
FIG. 3 is a longitudinal section taken in the plane of line 3-3 of FIG. 2.

Referring to FIGS. 1-3, a suppressor for suppressing a muzzle blast of a firearm is generally indicated at reference number 10. The suppressor 10 has a proximal end and a distal end spaced apart along a suppressor axis SA. A muzzle mount, generally indicated at 12, defines the proximal end of the suppressor and is configured to mount the suppressor on the muzzle of a firearm (not shown). A distal end cap, generally indicated at 14, defines the distal end of the suppressor. First and second blast baffle cups, generally indicated at 16; a plurality of intermediate baffle cups, generally indicated at 18; and a distal baffle cup, generally indicated at 20 are stacked along the axis SA of the suppressor 10 between the muzzle mount 12 and the distal end cap 14. As explained below, the baffle cups 16, 18, 20 are threadably fastened to one another and to the muzzle mount 12 and the distal end cap 14 to assemble the suppressor 10. A tubular shroud 22 extends along the axis SA of the suppressor 10 between the muzzle mount 12 and the distal end cap 14 and receives the baffle cups 16, 18, 20 in an interior passage. The muzzle mount 12, the baffle cups 16, 18, 20, and the proximal end cap 14 define a projectile passage 24 extending along the suppressor axis SA from the proximal end through the distal end of the suppressor. As explained below, the suppressor 10 is configured to be mounted on a firearm so that rounds fired from the firearm travel along the suppressor axis SA through the passage 24. The suppressor 10 receives exhaust gas associated with the round in chambers 26, 28, 30, 32 defined between the muzzle mount 12, the baffle cups 16, 18, 20, and the proximal end cap 14 at spaced apart locations along the suppressor axis SA, as described below. The suppressor 10 thereby slows the velocity of the blast gas associated with the round to reduce the report and flash signature of the round. As will be explained below, the suppressor 10 includes features that maximize suppression performance and minimize manufacturing cost. Below, the disclosure first separately describes each of the components of the suppressor 10, before describing the manufacture, assembly, and use of the suppressor in greater detail.

Figure 4:
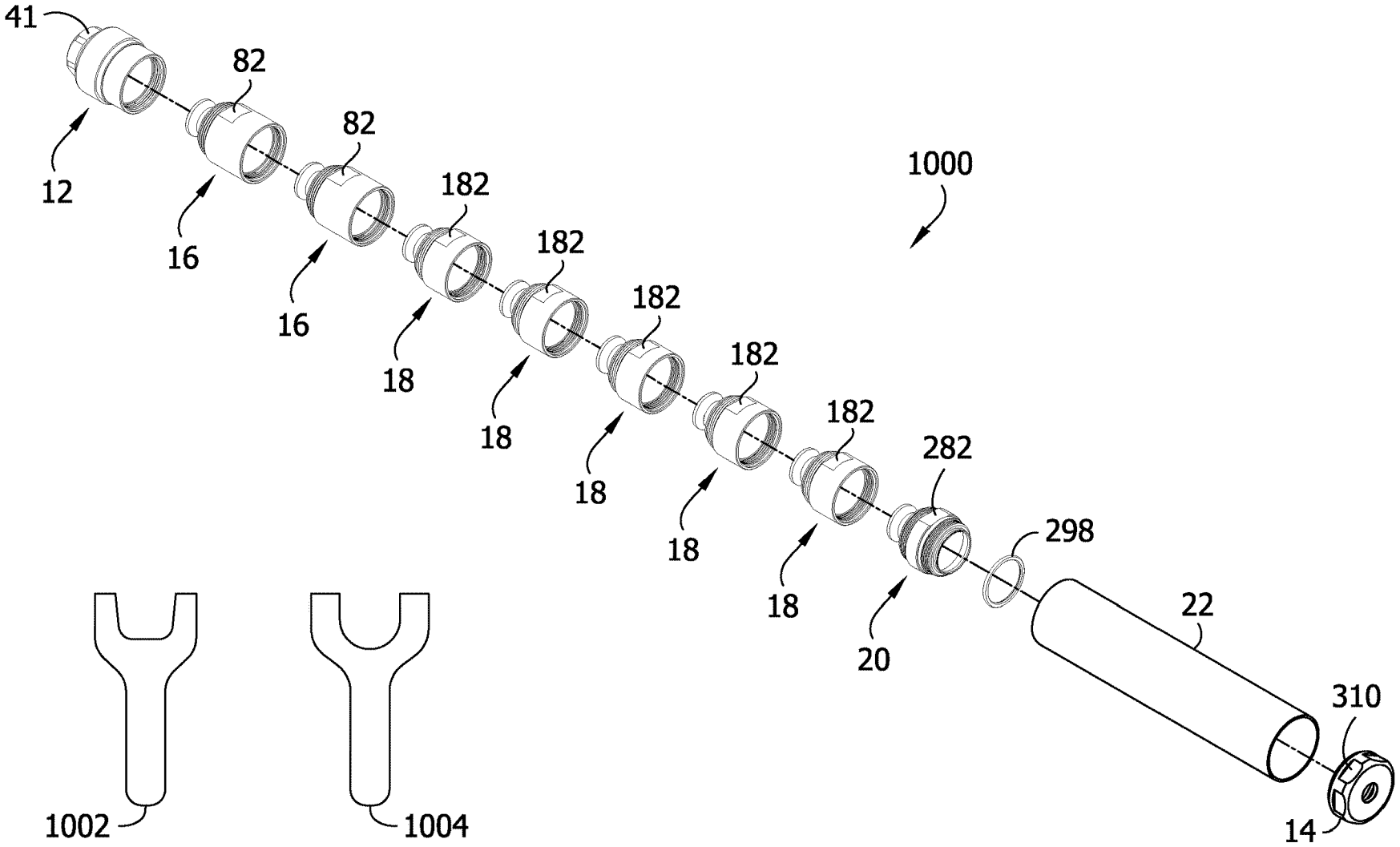
FIG. 4 is an exploded perspective of the suppressor and wrenches for disassembling the suppressor.
Figure 5:
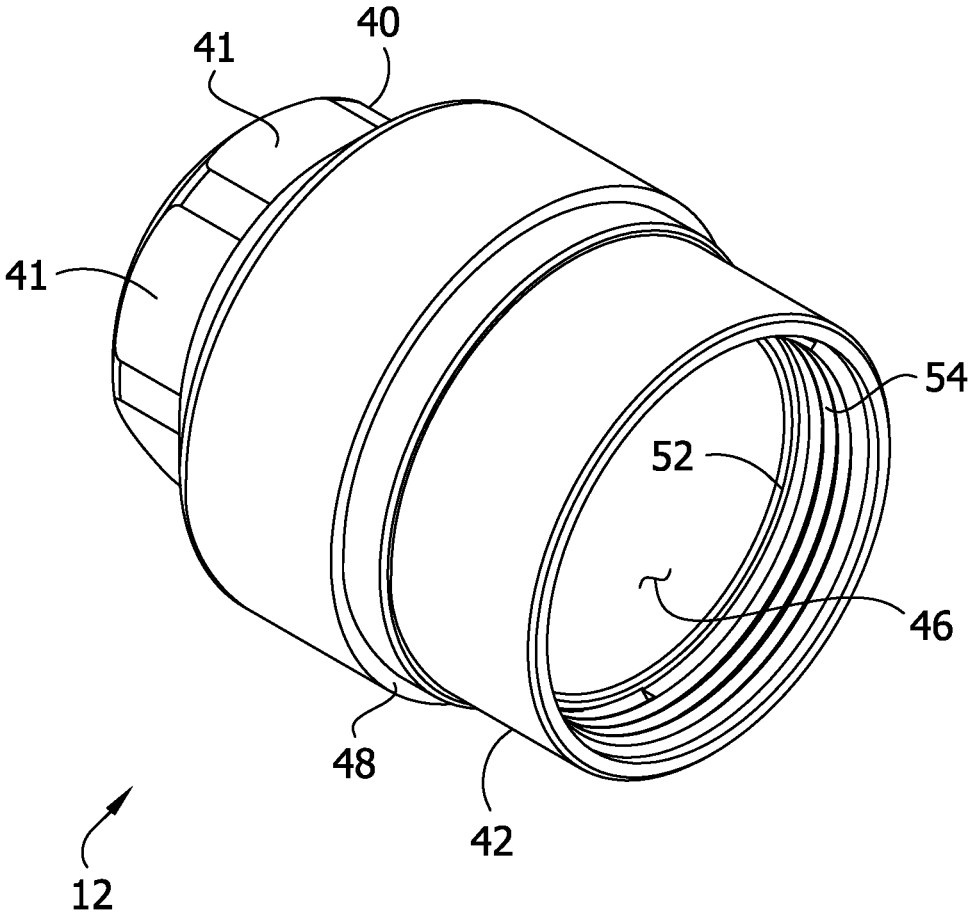
FIG. 5 is a perspective of a muzzle mount of the suppressor.
Figure 6:
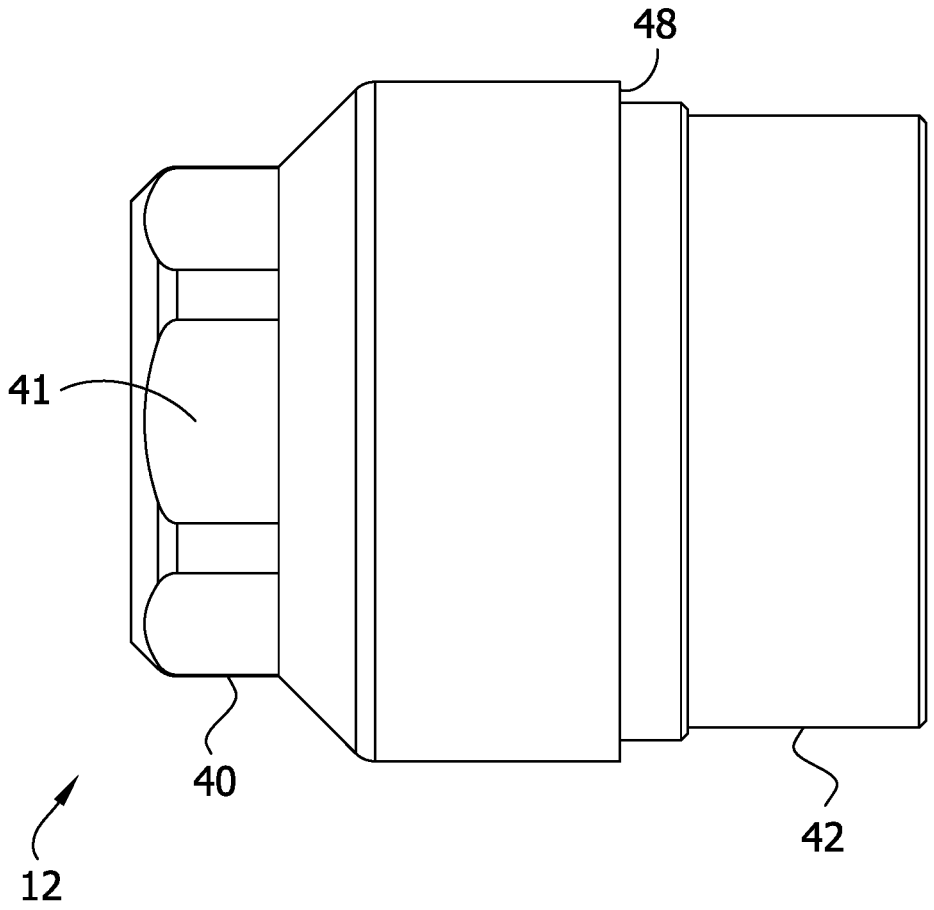
FIG. 6 is a front elevation of the muzzle mount, the rear elevation being a mirror image of the front elevation.
Figure 7:
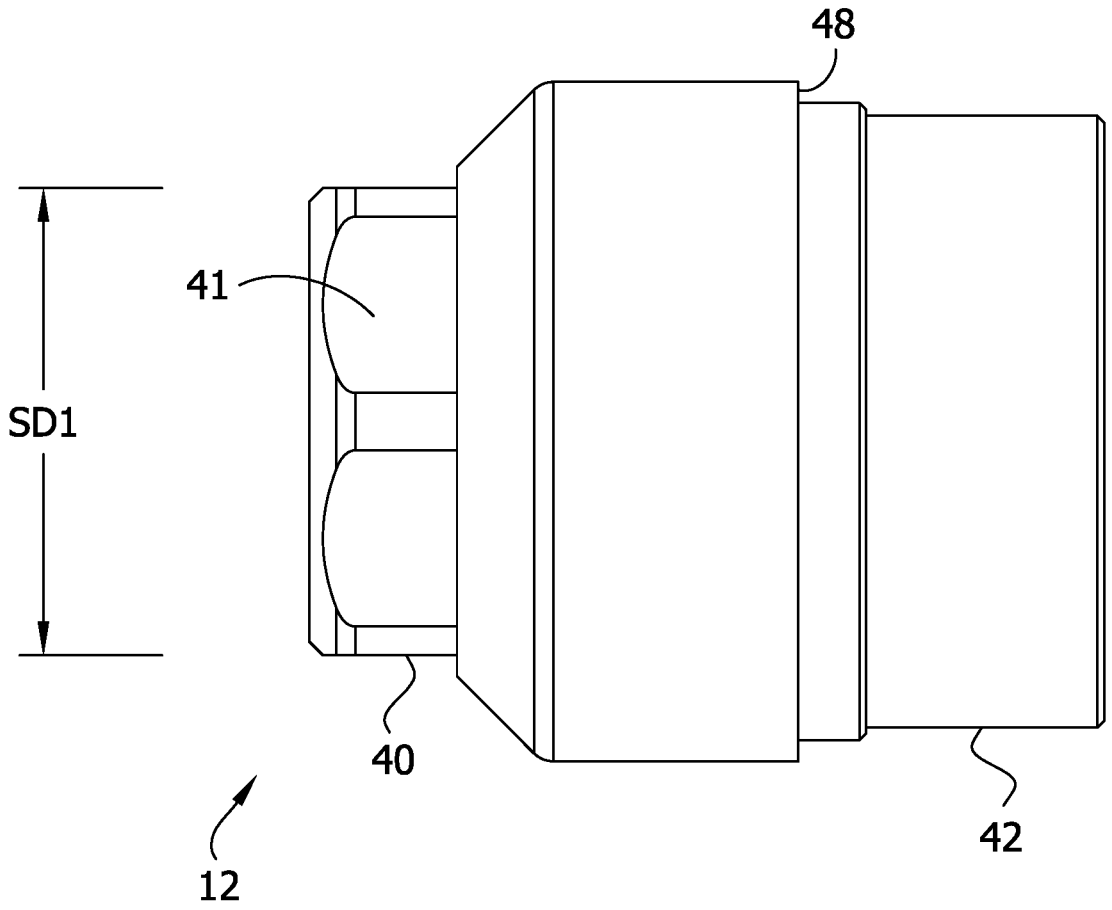
FIG. 7 is a top plan view of the muzzle mount, the bottom plan view being identical to the top plan view.
Figure 8:
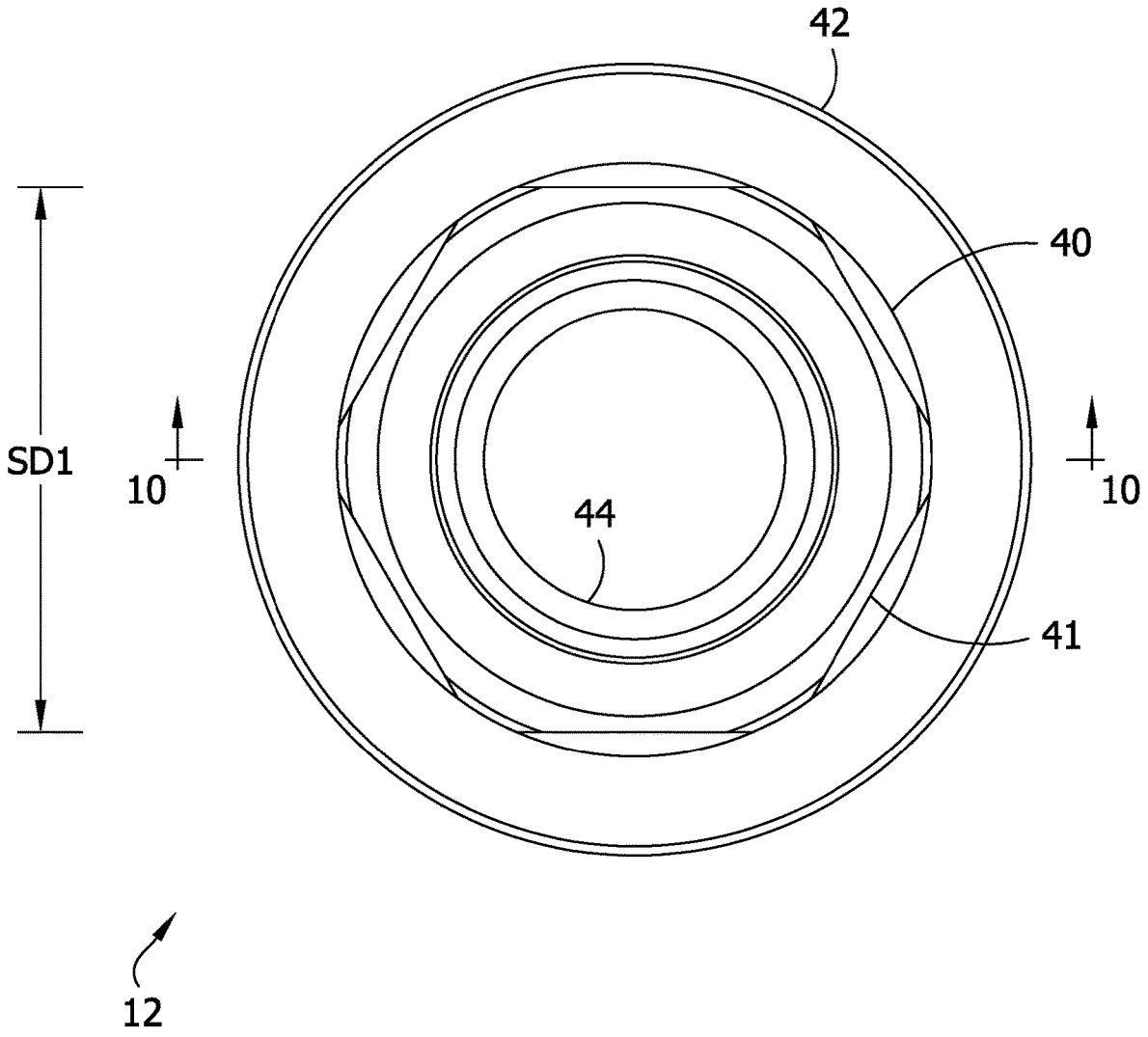
FIG. 8 is a distal end elevation of the muzzle mount.
Figure 9:
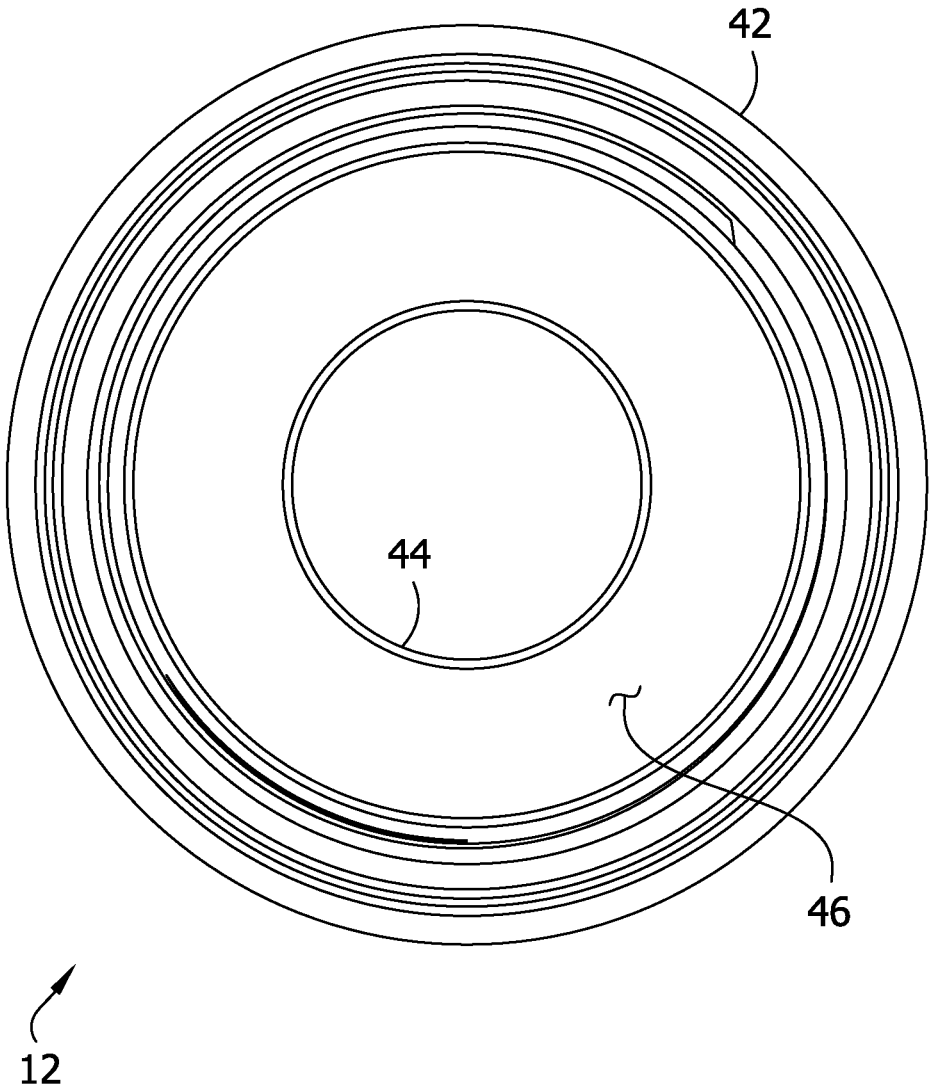
FIG. 9 is a proximal end elevation of the muzzle mount.

Referring to FIGS. 5-10, the muzzle mount 12 has an axis MA and proximal and distal ends spaced apart along the axis. In the illustrated suppressor 10, the axis MA of the muzzle mount 12 is coincident with the axis SA of the suppressor. In one or more embodiments, the muzzle mount 12 is formed from a single piece of machined metal stock (e.g., an aluminum-scandium alloy such as a material described in U.S. Pat. Nos. 6,557,289 and 6,711,819, each of which is hereby expressly incorporated by reference in its entirety). The muzzle mount 12 comprises a proximal mounting fixture 40 that defines the proximal end of the muzzle mount. The mounting fixture 40 is configured to be connected to the muzzle of a firearm. In use, the muzzle mounting fixture 40 secures the suppressor 10 to the muzzle of the firearm to operatively align the muzzle of the firearm with the projectile passage 24 of the suppressor. Any suitable type of muzzle mounting fixture may be used without departing from the scope of the invention. In the illustrated embodiment, the exterior surface of the muzzle mounting fixture 40 includes a plurality of pairs of wrench flats 41, each including first and second wrench flats on diametrically opposite sides of the axis MA. Each pair of wrench flats 41 is spaced apart by a spanning distance SD1 that corresponds to the size of a first wrench 1002 (FIG. 4).

The muzzle mount 12 also includes a distal receptacle portion 42 that extends distally along the axis MA from the distal end of the muzzle mounting fixture 40. The receptacle portion 42 includes a generally cylindrical side wall 42A and a proximal axial end wall 42B. The proximal axial end wall of the receptacle portion 42 defines a projectile opening 44 that is aligned with the projectile passage 24 when the suppressor 10 is assembled. The receptacle portion 42 defines a socket 46 having a length L1 (FIG. 10) extending from the proximal axial end wall to an open distal end of the cylindrical side wall of the receptacle portion. As will be explained in further detail below, the length L1 of the receptacle portion 42 is relatively short in the context of the suppressor 10 to limit the size of the proximal-most expansion chamber 26 of the suppressor. In one or more embodiments, the length L1 of the socket 46 of the receptacle portion 42 is in an inclusive range of from about 0.5 inches to about 1.0 inches, such as an inclusive range of from about 0.65 inches to about 0.85 inches, for example an inclusive range of from about 0.725 inches to about 0.775 inches.

Figure 10:
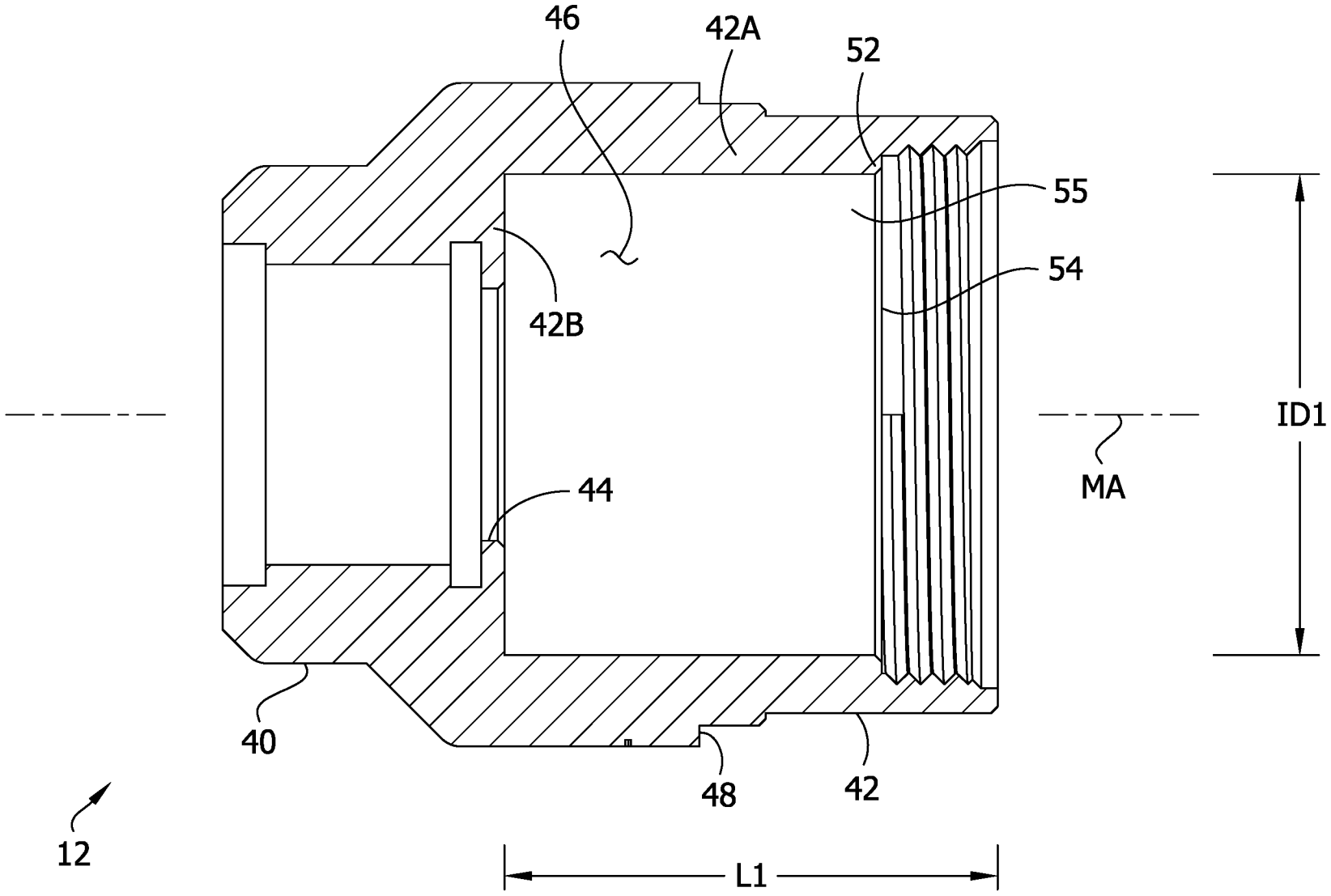
FIG. 10 is a longitudinal section taken in the plane of line 10-10 of FIG. 8.
Figure 11:
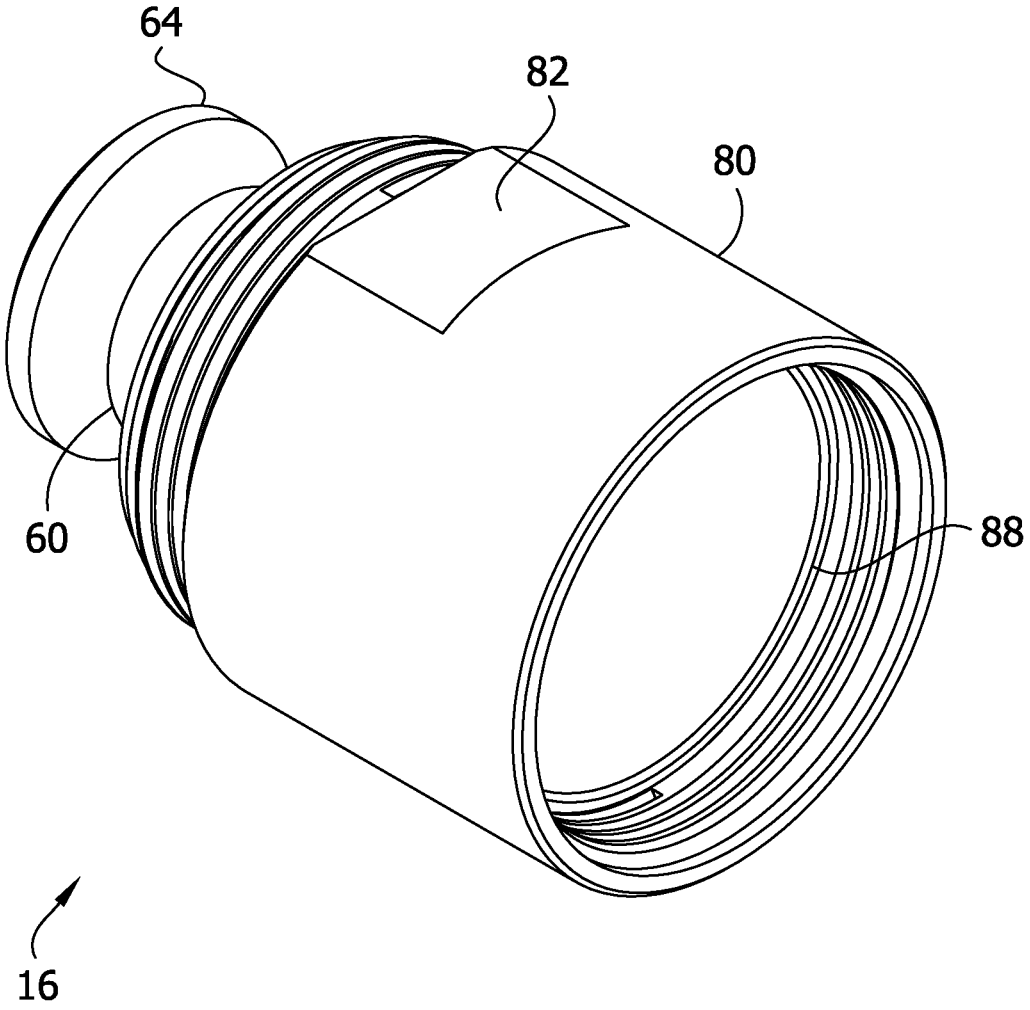
FIG. 11 is a perspective of a blast baffle cup of the suppressor.
Figure 12:
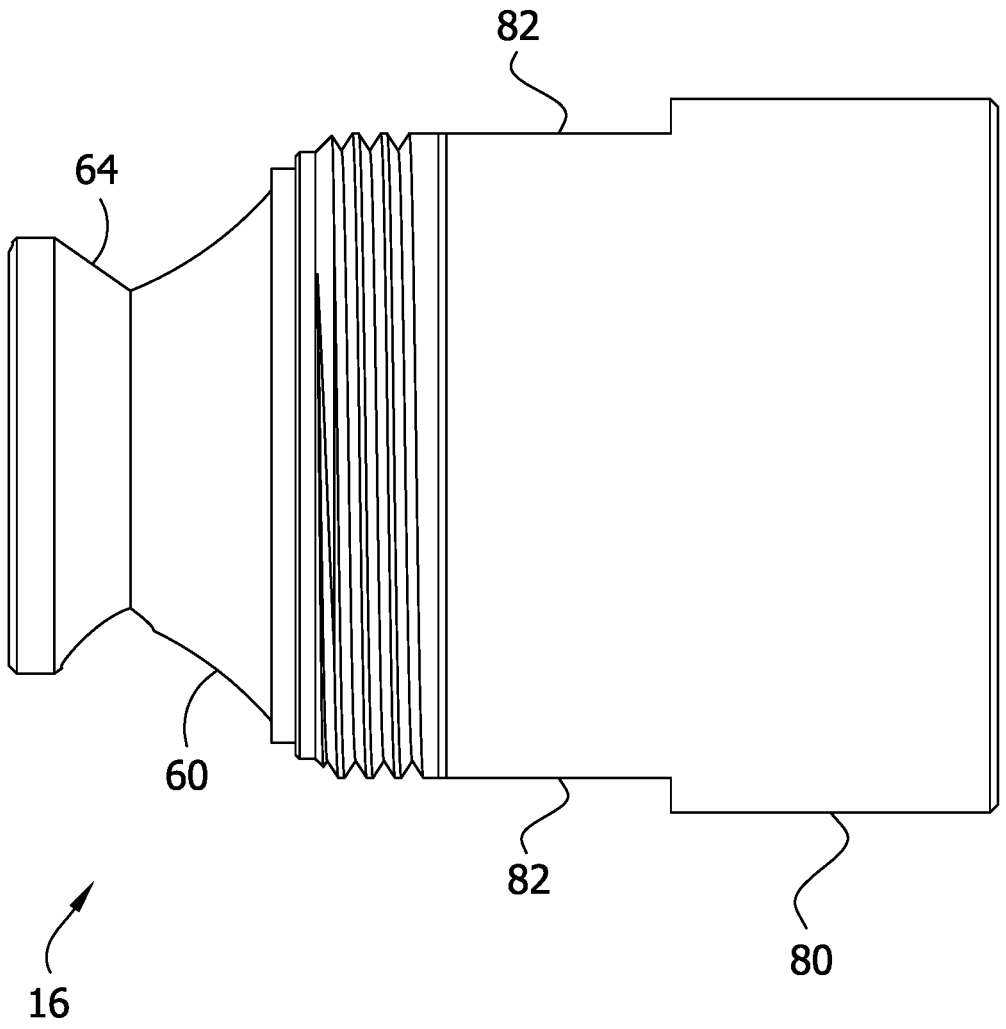
FIG. 12 is a front elevation of the blast baffle cup.
Figure 13:
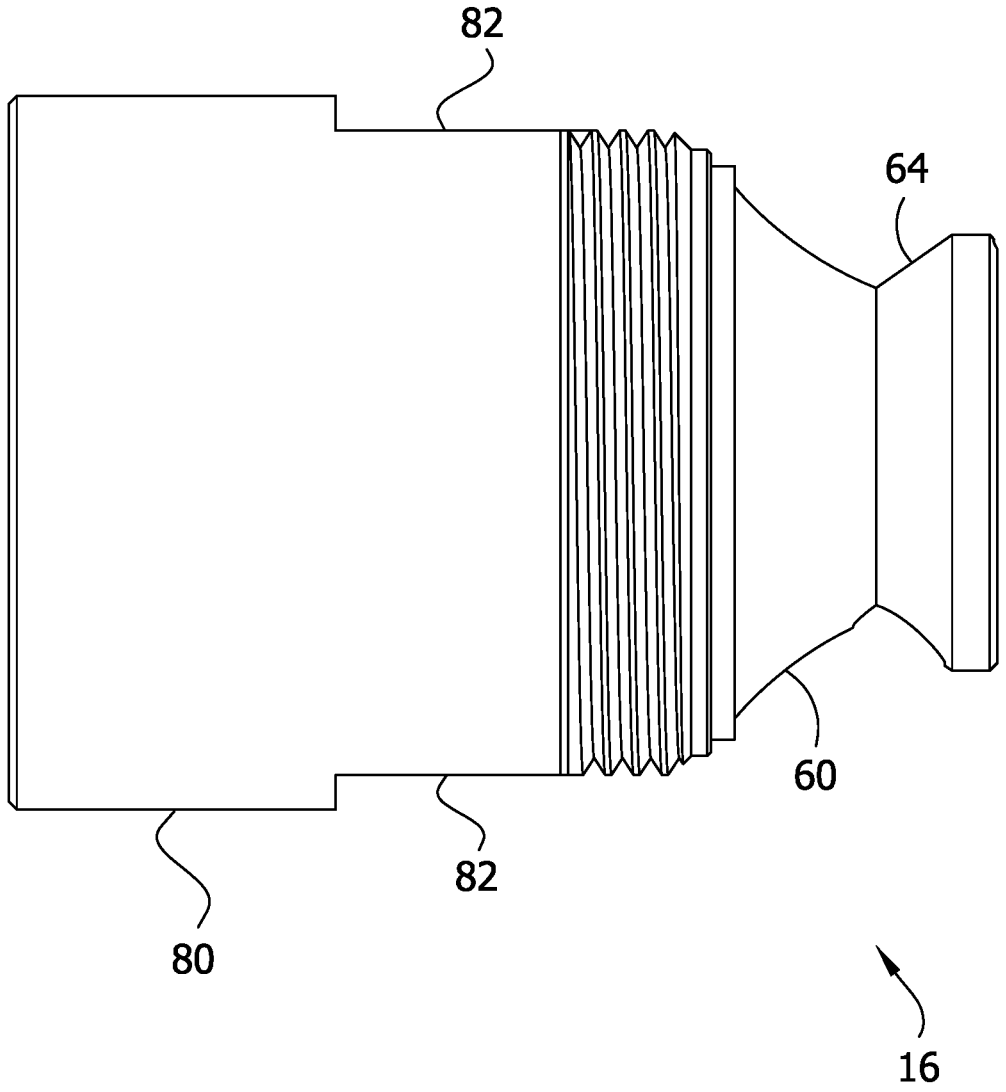
FIG. 13 is a rear elevation of the blast baffle cup.
Figure 14:
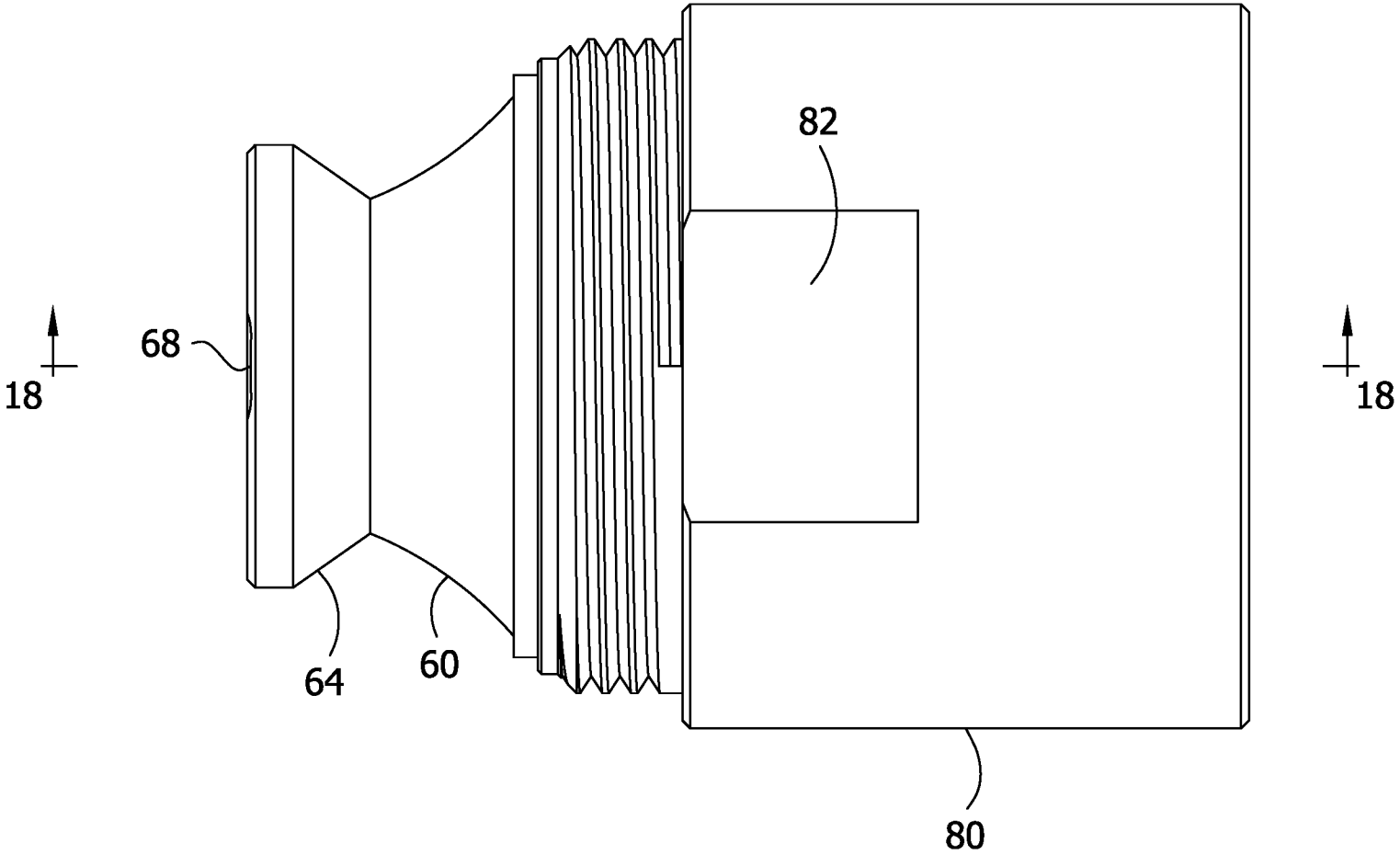
FIG. 14 is a top plan view of the blast baffle cup.
Figure 15:
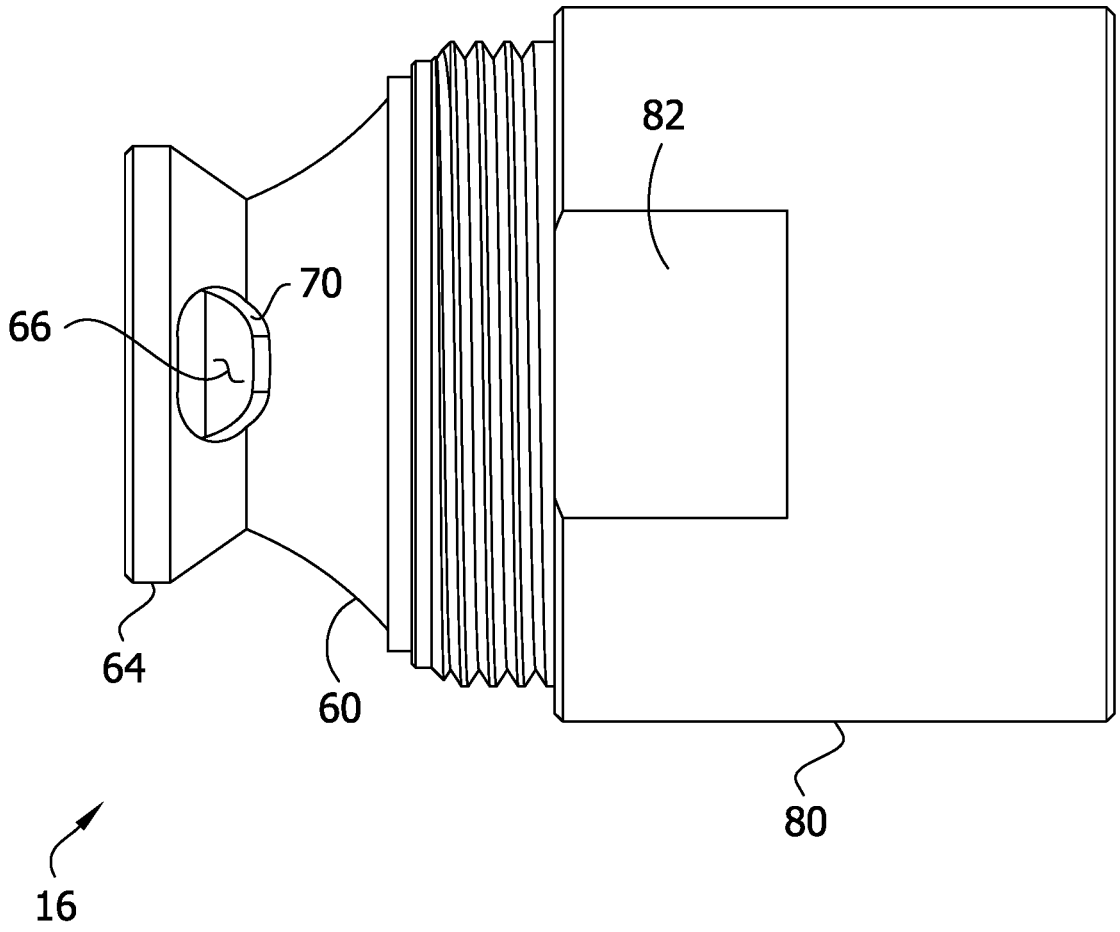
FIG. 15 is a bottom plan view of the blast baffle cup.
Figure 16:
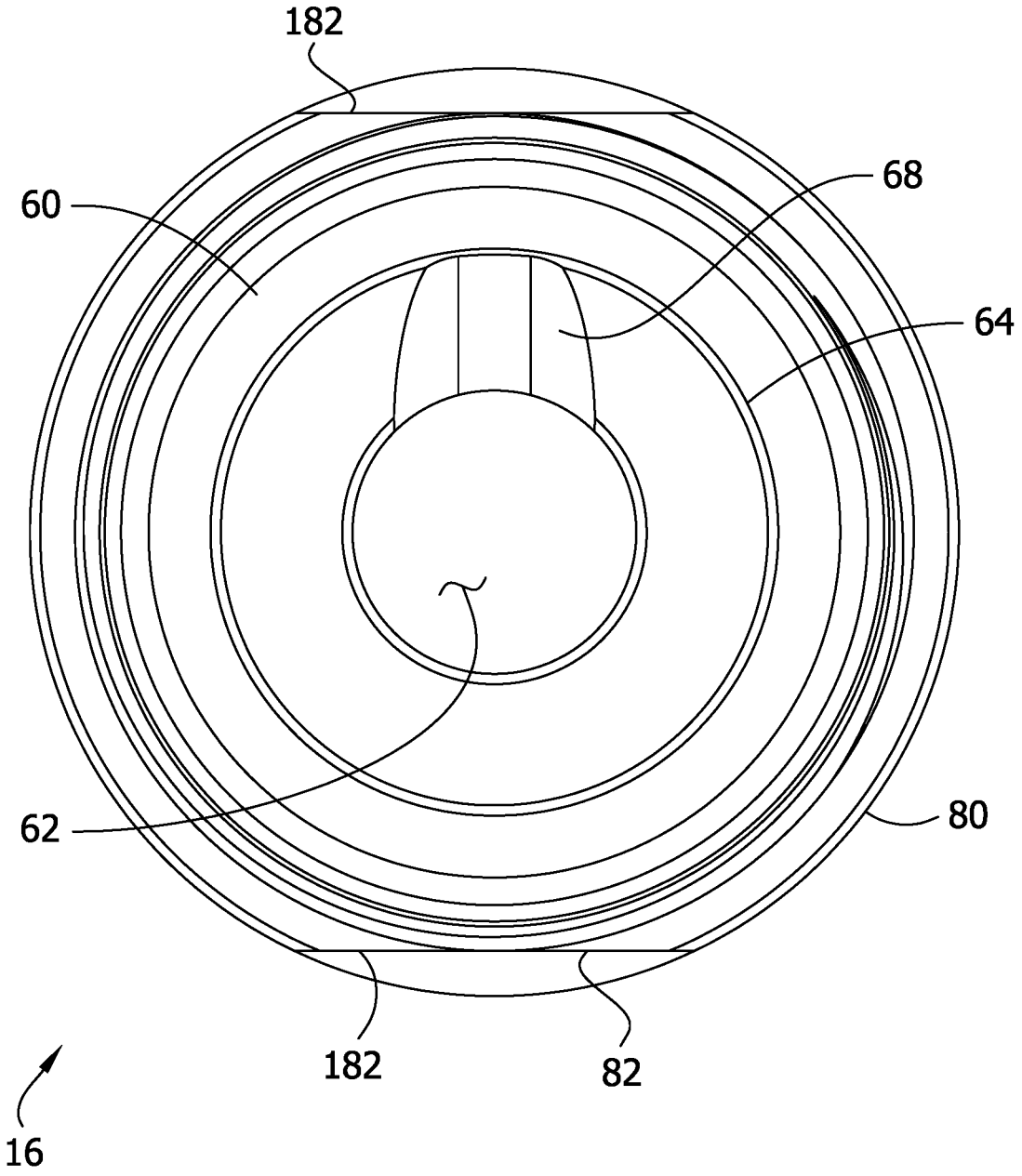
FIG. 16 is a distal end elevation of the blast baffle cup.
Figure 17:
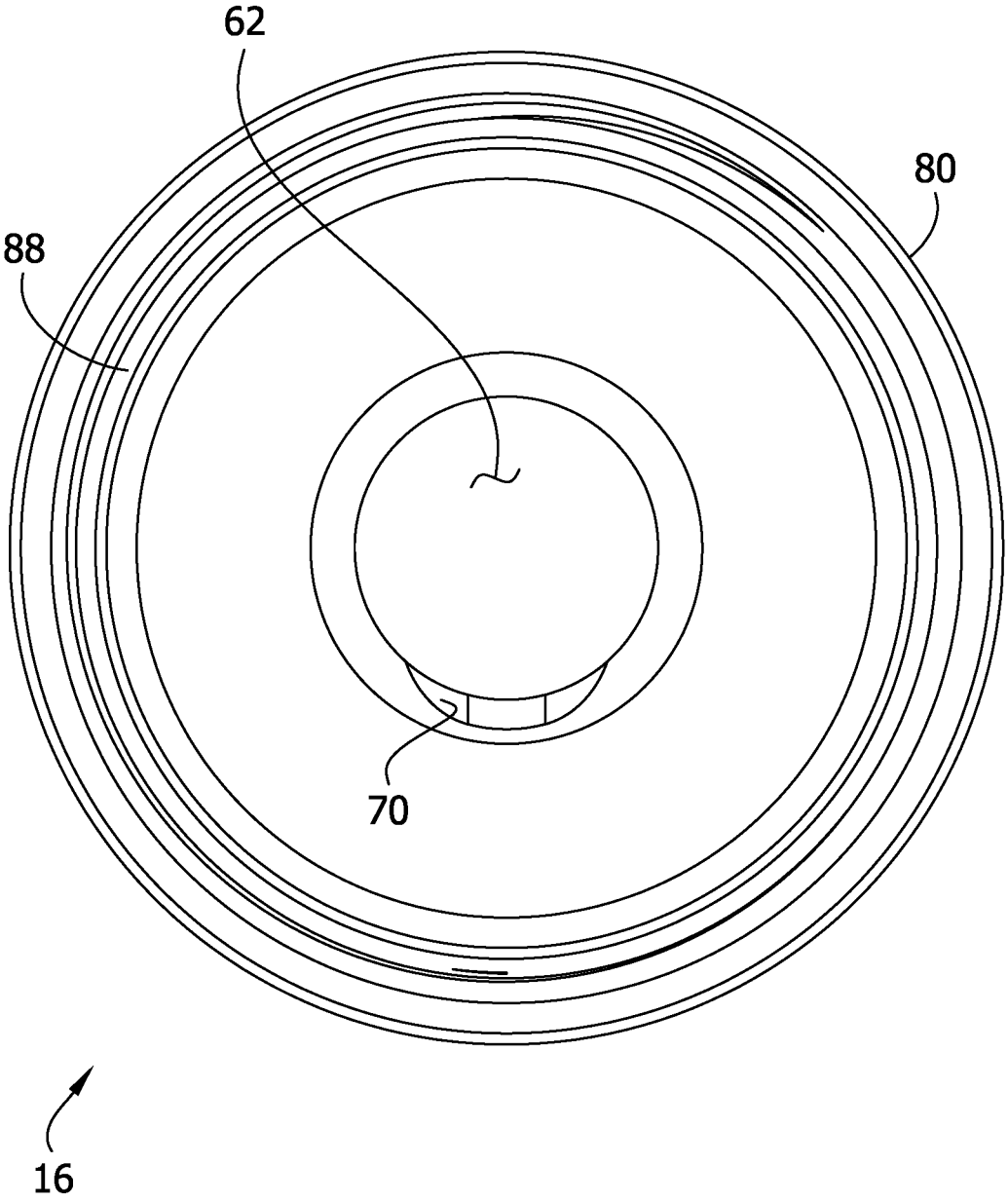
FIG. 17 is a proximal end elevation of the blast baffle cup.

The receptacle portion 42 of the muzzle mount 12 defines a radially outward and distal facing annular shoulder 48 on the exterior of the cylindrical perimeter side wall. The annular shoulder 48 is sized and arranged for being engaged with distal end portion of the shroud 22 as shown in FIG. 3. Specifically, the distal facing surface of the shoulder 48 opposingly engages the proximal end of the shroud 22 and the radially outward facing surface is received in the interior of the distal end portion of the shroud. As shown in FIG. 10, a distal end section of the receptacle portion 42 distal of the annular shoulder 48 has a smaller outer diameter than the radially outward facing surface of the annular shoulder. As a result, when the shoulder 48 engages the proximal end portion of the shroud 22 as shown in FIG. 3, an air gap 50 extends radially between the distal end section of the muzzle mount 12 and the shroud 22 to limit heat transfer between the muzzle mount and the shroud. Furthermore, the diameter of the radially outward facing surface of the annular shoulder 48 is larger than the outer diameters of the baffle cups 16, 18, 20 such that the air gap 50 is substantially continuous along the segment of the length of the suppressor 10 extending between the shoulder and the end cap 14.

Referring again to FIG. 10, a distal end segment of the receptacle portion 42 is internally threaded for forming a threaded connection with the proximal-most blast baffle cup 16 as discussed in further detail below. The receptacle portion 42 also includes an annular shoulder 52 projecting radially inward from the perimeter side wall at a location immediately proximal to the threaded distal end segment along the axis MA. The shoulder 52 defines a distally facing annular sealing surface 54 for sealingly engaging the proximal blast baffle cup 16 as described in further detail below. The annular shoulder 52 also defines an axially extending annular surface 55 extending proximally from adjacent the distally facing sealing surface 54. The annular surface 55 is generally cylindrical and has an inner diameter ID1. In addition, the shoulder 52 includes a sloping annular chamfer forming angles with the distally facing sealing surface 54 and the proximally extending surface 55 and intersecting the sealing surface at an inner radial end thereof and the proximally extending surface at the distal end thereof.

Referring to FIGS. 11-18, the first and second blast baffle cups 16 are substantially identical (it is understood that other numbers of blast baffle cups could be used without departing from the scope of the invention). In one or more embodiments, the blast baffle cups 16 are each formed from a single piece of machined metal stock (e.g., an aluminum-scandium alloy). As explained in further detail below, the blast baffle cups 16 are shaped and arranged to define relatively long blast chambers 28 (each, broadly, an expansion chamber) distal to the relatively short proximal chamber 26 in the assembled suppressor 10 (FIG. 3). The blast baffle cup 16 has an axis BA (FIG. 18) and proximal and distal ends spaced apart along the axis. In the illustrated suppressor 10, the axis BA of each blast baffle cup 16 is coincident with the axis SA of the suppressor. The blast baffle cup 16 has a length L2 (FIG. 18) extending along the axis BA from the proximal end to the distal end of the baffle cup. The length L1 of the socket 46 of the muzzle mount 12 is shorter than the length L2 of the blast baffle cup 16. In one or more embodiments, the length L1 of the socket 46 of the muzzle mount 12 is less than or equal to about 70% of the length L2 of the blast baffle cup 16. For example, in one or more embodiments, the length L2 of the blast baffle cup is in an inclusive range of from about 1.0 inches to about 1.5 inches, such as an inclusive range of from about 1.15 inches to about 1.35 inches, for example an inclusive range of from about 1.225 inches to about 1.275 inches. As explained below, using a blast baffle cup 16 that is longer than the socket 46 of the muzzle mount defines blast chambers 28 that are larger than the proximal chamber 26 of the suppressor, which has been found to enhance suppression performance by minimizing effects of first round pop (i.e., a relatively loud report of a first round of ammunition fired through the suppressor 10 in comparison with subsequent rounds of ammunition fired in immediate succession; first round pop is caused by a large air mass being present in the interior of the suppressor, much of which is evacuated by combustion when the first round is fired).

The blast baffle cup 16 comprises a proximal baffle wall 60 extending generally around the axis BA and extending distally from the proximal end of the baffle cup. The illustrated baffle wall 60 is generally conical, though other baffle walls can have other shapes without departing from the scope of the invention. The baffle wall 60 has a cone axis coincident with blast baffle cup axis BA and a proximal end portion and a distal end portion spaced apart from one another along the cone axis. A diameter of the conical baffle wall 60 increases as the conical baffle wall extends from adjacent the proximal end portion toward the distal end portion. The conical baffle wall 60 has an outer diameter OD1 at the enlarged distal end. The baffle wall 60 has exterior surface that faces radially outwardly and proximally and an interior surface that faces radially inwardly and distally. The interior surface defines a bore 62 that extends generally along the axis BA. The bore 62 forms a part of the projectile passage 24 when the suppressor 10 is assembled.

A flange portion 64 of the blast baffle cup 16 extends radially outward from the proximal end portion of the conical baffle wall 60. The flange portion 64 has a proximal end oriented transverse (e.g., perpendicular) to the axis BA and an opposite distal end spaced apart from the proximal end along the axis. In the illustrated embodiment, the proximal end of the flange portion 64 is defined by a substantially planar surface that is oriented generally perpendicular to the axis BA. A proximal end segment of the flange portion 64 defines a generally cylindrical outer surface, and a distal end segment slopes inwardly from the distal end of the cylindrical outer surface to the distal end of the flange portion. The sloping distal end segment of the flange portion 64 has a conical shape that extends from a narrow end adjacent the distal end of the flange portion to an enlarged end spaced apart from the distal end toward the proximal end of the flange portion. The cylindrical proximal end segment of the flange portion 64 defines an outer diameter OD2 of the flange portion that is smaller than the outer diameter OD1 of the enlarged distal end of the conical baffle wall 60. Suitably, the outer diameter OD2 of the flange portion 64 is at least about 75% of the outer diameter OD1 (e.g., at least about 80%, at least about 85%, etc.). As explained below, the relatively small size difference between the outer surface of the flange portion 64 and the enlarged distal end of the conical wall 60 facilitates the provision of a restricted opening to an annular space defined between the sloping distal end segment of the flange portion and the exterior surface of the conical wall. When a round is fired through the assembled suppressor 10, the restricted opening increases turbulence in the interior of the suppressor which increases energy dissipation from the blast gas to enhance suppression.

Figure 18:
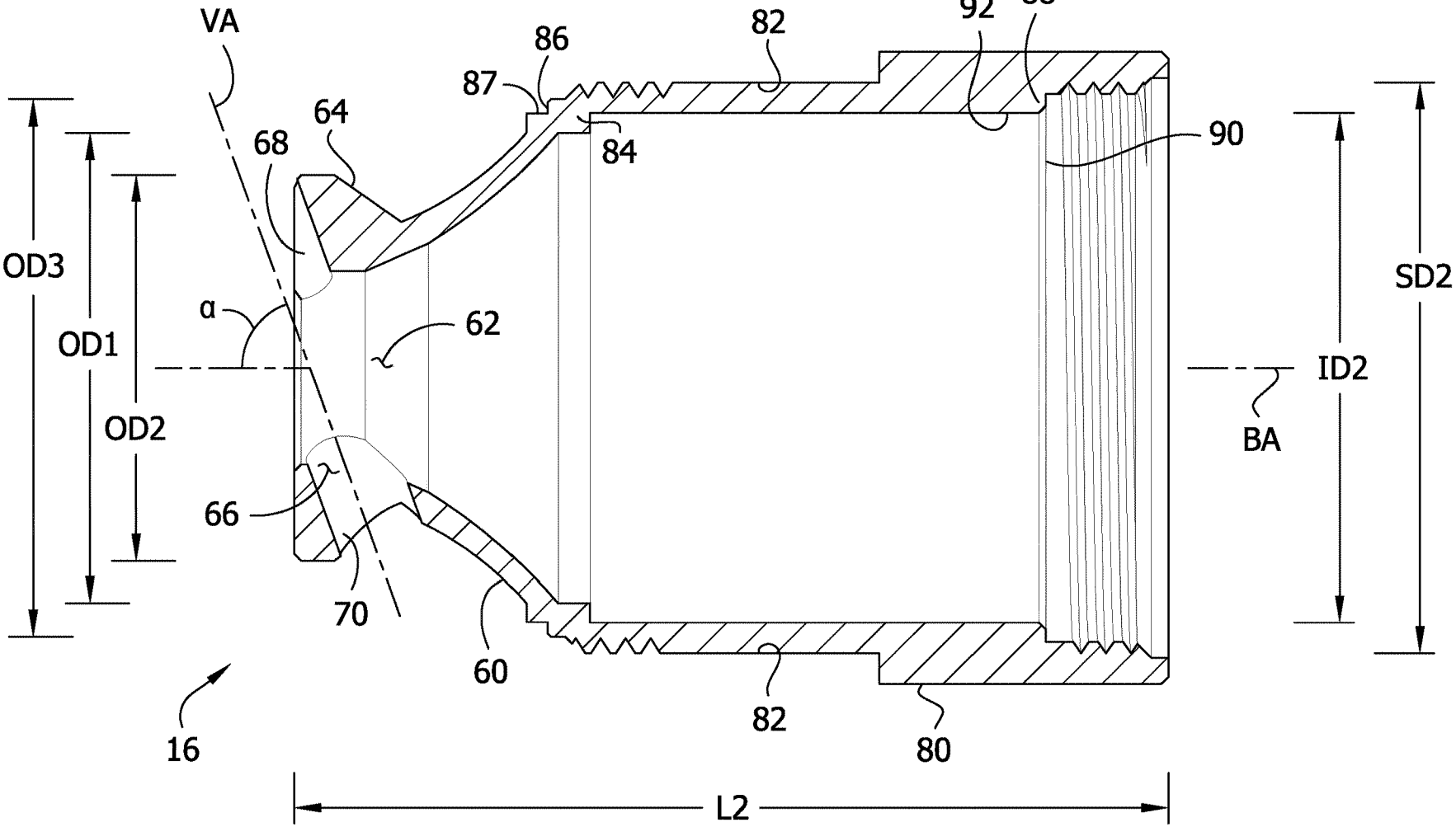
FIG. 18 is a longitudinal section taken in the plane of line 18-18 of FIG. 14.
Figure 19:
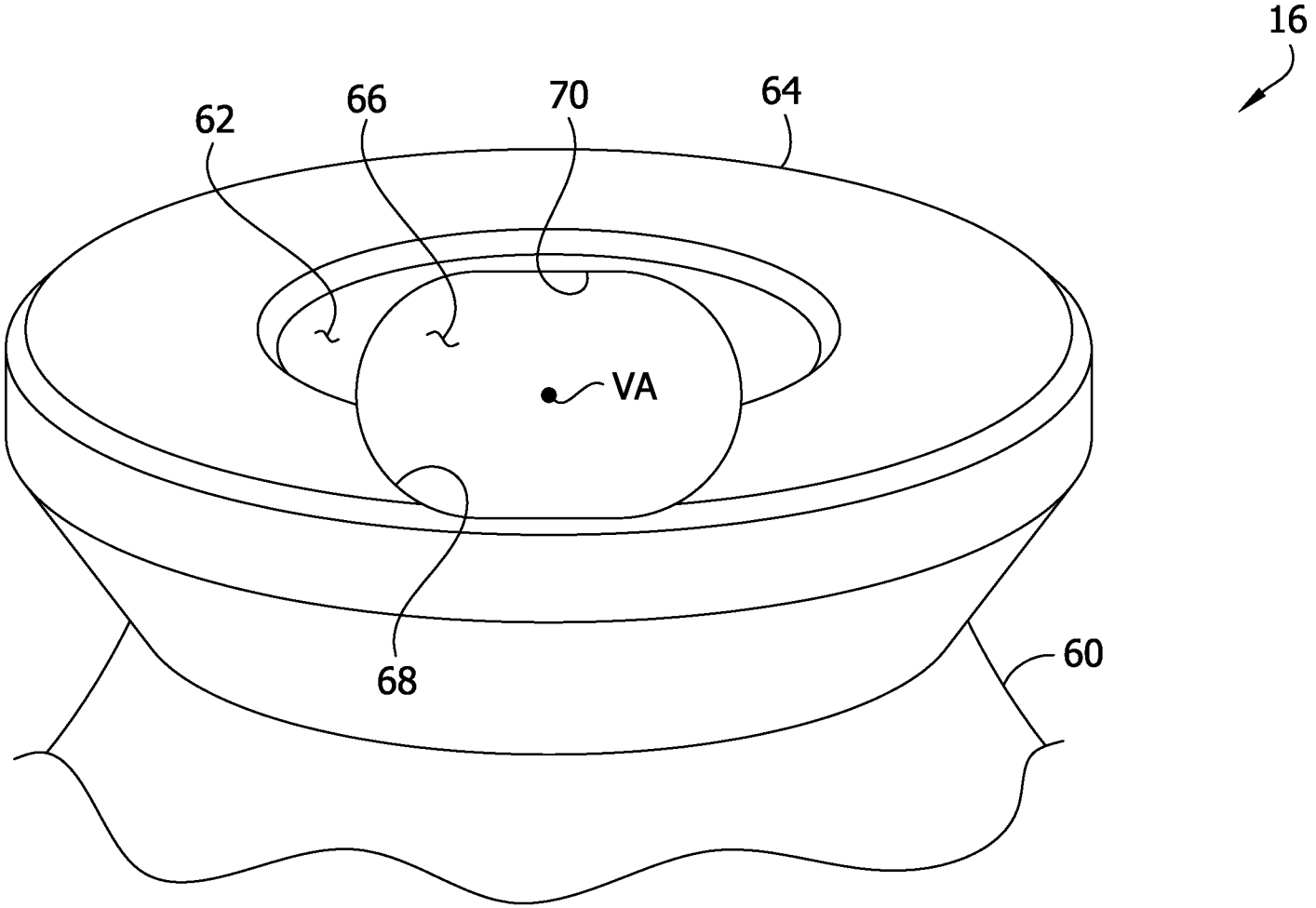
FIG. 19 is an enlarged, fragmentary perspective of a proximal end portion of the blast baffle cup from a vantage along an axis of a vent passage of the blast baffle cup.

Referring to FIGS. 18 and 19, a vent passage 66 extends through the distal end portion of the blast baffle cup 16 transverse to the projectile bore 62. The vent passage 66 extends along a venting axis VA oriented at a skew angle $\alpha$ with respect to the axis BA. In one or more embodiments, the skew angle $\alpha$ is in an inclusive range of from about 55° to about 85°, such as an inclusive range of from about 65° to about 75°, for example about 70°. The vent passage 66 opens on sides of the baffle cup 16 that are opposite to each other with respect to the axis BA. The vent passage 66 includes a groove 68 formed in the proximal end of the flange portion 64 and a vent hole 70. The venting axis VA is oriented so that the groove 68 intersects the proximal end of the flange portion 64 and the vent hole 70 intersects the distal end of the flange portion in the illustrated embodiment. In addition, the illustrated vent passage 66 is shaped and arranged so that the outer end of the groove 68 is located immediately adjacent the proximal end of the cylindrical proximal end segment of the flange portion 64. The groove 68 and the vent hole 70 form first and second segments of the vent passage 66 on generally opposite sides of the bore hole 62. The first and second segments of the vent passage 66 (e.g., the groove 68 and the vent hole 70) each extend along the same venting axis VA. The first segment opens to one side of the baffle cup 16 and the second segment opens to the opposite side of the baffle cup. The vent hole 70 has an opening that extends through the flange portion 64 and the conical baffle wall 60 (e.g., in the illustrated embodiment, the opening spans the intersection between the distal end segment of the flange portion and a portion of the conical baffle wall 60). In other embodiments, the vent passage can be oriented so that the opening of the vent hole 70 extends through only one of either the flange portion 64 or the conical baffle wall 60. The proximal end portion of the blast baffle cup 16 (e.g., one or both of the baffle wall 60 and the flange portion 64) entirely encloses the perimeter of the opening of the vent hole 70.

Referring to FIG. 19, in the illustrated embodiment, the opening of the vent hole 70 has a generally obround cross-sectional shape in a plane orthogonal to the venting axis VA. Other embodiments can have other cross-sectional shapes without departing from the scope of the invention. An imaginary volume can be defined by moving or sweeping the cross-sectional shape of the opening along the venting axis over the entire length of the vent passage 66. The imaginary volume is free of material of the conical baffle wall 60 and the flange portion 64. Furthermore, portions of the conical baffle wall 60 and the flange portion 64 that define the groove 68 and the hole 70 closely define the boundaries of the imaginary volume. As explained below, forming the groove 68 and the hole 70 to closely conform the dimensions of an imaginary volume defined by a shape that is swept along a venting axis minimizes manufacturing cost by enabling the vent passage 66 to be formed in a single material removal operation (e.g., using a multi-axis milling machine or the like). Moreover, forming the vent passage 66 enhances suppression performance by increasing turbulence inside the suppressor 10 when a round is fired. The groove 68 disrupts the otherwise planar proximal end surface of the blast baffle cup to redirect the flow of blast gas as it flows around and through the groove. In addition, the hole 70 directs some of the blast gas inside the bore hole 62 radially outward into the annular space between the distal end segment of the flange portion 64 and the exterior surface of the baffle wall 60. This portion of the blast gas intersects other blast gas entering the annular space through the restricted annular opening defined by the outer end of the flange portion 64. The intersection of these transverse gas flows creates additional turbulence in the annular space to absorb blast energy and reduce the report of the fired round.

Figure 20:
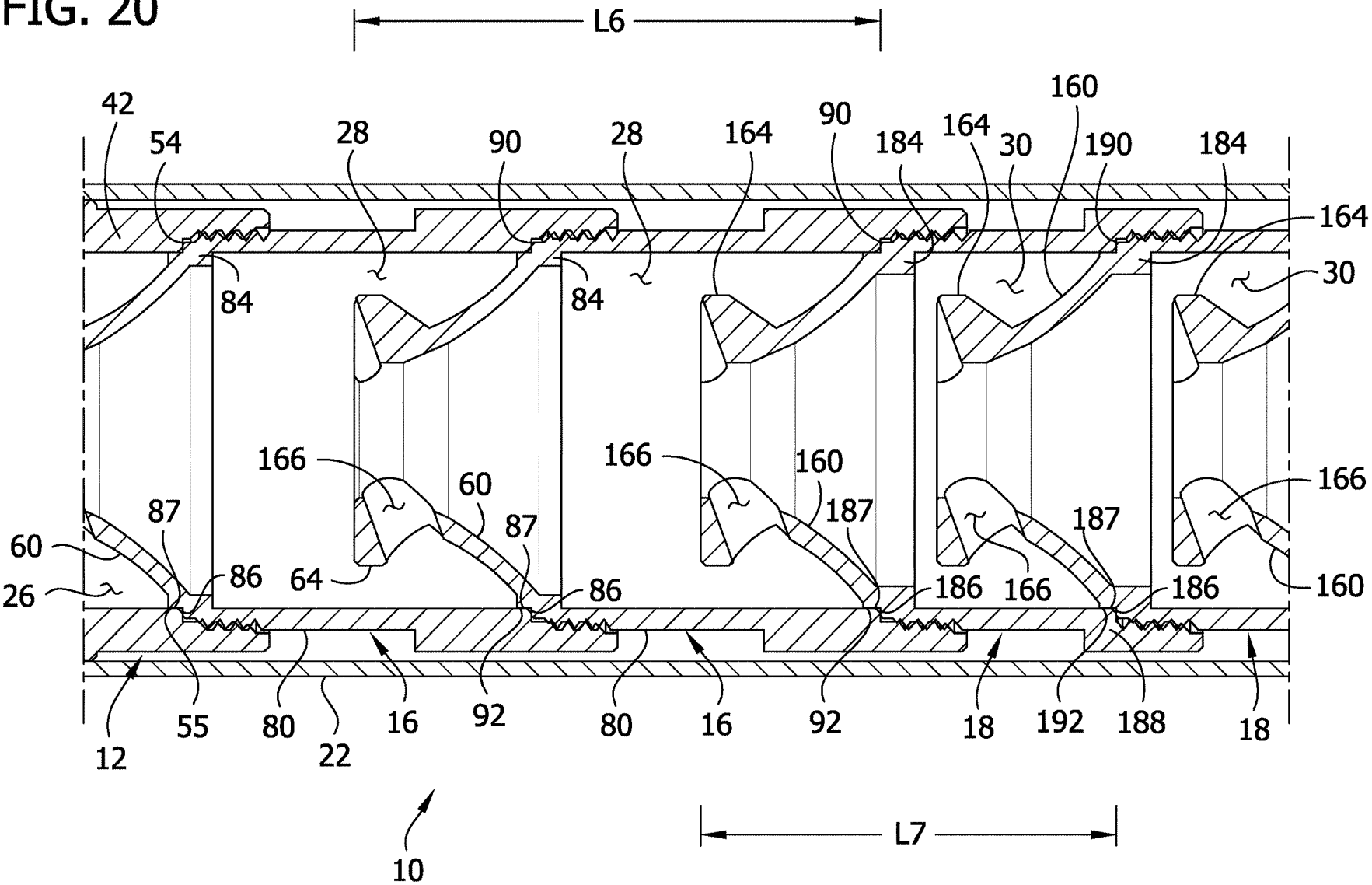
FIG. 20 is an enlarged view of a portion of FIG. 3.
Figure 21:
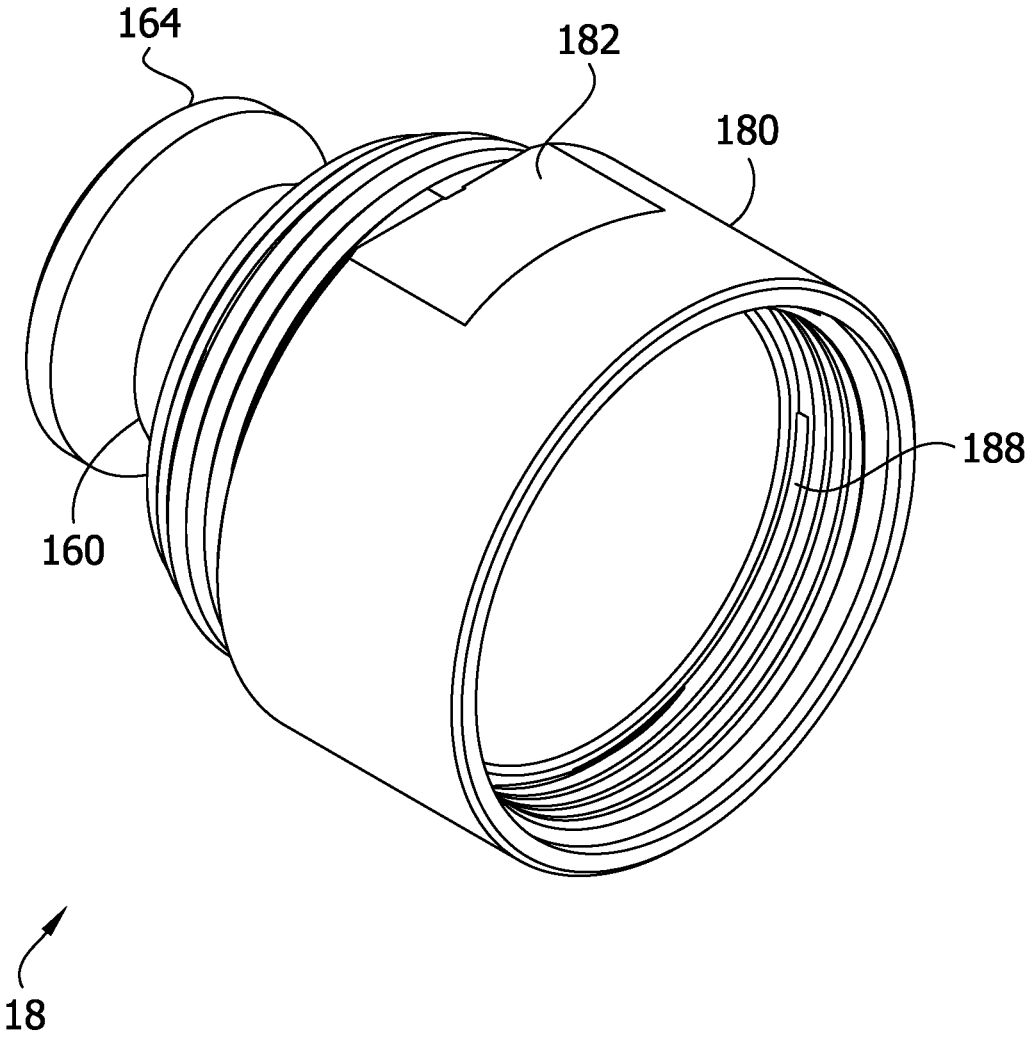
FIG. 21 is a perspective of an intermediate baffle cup of the suppressor.
Figure 22:
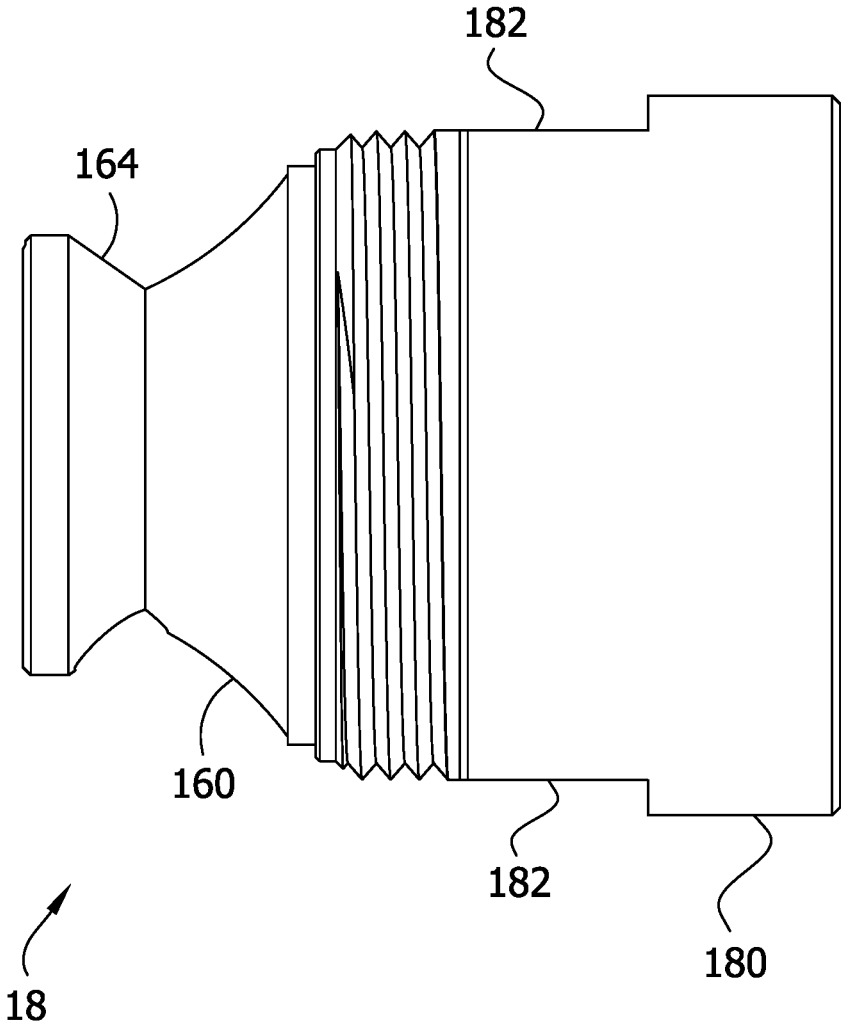
FIG. 22 is a front elevation of the intermediate baffle cup.
Figure 23:
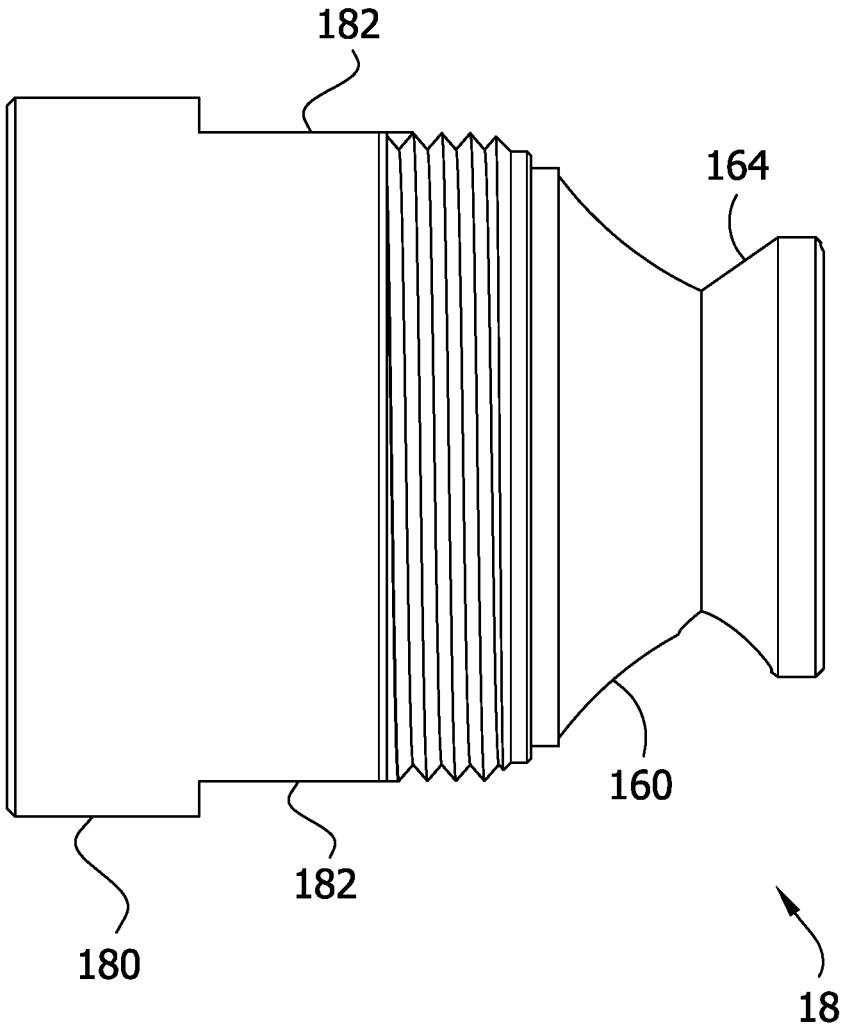
FIG. 23 is a rear elevation of the intermediate baffle cup.
Figure 24:
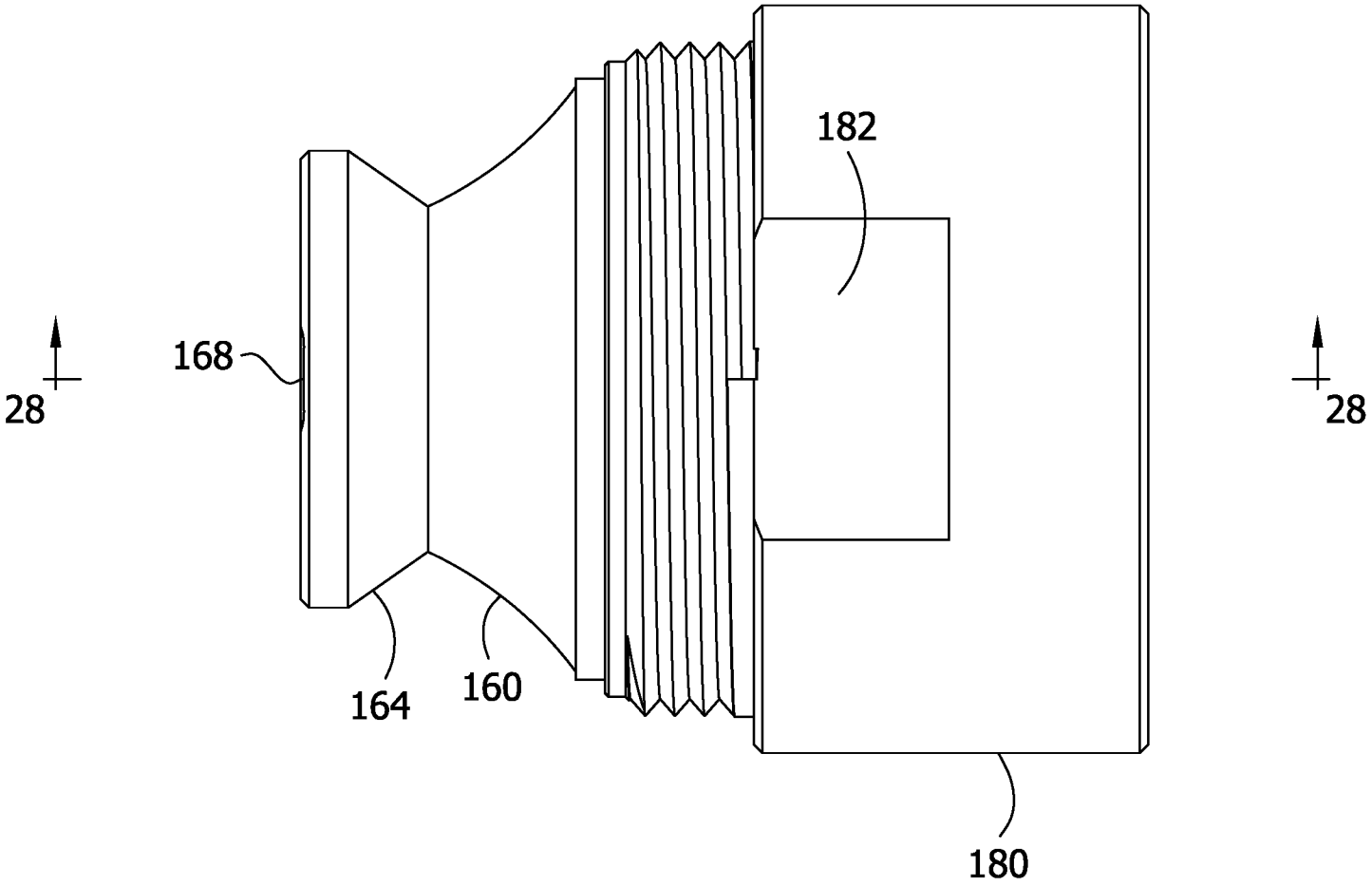
FIG. 24 is a top plan view of the intermediate baffle cup.
Figure 25:
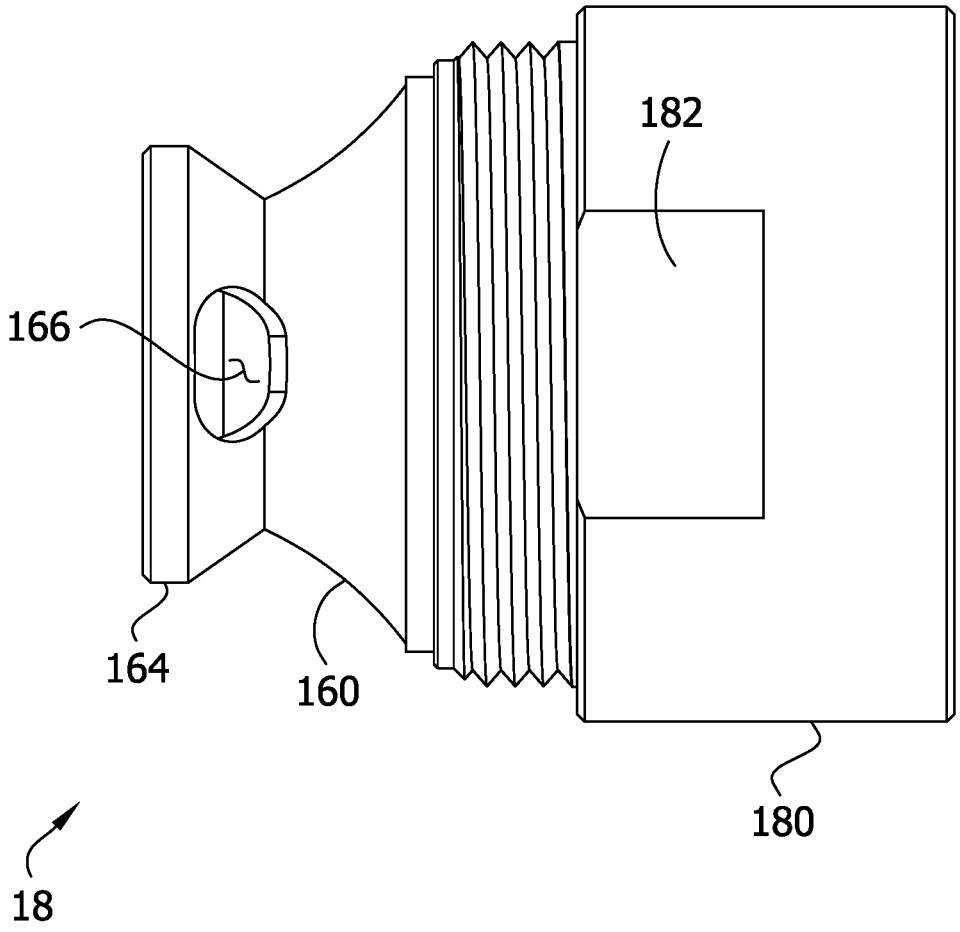
FIG. 25 is a bottom plan view of the intermediate baffle cup.
Figure 26:
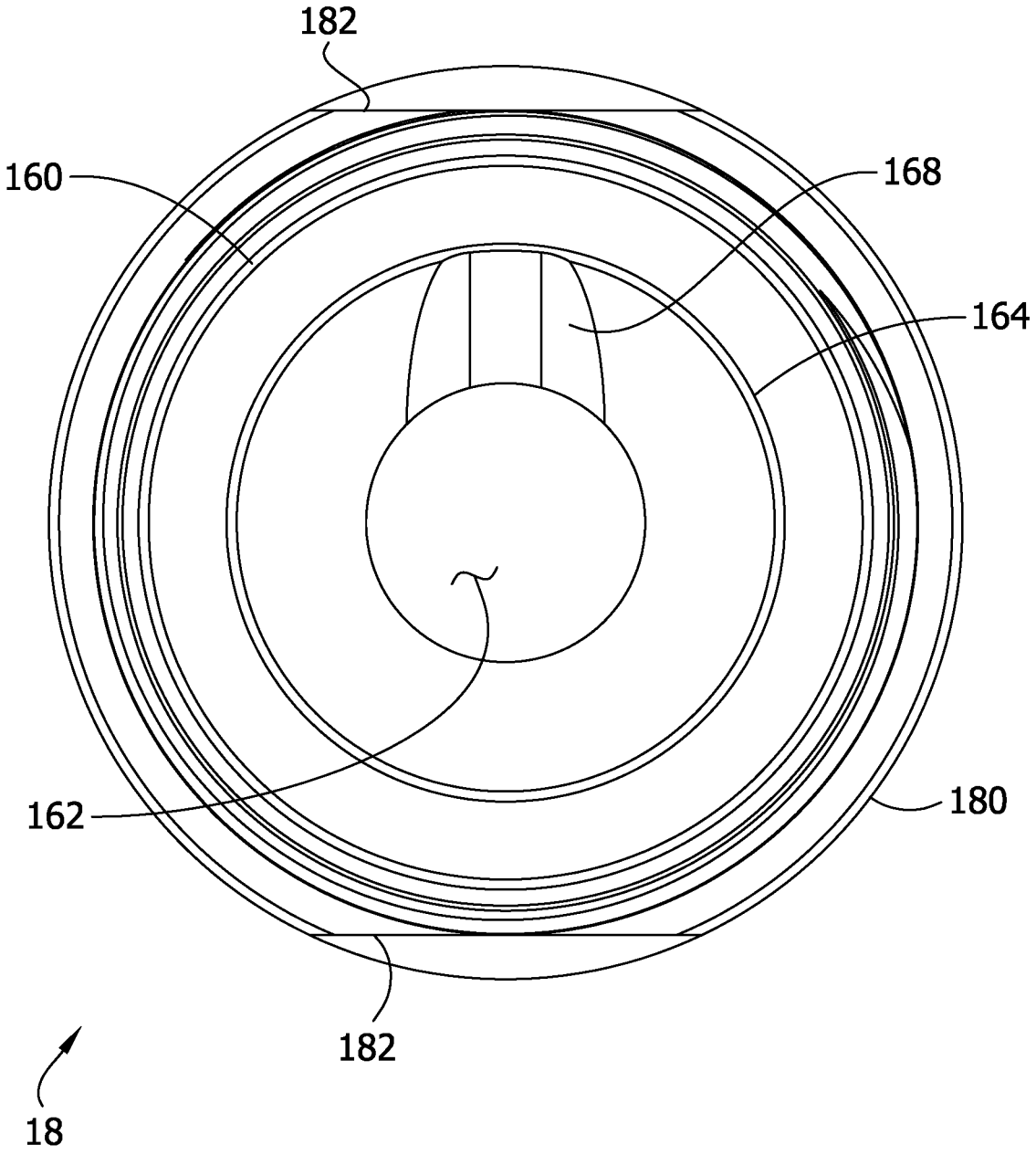
FIG. 26 is a distal end elevation of the intermediate baffle cup.
Figure 27:
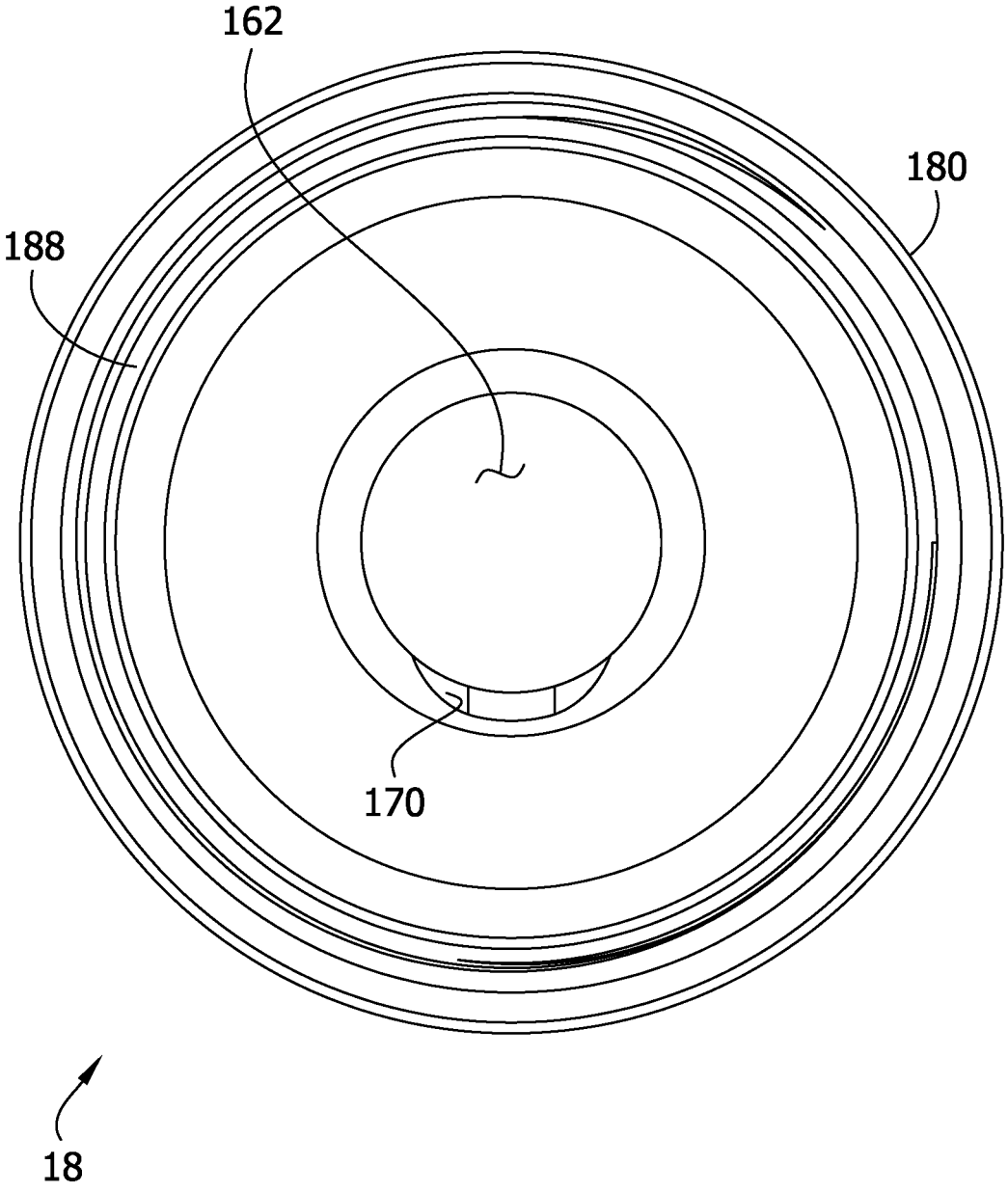
FIG. 27 is a proximal end elevation of the intermediate baffle cup.

Referring again to FIG. 18, the blast baffle cup 16 further comprises a distal spacer wall 80 extending distally from the distal end of the conical baffle wall 60. The spacer wall 80 has a generally cylindrical shape extending from a proximal end segment adjacent the baffle wall 60 to an opposite distal end segment that defines the distal end of the blast baffle cup 16. The exterior surface of the spacer wall 80 is generally cylindrical, except for two wrench flats 82 that are formed on diametrically opposite sides of the exterior surface. The wrench flats 82 are spaced apart from one another by a second spanning distance SD2. The second spanning distance SD2 is about the same as the first spanning distance SD1 of the muzzle mount 12 in the illustrated embodiment. Thus, the first wrench 1002 can be used to threadably rotate both the muzzle mount 12 and the blast baffle cup 16 when disassembling the suppressor 10. The proximal end segment of the spacer wall 80 is externally threaded and the distal end segment of the spacer wall is internally threaded. As shown in FIGS. 3 and 20, when the suppressor 10 is fully assembled, the externally threaded segment of the spacer wall 80 of the proximal blast baffle cup 16 is threadably received in the internally threaded segment of receptacle portion 42 of the muzzle mount 12 to form a threaded interface. The externally threaded segment of the spacer wall 80 of the distal blast baffle cup 16 is threadably received in the internally threaded segment of the spacer wall of the first blast baffle cup to form another threaded interface. As explained below, the internally threaded segment of the spacer wall 80 of the distal blast baffle cup 16 is configured to threadably receive one of the intermediate baffle cups 18 and form yet another threaded interface.

Referring to FIGS. 18 and 20, the blast baffle cups 16 are each shaped and arranged to define surfaces oriented transverse to the axis BA for forming sealed interfaces proximal to each of the threaded interfaces that connect the blast baffle cups to the muzzle mount 12. Each baffle cup 16 includes a first, proximal annular shoulder 84 projecting radially inwardly from the spacer wall 80 adjacent the proximal end segment thereof. The proximal annular shoulder 84 defines a proximally facing sealing surface 86 oriented transverse to (e.g., perpendicular to) the axis BA and located proximal of the externally threaded segment of the spacer wall 80. Similarly, the blast baffle cup 16 includes a second, distal annular shoulder 88 projecting radially inwardly adjacent and proximal to the internally threaded distal end segment of the spacer wall 80. Like the proximal annular shoulder 84, the distal annular shoulder 88 defines a distally facing sealing surface 90 oriented transverse to (e.g., perpendicular to) the axis BA and located proximal of the internally threaded distal end segment of the spacer wall 80. As explained in further detail below, in the illustrated suppressor 10, the opposing transverse sealing surfaces 54, 86, 90 adjacent the respective threaded interface that connects the proximal blast baffle cup 16 to the muzzle mount 12 and the distal baffle cup to the proximal baffle cup engage one another to form a sealed interface that limits the ingress of contaminants into the threaded interface In addition, the shoulders 52, 84, 88 of the muzzle mount 12 and the blast baffle cups 16 are shaped and arranged to form mating slip fit connections adjacent each threaded interface that connects the proximal blast baffle cup to the muzzle mount and the distal baffle cup to the proximal baffle cup. The proximal annular shoulder 84 of each blast baffle cup 16 defines an axially extending and outwardly facing annular surface 87 extending proximally from adjacent the proximally facing sealing surface 86. In the illustrated embodiment, the proximally extending surface 87 is generally cylindrical and has an outer diameter OD3 (FIG. 18). The distal annular shoulder 88 defines an axially extending and inwardly facing annular surface 92 extending proximally from adjacent the distally facing sealing surface 90. In the illustrated embodiment, the inwardly facing surface 92 is generally cylindrical and has an inner diameter ID2. In addition, like the inwardly extending annular shoulder 52 of the muzzle mount 12, the distal annular shoulder 88 of the blast baffle cup 16 further defines a sloping annular chamfer oriented at angles to the distally facing sealing surface 90 and the inwardly facing surface 92 and intersecting the distally facing sealing surface at the radially inner end thereof and intersecting the inwardly facing surface at the distal end thereof. Suitably, the inner diameter ID1 of the muzzle mount shoulder 52 and the inner diameter ID2 of the distal shoulder 88 of the blast baffle cup 16 are greater than the outer diameter OD3 of the proximal shoulder 84 of the blast baffle cup by a diameter offset. In one or more embodiments, the diameter offset is less than or equal to 0.0025 inches. The slightly larger inwardly facing annular surfaces 55, 92 are shaped and arranged to receive the outwardly facing annular surfaces 87 of each of the blast baffle cups 16 in the manner of a slip fit connection. Moreover, the chamfered surfaces of the inwardly extending shoulders 52, 88 aid in centering the inwardly extending shoulders around the outwardly facing axial surfaces 87 when the proximal blast baffle cup16 is connected to the muzzle mount 12 during assembly.

Referring to FIGS. 21-28, the intermediate baffle cups 18 are substantially identical to one another and similar in many respects to the blast baffle cup 16. Features of the intermediate baffle cup 18 that correspond to features of the blast baffle cup 16 are given the same reference number, plus 100. In one or more embodiments, the intermediate baffle cups 18 are each formed from a single piece of machined metal stock (e.g., an aluminum-scandium alloy). As explained in further detail below, in the assembled suppressor 10 (FIG. 3), the intermediate baffle cups 18 are shaped and arranged to define relatively short intermediate suppression chambers 30 (each, broadly, an expansion chamber) distal to the relatively long blast baffle chambers 28 and the relatively short proximal chamber 26. The intermediate baffle cup 18 has an axis IA (FIG. 28) and proximal and distal ends spaced apart along the axis. In the illustrated suppressor 10 (FIG. 3), the axis IA of each intermediate baffle cup 18 is coincident with the axis SA of the suppressor. The intermediate baffle cup 18 has a length L3 (FIG. 28) extending along the axis IA from the proximal end to the distal end of the baffle cup. The length L3 of the intermediate baffle cup 18 is shorter than the length L2 of the blast baffle cup 16, and the length L1 of the socket 46 of the muzzle mount 12 is shorter than the length L3 of the intermediate baffle cup. In one or more embodiments, the length L1 of the socket 46 of the muzzle mount 12 is less than or equal to about 80% of the length L3 of the intermediate baffle cup 18 and the length L3 of the intermediate baffle cup is less than or equal to about 85% of the length L2 of the blast baffle cup 16. For example, in one or more embodiments, the length L3 of the intermediate baffle cup 18 is in an inclusive range of from about 0.75 inches to about 1.25 inches, such as an inclusive range of from about 0.85 inches to about 1.15 inches, for example an inclusive range of from about 0.95 inches to about 1.05 inches. As explained below, using an intermediate baffle cup 18 that is longer than the socket 46 of the muzzle mount and shorter than the blast baffle cup 16 defines intermediate suppression chambers 30 that are larger than the proximal chamber 26 of the suppressor 10 and smaller than the blast chambers 28. Distributing the sizes of the chambers 26, 28, 30 along the length of the suppressor 10 in this manner has been found to enhance suppression performance.

Like the blast baffle cup 16, the intermediate baffle cup 18 comprises a proximal baffle wall 160 and a flange portion 164 extending radially outward from the proximal end portion of the baffle wall. In the illustrated embodiment, the baffle wall 160 and the flange portion 164 have substantially identical sizes, shapes, and arrangements to the baffle wall 60 and the flange portion 64 of the blast baffle cup 16. Thus, like the baffle wall 60, the baffle wall 160 is conical in shape, having a cone axis coincident with baffle cup axis IA and a narrow proximal end portion and an enlarged distal end portion spaced apart from one another along the cone axis. The enlarged distal end portion of the conical baffle wall 160 has an outer diameter OD1' that is substantially the same as the outer diameter OD1 of the enlarged distal end portion of the conical baffle wall 60. The baffle wall 160 also defines a projectile bore 162 shaped and arranged for partially defining the projectile passage 24 when the suppressor 10 is assembled to allow the round to travel through the intermediate baffle cup 18 along the projectile passage. Like the flange portion 64, the flange portion 164 has a substantially planar proximal end oriented transverse (e.g., perpendicular) to the axis IA, a substantially cylindrical proximal end segment that defines an outer surface of the flange portion having an outer diameter OD2' substantially equal to the outer diameter OD2, and an opposite distal end segment that slopes inwardly from the distal end of the cylindrical outer surface to the distal end of the flange portion. As above, the outer diameter OD2' of the flange portion 164 is at least about 75% of the outer diameter OD1' (e.g., at least about 80%, at least about 85%, etc.) to provide a restricted opening to an annular space extending between the sloping distal end segment of the flange portion and the exterior surface of the conical baffle wall 160.

Figure 28:
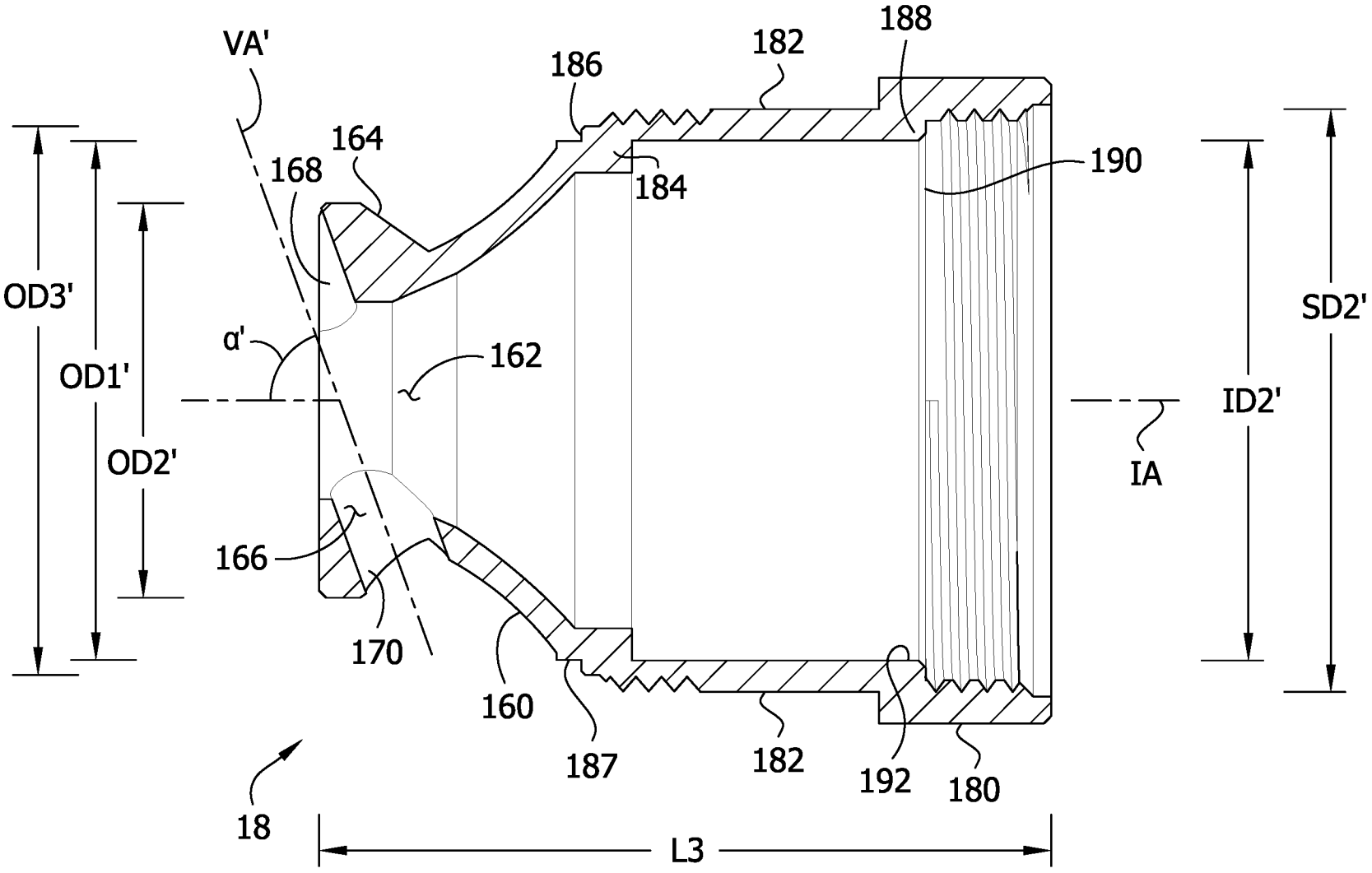
FIG. 28 is a longitudinal section taken in the plane of line 28-28 of FIG. 24.
Figure 29:
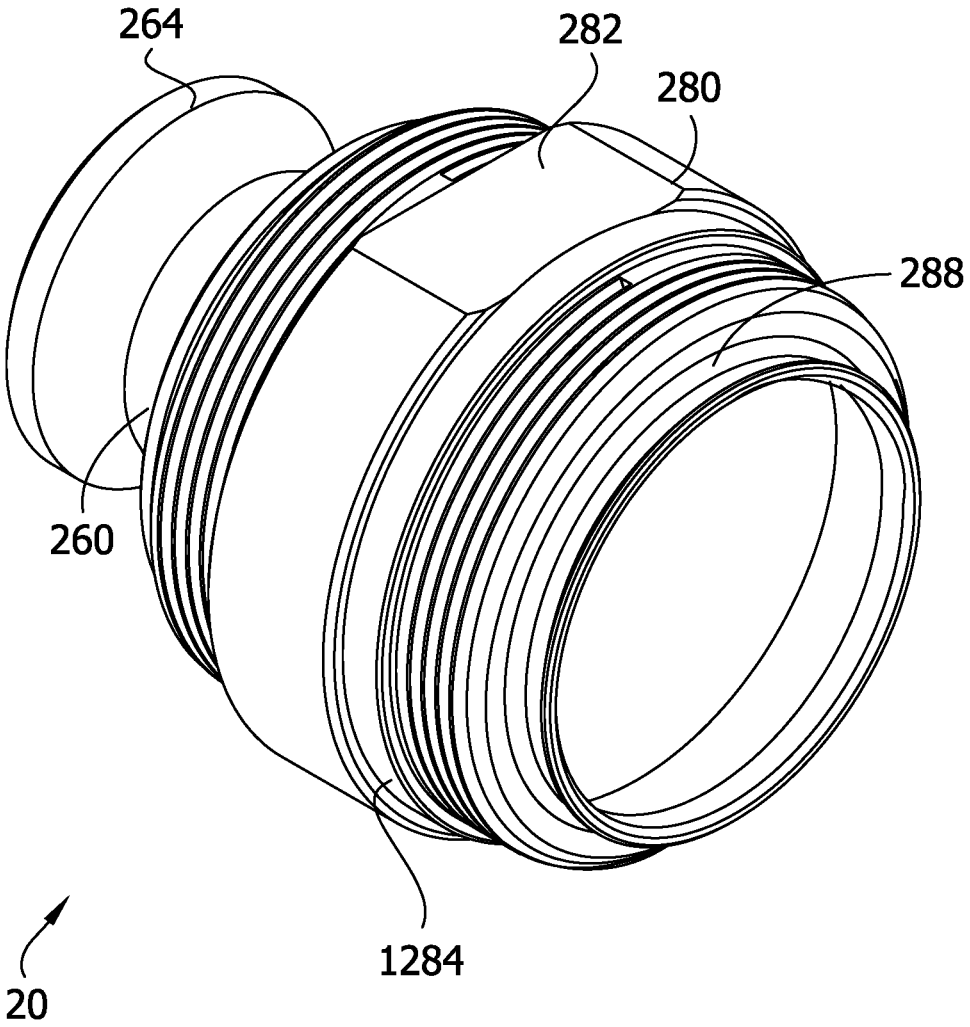
FIG. 29 is a perspective of a distal baffle cup of the suppressor.
Figure 30:
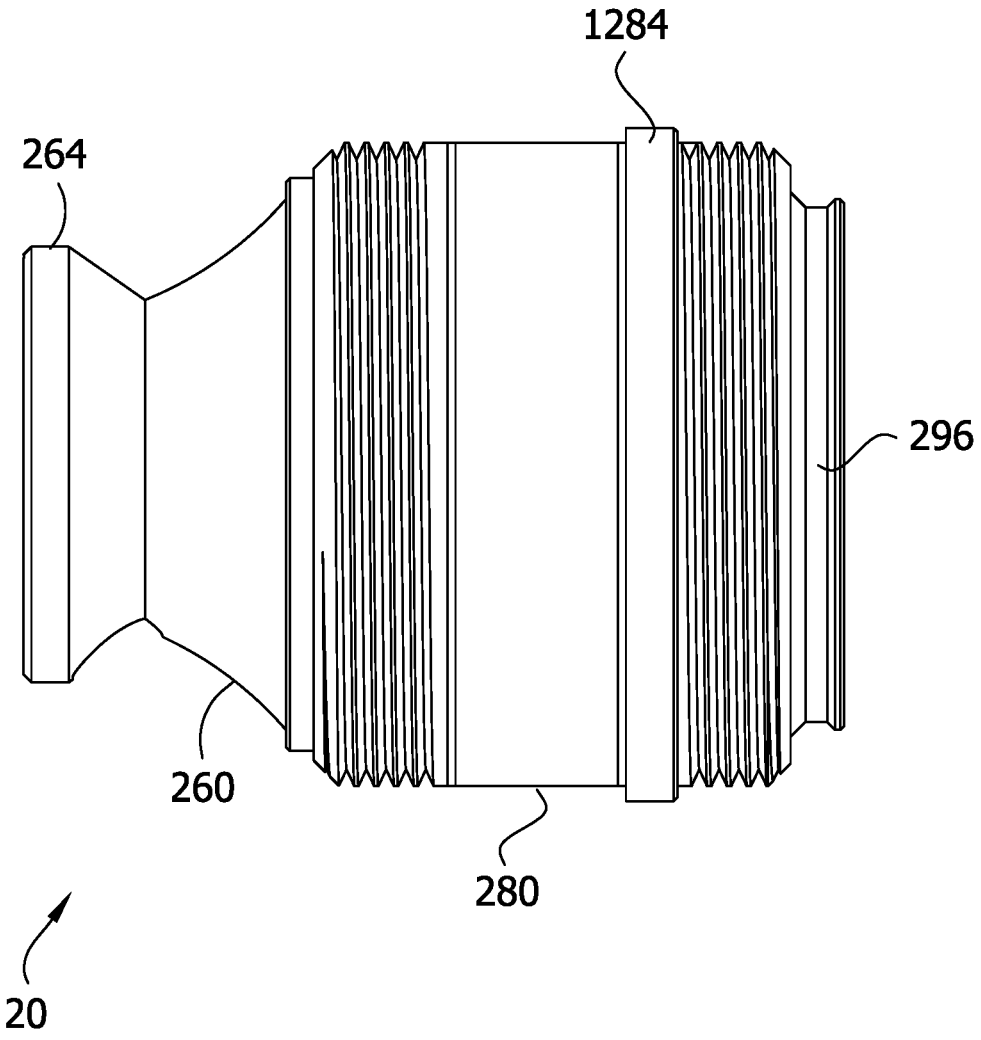
FIG. 30 is a front elevation of the distal baffle cup.
Figure 31:
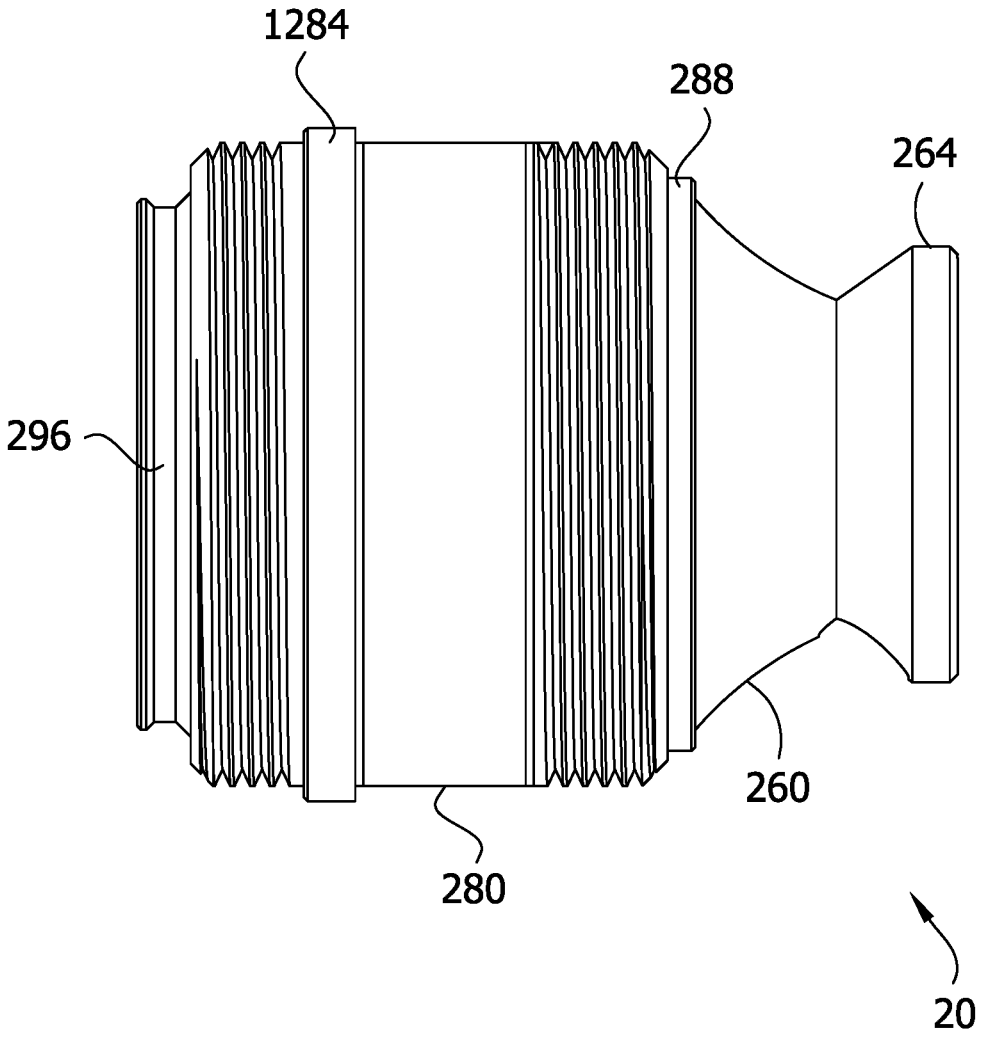
FIG. 31 is a rear elevation of the distal baffle cup.
Figure 32:
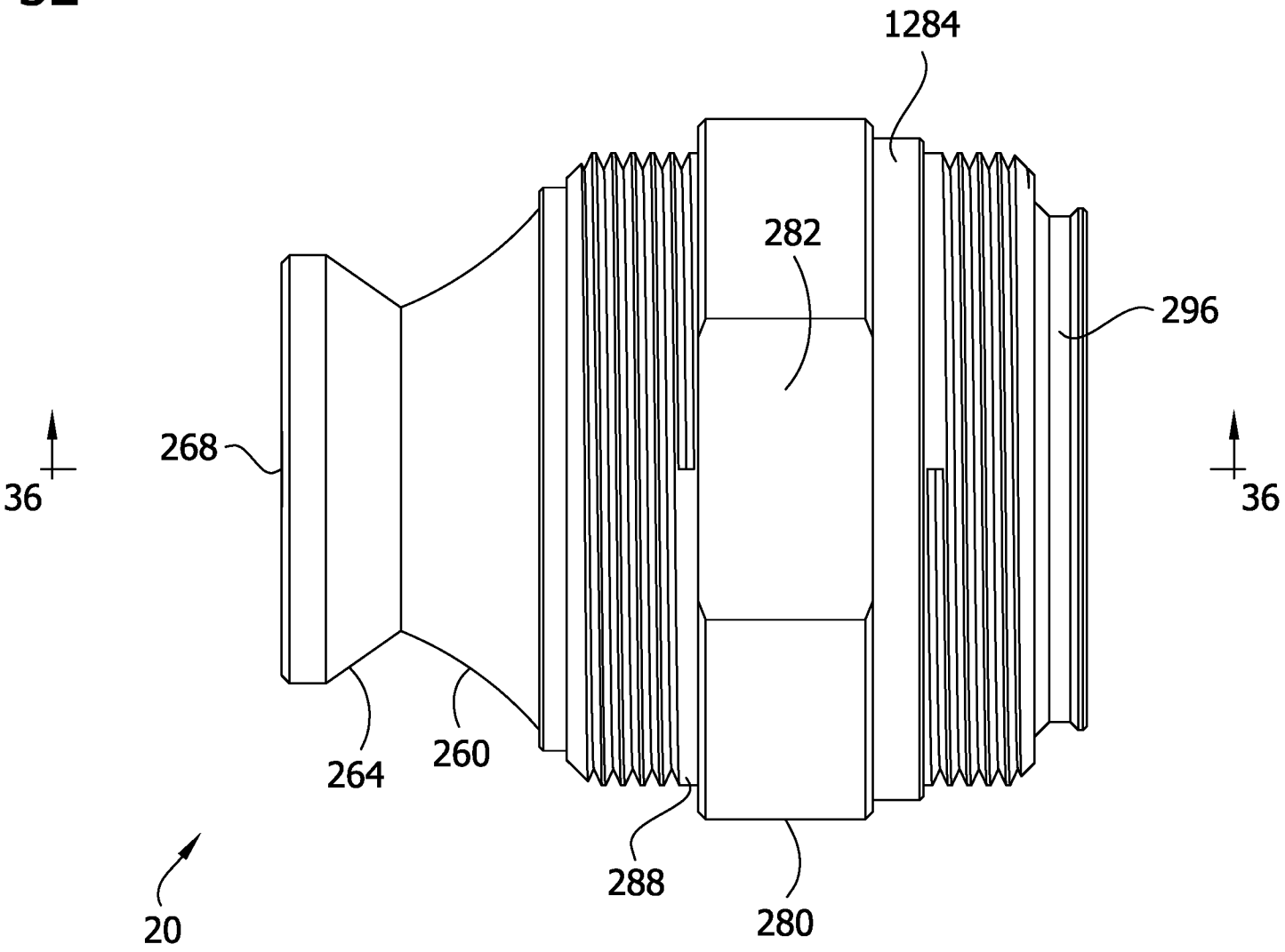
FIG. 32 is a top plan view of the distal baffle cup.
Figure 33:
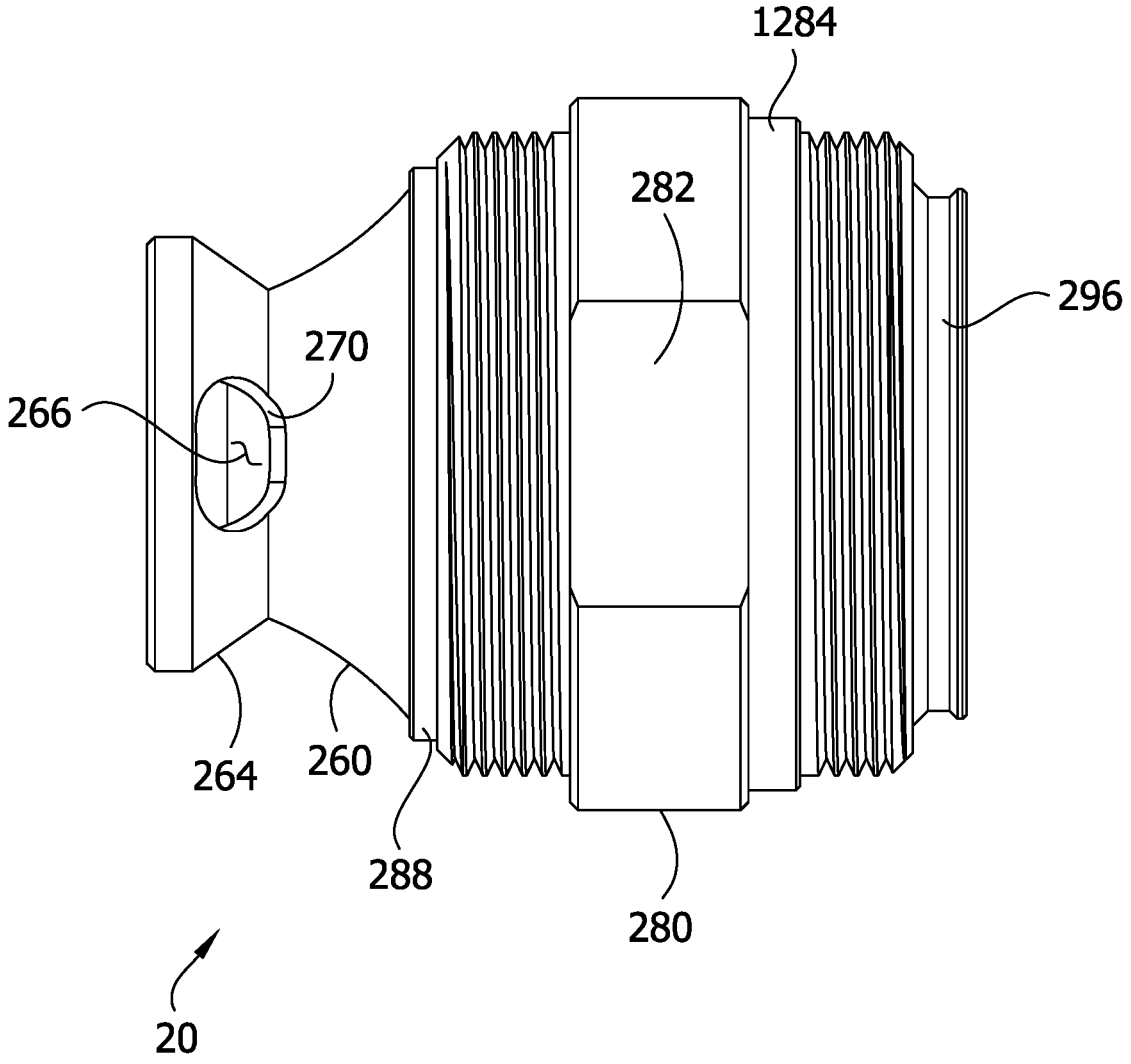
FIG. 33 is a bottom plan view of the distal baffle cup.
Figure 34:
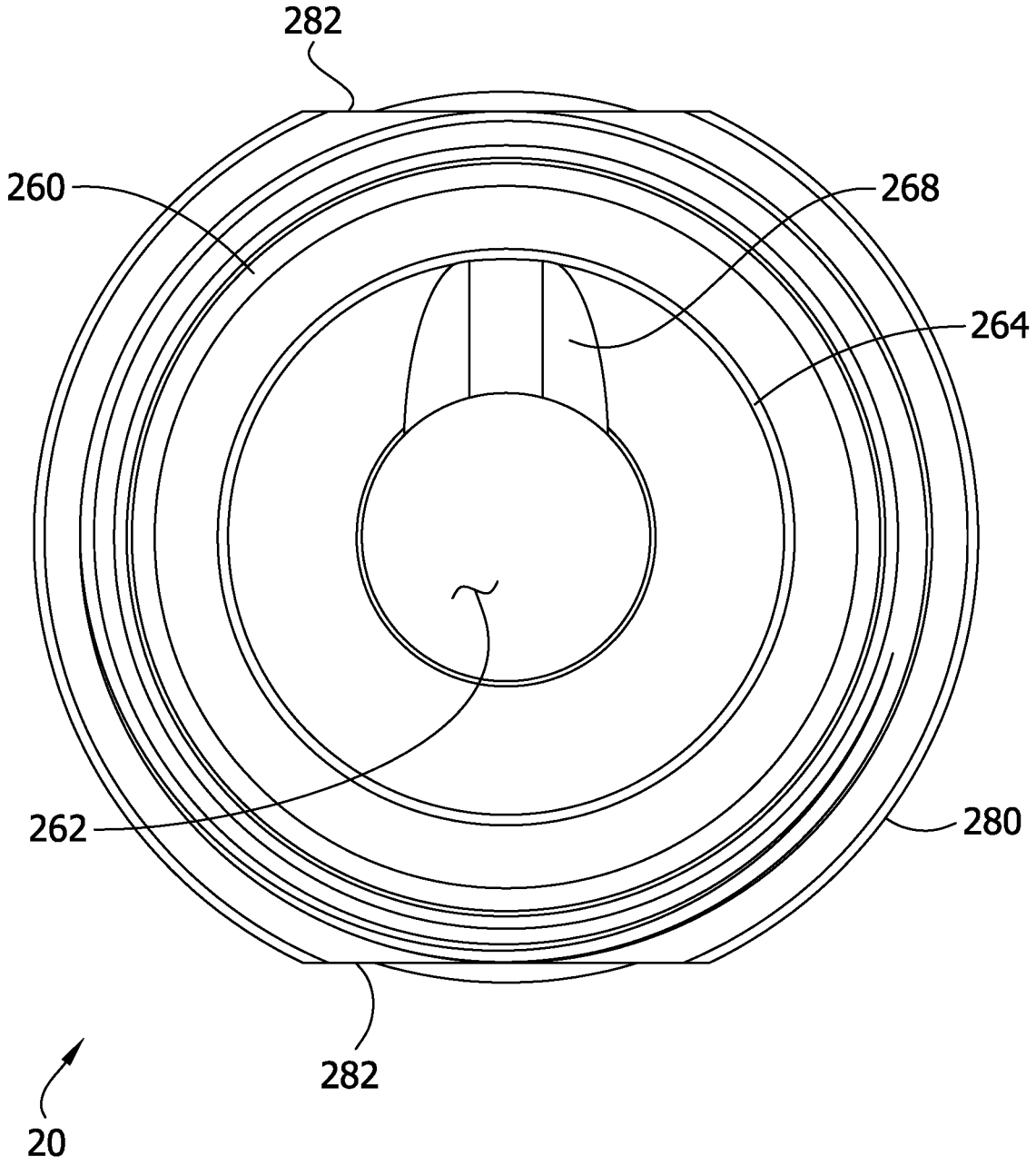
FIG. 34 is a distal end elevation of the distal baffle cup.
Figure 35:
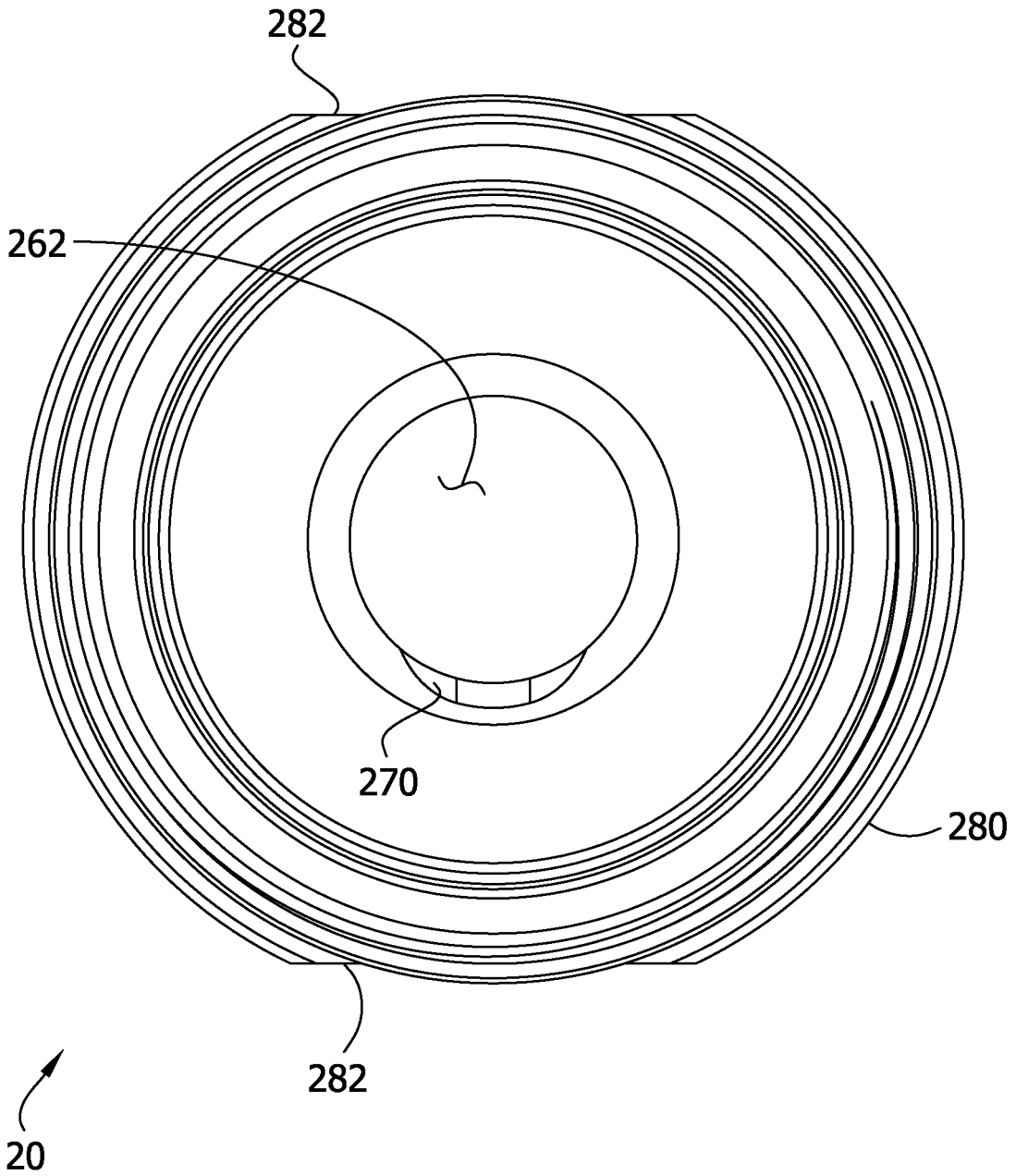
FIG. 35 is a proximal end elevation of the distal baffle cup.

Referring to FIG. 28, a vent passage 166 extends through the distal end portion of the blast baffle cup 16 transverse to the projectile bore 162. In the illustrated embodiment, the size, shape and arrangement of the vent passage 166 is substantially identical to the vent passage 66. Like the vent passage 66, the vent passage 166 extends along a venting axis VA' oriented at a skew angle $\alpha'$ with respect to the axis IA and includes an open groove 168 formed in the proximal end of the flange portion 164 and an enclosed vent hole 170 on a diametrically opposite side of the axis IA. The groove 168 and the vent hole 170 each extend along the venting axis VA' and have the boundaries of an imaginary volume (free of baffle cup material) formed by an obround cross-sectional shape swept along the venting axis over the entire length of the vent passage 166. Although in other embodiments, the baffle wall, flange portion, and/or vent passage of the baffle cups in a suppressor could have different sizes, shapes, or arrangements, without departing from the scope of the invention, forming the intermediate baffle cups 18 to have proximal end segments that are substantially identical to the proximal end segments of the blast baffle cups 16 allows common tooling to be used to form the blast baffle cups and the intermediate baffle cups, thus minimizing the cost of manufacturing the suppressor 10.

Referring again to FIG. 28, the intermediate baffle cup 18 further comprises a distal spacer wall 180 extending distally from the distal end of the conical baffle wall 160. Like the spacer wall 80, the spacer wall 180 has a generally cylindrical shape extending along the axis IA and includes two wrench flats 182 that are formed on diametrically opposite sides of the exterior surface of the spacer wall. The wrench flats 182 are spaced apart from one another by a spanning distance SD2' that is substantially equal to the spanning distances SD1, SD2 so that the first wrench 1002 can be used to disengage the threaded connections of the muzzle mount 12, the blast baffle cups 16, and the intermediate baffle cups 18 when disassembling the suppressor 10. The proximal end segment of the spacer wall 180 is externally threaded and the distal end segment of the spacer wall is internally threaded. As shown in FIGS. 3 and 20, when the suppressor 10 is fully assembled, the externally threaded segment of the spacer wall 180 of the proximal-most intermediate baffle cup 18 is threadably received in the internally threaded distal end segment of the spacer wall 80 of the distal blast baffle cup 16. The externally threaded proximal end segment of the spacer wall 180 of each additional intermediate baffle cup 18 is threadably received in the internally threaded distal end segment of the proximally adjacent intermediate baffle cup.

Like the blast baffle cups 16, each intermediate baffle cup 18 includes a first, proximal annular shoulder 184 projecting radially inwardly from the spacer wall 180 adjacent the externally threaded proximal end segment thereof and a distal annular shoulder 188 projecting radially inward adjacent the internally threaded distal end segment. The proximal annular shoulder 184 defines a proximally facing sealing surface 186 oriented transverse to (e.g., perpendicular to) the axis IA and located proximal of the externally threaded segment of the spacer wall 180. Likewise, the distal annular shoulder 188 defines a distally facing sealing surface 190 oriented transverse to (e.g., perpendicular to) the axis IA and located proximal of the internally threaded segment of the spacer wall 180. The proximal annular shoulder 184 of each intermediate baffle cup 16 also defines an axially extending and outwardly facing annular surface 187 extending proximally from adjacent the proximally facing sealing surface 186. The annular surface 187 has an outer diameter OD3' that is substantially equal to the outer diameter OD3 of the outwardly facing annular surface 87 of the blast baffle cup 16. The distal annular shoulder 188 likewise defines an axially extending and inwardly facing annular surface 192 extending proximally from adjacent the distally facing sealing surface 190. The annular surface 192 has an inner diameter ID2' that is substantially equal to the outer diameter ID2 of the inwardly facing annular surface 92 of the blast baffle cup 16. The distal annular shoulder 188 further defines a sloping annular chamfer oriented at angles to the distally facing sealing surface 190 and the proximally extending surface 192 and intersecting the distally facing sealing surface at the radially inner end thereof and intersecting the proximally extending surface at the distal end thereof. As explained below the axially facing sealing surfaces 186, 190 are configured to provide sealed interfaces between adjacent baffle cups 16, 18, 20 at locations proximal of corresponding threaded interfaces. The annular surfaces 187, 192 are configured for slidingly aligning the adjacently connected baffle cups 16, 18, 20 when they are threaded together.

Referring to FIGS. 29-36, the distal baffle cup 20 is similar in many respects to the blast baffle cups 16 and the intermediate baffle cups 18. Features of the distal baffle cup 20 that correspond to features of the blast baffle cups 16 are given the same reference number, plus 200. In one or more embodiments, the distal baffle cup 20 is formed from a single piece of machined metal stock (e.g., an aluminum-scandium alloy). As explained in further detail below, in the assembled suppressor 10, the distal baffle cup 20 is shaped and arranged to define a relatively long distal suppression chamber 32 distal to the other suppression chambers 26, 28, 30. The distal baffle cup 20 has an axis DA (FIG. 36) and proximal and distal ends spaced apart along the axis. In the illustrated suppressor 10 (FIG. 3), the axis DA of each distal baffle cup 20 is coincident with the axis SA of the suppressor. The distal baffle cup 20 has a length L4 (FIG. 36) extending along the axis DA from the proximal end to the distal end of the baffle cup. The length L4 of the distal baffle cup 20 is shorter than the length L2 of the blast baffle cup 16; the length L1 of the socket 46 of the muzzle mount 12 is shorter than the length L4 of the distal baffle cup; and the length L3 of the intermediate baffle cup 16 is slightly shorter than the length L4 of the distal baffle cup (e.g., the length L3 is no less than 95% of the length L4). In one or more embodiments, the length L1 of the socket 46 of the muzzle mount 12 is less than or equal to about 80% of the length L4 of the distal baffle cup 20. For example, in one or more embodiments, the length L4 of the distal baffle cup 20 is in an inclusive range of from about 0.75 inches to about 1.25 inches, such as an inclusive range of from about 0.85 inches to about 1.15 inches, for example an inclusive range of from about 0.95 inches to about 1.05 inches. As explained below, using a distal baffle cup 20 that is longer than the socket 46 of the muzzle mount 12, slightly longer than the intermediate baffle cups 18, and shorter than the blast baffle cup 16 defines a distal suppression chamber 32 that is larger than the other chambers 26, 28, 30 of the suppressor 10. Distributing the sizes of the chambers 26, 28, 30, 32 along the length of the suppressor 10 in this manner has been found to enhance suppression performance.

Like the blast baffle cup 16, the distal baffle cup 20 comprises a proximal baffle wall 260 and a flange portion 264 extending radially outward from the proximal end portion of the baffle wall. In the illustrated embodiment, the baffle wall 260 and the flange portion 264 have substantially identical sizes, shapes, and arrangements to the baffle wall 60 and the flange portion 64 of the blast baffle cup 16. Thus, like the baffle wall 60, the baffle wall 260 is conical in shape, having a cone axis coincident with baffle cup axis DA and a narrow proximal end portion and an enlarged distal end portion spaced apart from one another along the cone axis. The enlarged distal end portion of the conical baffle wall 260 has an outer diameter OD1" that is substantially the same as the outer diameter OD1 of the enlarged distal end portion of the conical baffle wall 60. The baffle wall 260 also defines a projectile bore 262 shaped and arranged to partially define the projectile passage 24 when the suppressor 10 is assembled to allow the round to travel through the distal baffle cup 20 along the projectile passage. Like the flange portion 64, the flange portion 264 has a substantially planar proximal end oriented transverse (e.g., perpendicular) to the axis DA, a substantially cylindrical proximal end segment that defines an outer surface of the flange portion having an outer diameter OD2" substantially equal to the outer diameter OD2, and an opposite distal end segment that slopes inwardly from the distal end of the cylindrical outer surface to the distal end of the flange portion. As above, the outer diameter OD2" of the flange portion 264 is at least about 75% of the outer diameter OD1" (e.g., at least about 80%, at least about 85%, etc.) to provide a restricted opening to an annular space extending between the sloping distal end segment of the flange portion and the exterior surface of the conical baffle wall 160.

Figure 36:
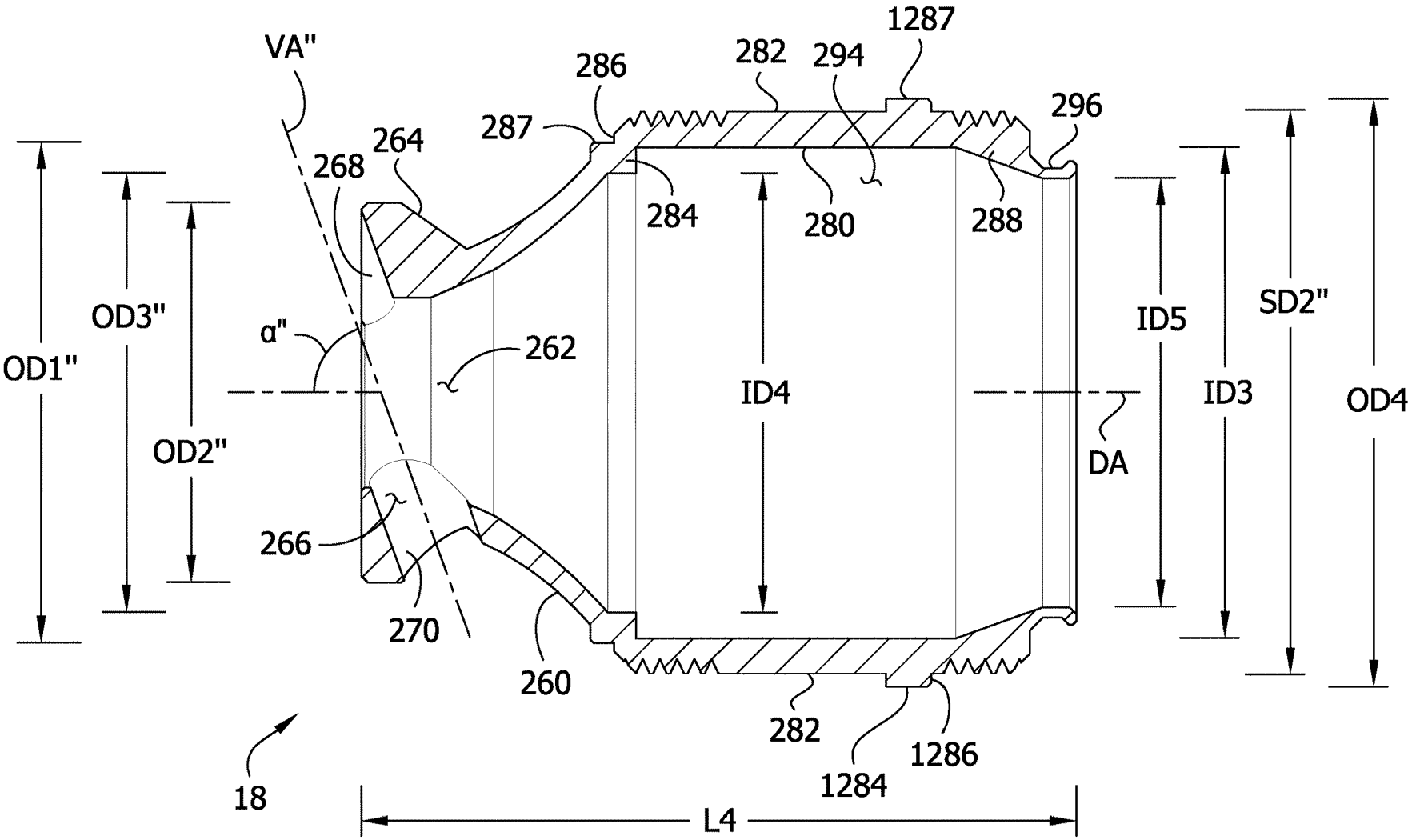
FIG. 36 is a longitudinal section taken in the plane of line 36-36 of FIG. 32.

Referring to FIG. 36, a vent passage 266 extends through the distal end portion of the distal baffle cup 20 transverse to the projectile bore 262. In the illustrated embodiment, the size, shape and arrangement of the vent passage 266 is substantially identical to the vent passage 66. Like the vent passage 66, the vent passage 266 extends along a venting axis VA" oriented at a skew angle $\alpha$" with respect to the axis DA and includes an open groove 268 formed in the proximal end of the flange portion 264 and an enclosed vent hole 270 on a diametrically opposite side of the axis DA. The groove 268 and the vent hole 270 each extend along the venting axis VA" and have the boundaries of an imaginary volume (free of baffle cup material) formed by an obround cross-sectional shape swept along the venting axis over the entire length of the vent passage 266. Although in other embodiments, the baffle wall, flange portion, and/or vent passage of the baffle cups in a suppressor could have different sizes, shapes, or arrangements, without departing from the scope of the invention, forming the baffle cups 16, 18, 20 to have substantially identical proximal end segments allows common tooling to be used to form different types of baffle cups, thus minimizing the cost of manufacturing the suppressor 10.

Figure 37:
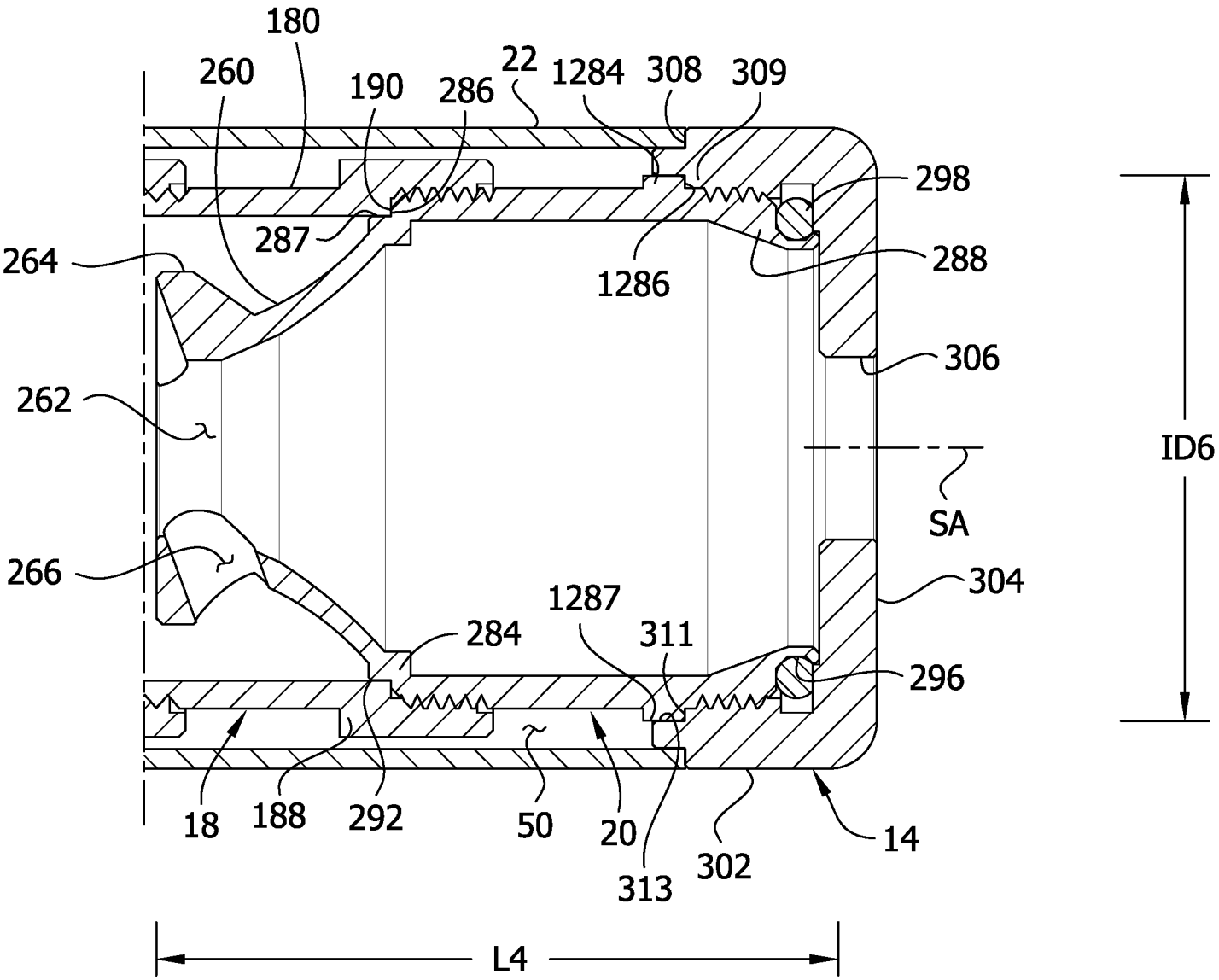
FIG. 37 is an enlarged view of another portion of FIG. 3.

The distal baffle cup 20 further comprises a distal spacer wall 280 extending distally from the distal end of the conical baffle wall 260. Like the spacer wall 80, the spacer wall 280 has a generally cylindrical shape extending along the axis DA and includes two wrench flats 282 that are formed on diametrically opposite sides of the exterior surface of the spacer wall. The wrench flats 282 are spaced apart from one another by a spanning distance SD2" that is substantially equal to the spanning distances SD1, SD2, SD2' so that the first wrench 1002 can be used to disconnect the muzzle mount 12, the blast baffle cups 16, the intermediate baffle cups 18, and the distal baffle cup 20 when disassembling the suppressor 10. The proximal end segment of the spacer wall 280 is externally threaded. As shown in FIGS. 3 and 37, when the suppressor 10 is fully assembled, the externally threaded proximal end segment of the spacer wall 280 of the distal baffle cup 20 is threadably received in the internally threaded distal end segment of the spacer wall 180 of the distal-most intermediate baffle cup 18. Unlike the other baffle cups 16, 18, the distal end segment of the spacer wall 280 of the distal baffle cup 20 is also externally threaded for being threadably received in the distal end cap 14 as described in further detail below.

Referring to FIG. 36, like the blast baffle cups 16, 18, the spacer wall 280 of the distal baffle cup 20 includes a first, proximal annular shoulder 284 projecting radially inwardly adjacent the externally threaded proximal end segment thereof. The proximal annular shoulder 284 defines a proximally facing sealing surface 286 oriented transverse to (e.g., perpendicular to) the axis DA and located proximal of the externally threaded proximal end segment of the spacer wall 280. The proximal annular shoulder 284 of the distal baffle cup 20 also defines an axially extending and outwardly facing annular surface 287 extending proximally from adjacent the proximally facing sealing surface 286. The annular surface 287 has an outer diameter OD3" that is substantially equal to the outer diameter OD3 of the outwardly facing annular surface 87 of the blast baffle cup 16. As explained below the axially facing sealing surface 286 is configured to provide a sealed interface between the distal baffle cup 20 and the distal-most intermediate baffle cup 18 at a location proximal of the corresponding threaded interface. The annular surface 287 is configured for slidingly aligning the distal baffle cup 20 with the distal-most intermediate baffle cup 18 when they are threaded together.

The distal end segment of the spacer wall 280 of the distal baffle cup 20 includes an inwardly projecting shoulder 288 distal to the externally threaded distal segment of the spacer wall that defines an external annular recess 296 distal to the externally threaded distal end segment of the spacer wall. As shown in FIGS. 3 and 4, the suppressor 10 includes an annular seal or O-ring 298 sized and arranged for being received in the external annular recess 296. As shown in FIGS. 3 and 37, in the assembled suppressor 10, the seal 298 is compressed between the distal baffle cup 20 and the distal end cap 14 to form a seal between the distal baffle cup and the distal end cap. Moreover, although the O-ring 298 is located distal to the threaded interface between the distal baffle cup 20 and the distal end cap 14, it is located upstream of the threaded interface along the flow path through which blast gas must flow if it is to ingress into the threaded interface. Thus the seal 298 is configured to limit fouling of the threaded interface between the distal baffle cup 20 and the distal end cap 14.

In addition, the distal baffle cup 20 is configured to form a secondary seal with the distal end cap 14 to limit the ingress of contaminants into the annular air gap 50 between the baffle cups 16, 18, 20 and the sheath 22. The spacer wall 280 includes a second, distal annular shoulder 1284 projecting radially outwardly immediately proximal of the externally threaded distal end segment thereof. The distal annular shoulder 1284 defines a distally facing sealing surface 1286 oriented transverse to (e.g., perpendicular to) the axis DA shown in FIG. 37 and located proximal of the externally threaded proximal end segment of the spacer wall 280. The distal annular shoulder 1284 of the distal baffle cup 20 also defines an axially extending and outwardly facing annular surface 1287 extending proximally from adjacent the distally facing sealing surface 1286. The outwardly facing annular surface 1287 has an outer diameter OD4. As explained below the axially facing sealing surface 1286 is configured to provide a secondary sealed interface between the distal baffle cup 20 and the distal end cap 14. The annular surface 1287 is configured for slidingly aligning the distal baffle cup 20 with the distal end cap 14 when they are threaded together.

Referring to FIG. 36, the spacer wall 280 defines a radially outwardly extending annular recess 294 that extends axially between the distal end of the proximal shoulder 284 and the proximal end of the inwardly extending distal shoulder 288. In the illustrated embodiment, the distal end of the proximal annular shoulder 284 is oriented substantially perpendicular to the axis BA and the proximal end of the distal annular shoulder 288 slopes inwardly and distally. The shoulders 284, 288 form proximal and distal annular protrusions that define the proximal and distal ends of the annular recess 294, respectively. The spacer wall 280 has a length extending along the axis DA, and the recess 284 has a length extending along the axis and along a majority of the length of the spacer wall. The annular recess 294 has an inner diameter ID3, the proximal shoulder 284 has an inner diameter ID4, and the distal shoulder 288 has an inner diameter ID5. The inner diameter ID5 of the shoulder 288 and the inner diameter ID4 of the shoulder 284 are each less than the inner diameter ID3 of the annular recess 294 (e.g., the inner diameter ID4 and the inner diameter ID5 are each is at least about 0.015 inches less than the inner diameter ID3, such as at least about 0.03 inches less, at least about 0.05 inches less, at least about 0.07 inches less, etc.). By forming the annular recess 294 in the spacer wall 80, the weight of the distal baffle cup is reduced substantially. The reduction in weight shifts the center of mass of the suppressor proximally, which improves the comfort of shooting with the suppressor 10 and enhances maneuverability when pointing the firearm while the suppressor is installed.

Referring to FIGS. 3, 4, and 37, the distal end cap 14 includes a generally cylindrical receptacle portion 302 and a distal end wall 304. In one or more embodiments, the distal end cap 14 is formed from a single piece of machined metal stock (e.g., an aluminum-scandium alloy). The receptacle portion 302 extends generally along the suppressor axis SA in the assembled suppressor 10. The distal end wall 304 extends generally perpendicular to the suppressor axis SA and defines a projectile opening 306 forming the distal end of the projectile passage 24. The receptacle portion 302 is internally threaded for threadably receiving the externally threaded distal end segment of the distal baffle cup 20. The receptacle portion 302 defines a radially outwardly and proximal facing annular shoulder 308 and a radially inwardly and proximal facing annular shoulder 309. The outwardly facing annular shoulder 308 is configured to receive and support the distal end portion of the shroud 22 in the assembled suppressor. Specifically, the proximal facing surface of the shoulder 308 opposingly engages the distal end of the shroud 22 and the radially outwardly facing surface is received in the interior of the distal end portion of the shroud. When the shoulder 308 engages the distal end portion of the shroud 22 as shown in FIGS. 3 and 37, the shoulder positions the shroud so that the radial air gap 50 extends continuously between the proximal end of the distal end cap 14 and the muzzle mount 12. The air gap 50 limits heat transfer to the shroud 22 during use of the suppressor 10, which permits the shroud to be formed of suitable lightweight materials, such as carbon fiber composite. The inwardly facing annular shoulder 309 includes a proximally facing sealing surface 311 oriented transvers to the axis SA and an inwardly facing annular guiding surface 313 having an inner diameter ID6 that is slightly larger than the outer diameter OD4 of the shoulder 1284. When the end cap 14 is threaded onto the distal baffle cup 20, the inwardly facing annular surface 313 slides along the outwardly facing annular surface 1287 until the proximally facing sealing surface 311 sealingly engages the distally facing sealing surface 1286 to provide a secondary seal of the air gap 50 at the distal end of the suppressor 10.

Referring to FIGS. 2 and 4, in the illustrated embodiment, the exterior surface of the receptacle portion 302 of the distal end cap 14 includes a plurality of pairs of wrench flats 310, each including first and second wrench flats on opposite diametrically opposite sides of the end cap. Each pair of wrench flats 310 is spaced apart by a spanning distance SD3 that corresponds to the size of a second wrench 1004 (FIG. 4). The spanning distance SD3 is larger than the spanning distances SD1, SD2, SD2', SD2", and thus the wrenches 1002, 1004 can have different sizes.

Having separately described each of the components of the suppressor 10, features of the assembled suppressor 10 will now be briefly described before describing methods of manufacture and use of the suppressor in greater detail. Referring to FIGS. 3, 20 and 37, when the suppressor 10 is fully assembled threaded interfaces connect each of the baffle cups 16, 18, 20 and the distal end cap 14 to the muzzle mount 12. The proximal blast baffle cup 16 is connected to the muzzle mount 12 at one threaded interface between the internally threaded distal end segment of the receptacle portion 42 of the muzzle mount and the externally threaded proximal end segment of the spacer wall 80 of the proximal blast baffle cup; the distal blast baffle cup 16 is connected to the proximal blast baffle cup at another threaded interface between the internally threaded distal end segment of the spacer wall 80 of the proximal blast baffle cup and the externally threaded proximal end segment of the spacer wall of the distal blast baffle cup; the proximal-most intermediate baffle cup 18 is connected to the distal blast baffle cup 16 at another threaded interface between the internally threaded distal end segment of the spacer wall 80 of the distal blast baffle cup and the externally threaded proximal end segment of the spacer wall 180 of the proximal-most intermediate baffle cup; each additional intermediate blast baffle cup 18 in distal succession is connected to the proximally adjacent intermediate baffle cup at another respective threaded interface between the internally threaded distal end segment of the spacer wall 180 of the proximally adjacent intermediate baffle cup and the externally threaded proximal end segment of the spacer wall of the distally adjacent intermediate baffle cup; the distal baffle cup 20 is connected to the distal-most intermediate baffle cup 18 at another threaded interface between the internally threaded distal end segment of the spacer wall 180 of the distal-most intermediate baffle cup and the externally threaded proximal end segment of the spacer wall 280 of the distal baffle cup; and the distal end cap 14 is connected to the distal baffle cap 20 at another threaded interface between the externally threaded distal end segment of the spacer wall 280 of the distal baffle cup and the internally threaded end segment of the receptacle portion 302 of the end cap. The shroud 22 is secured between the shoulders 48, 308 of the threadably connected muzzle mount 12 and the distal end cap 14.

When the suppressor 10 is fully assembled a respective sealed interface inhibits blast gas from ingression into each of the threaded interfaces between the muzzle mount 12, the baffle cups 16, 18, 20, and the distal end cap 14. The distal facing sealing surface 54 of the muzzle mount 12 engages the proximal facing sealing surface 86 of the proximal blast baffle cup 16 to provide a sealed interface upstream of the threaded interface between the muzzle mount and the proximal blast baffle cup. The distal facing sealing surface 90 of the proximal blast baffle cup 16 engages the proximal facing sealing surface 86 of the distal blast baffle cup to provide a sealed interface upstream of the threaded interface between the two blast baffle cups. The distal facing sealing surface 90 of the distal blast baffle cup 16 engages the proximal facing sealing surface 186 of the proximal-most intermediate baffle cup 18 to provide a sealed interface upstream of the threaded interface between the distal blast baffle cup and the proximal-most intermediate baffle cup. The proximal facing sealing surface 186 of each additional intermediate baffle cup 18 in distal succession engages the distal facing sealing surface 190 of the proximally adjacent intermediate baffle cup to provide a sealed interface upstream of the threaded interface between each adjacent pair of intermediate baffle cups. The distal facing sealing surface 190 of the distal intermediate baffle cup 18 engages the proximal facing sealing surface 286 of the distal baffle cup 20 to provide a sealed interface upstream of the threaded interface between the distal baffle cup and the distal-most intermediate baffle cup. And the seal 298 is compressed between the distal baffle cup 20 and the distal end cap 14 to provide a sealed interface upstream of the threaded interface between the distal baffle cup and the distal end cap. The sealed interfaces thus limit blast gas flow through the threaded interfaces and encourage the discharge of substantially all blast gas through the opening 306 in the distal end wall 304 of the distal end cap 134. In addition, the distal facing sealing surface 1286 of the distal baffle cup 20 sealingly engages the proximal facing sealing surface 311 to provide a secondary seal of the air gap 50 at the distal end of the suppressor 10.

As alluded to above, in the assembled suppressor 10, the muzzle mount 12 and the baffle cups 16, 18, 20 are shaped and arranged to form expansion chambers 26, 28, 30, 32 whose sizes vary along the length of the suppressor. It will be understood that other suppressors could be constructed other ways (e.g., using a monocore baffle, using separate baffle elements and spacer elements, etc.) to form an arrangement of expansion chambers encompassed in the scope of this invention. As shown in FIG. 3, the proximal chamber 26 has a length L5 that extends from a distal end defined by the proximal end wall of the receptacle 42 of the muzzle mount 12 to a distal end defined by the sealed interface between the muzzle mount and the proximal blast baffle cup 16. Each blast suppression chamber 28 has a length L6 that extends from a proximal end defined by the proximal end of the respective blast baffle cup 16 to a distal end defined by the sealed interface between the respective blast baffle cup and the distally adjacent baffle cup. Each intermediate suppression chamber 30 has a length L7 that extends from a proximal end defined by the proximal end of the respective intermediate baffle cup 18 to a distal end defined by the sealed interface between the respective intermediate baffle cup and the distally adjacent baffle cup. The length of the distal suppression chamber 32 is substantially equal to the length L4 of the distal baffle cup 20. In the illustrated embodiment, the length L5 of the proximal chamber 26 is shorter than the lengths L6 of the blast chambers 28, the lengths L7 of the intermediate chambers 30, and the length L4 of the distal chamber 20. For example, the length L5 is less than or equal to about 60% of the length L4, less than or equal to about 65% of the length L6, and less than or equal to about 80% of the length L7. The length L7 of each intermediate chamber 30 is shorter than the length L6 of the blast chambers 28 and the length L4 of the distal suppression chamber 32. In one or more embodiments, the lengths L4, L6 of the distal suppression chamber 32 and the blast chambers 28 differ by no more than about 10% of the length of the shorter of the two chambers (e.g., by no more than about 5% of the length of the shorter of the two chambers).

To manufacture the suppressor 10, each of the muzzle mount 12, the distal end cap 14, the baffle cups 16, 18, 20, and the shroud 22 are formed separately. For example, in one embodiment the shroud 22 is cut from carbon fiber tube stock and each of the muzzle mount 12, the distal end cap 14, the baffle cups 16, 18, 20 is machined from metal (e.g., aluminum-scandium alloy) tube stock or round stock. When forming each of the baffles 16, 18, 20, material is removed from the stock to form the conical baffle wall 60, 160, 260, the flange portion 64, 164, 264, and the spacer wall 80, 180, 280. In the illustrated embodiment, the manufacturer also removes material from the stock to form the vent passage 66, 166, 266. In one embodiment, a clamp of a milling machine holds the baffle cup 16, 18, 20 by gripping the cylindrical proximal end segment of the flange portion 64, 164, 264 at positions spaced apart from the venting axis VA, VA', VA". While the clamp holds the baffle cup 16, 18, 20 in place, a material removing tool is inserted through the proximal end portion of the baffle cup along the venting axis VA, VA', VA" and, in some embodiments, moved along one or more widening axes perpendicular to the venting axis to widen the venting passage along the widening axes. Inserting the material removing tool forms both the open groove 68, 168, 268 and the enclosed hole 70, 170, 270 in a single machining step. After initially forming the spacer wall 280 of the distal baffle cup 20 such that the spacer wall has a wall thickness, the manufacturer removes additional material from the interior surface of the spacer wall along a portion of the length of the spacer wall to define the annular recess 294 and reduce the wall thickness of the spacer wall. In the illustrated embodiment, the step of removing material from the spacer wall 280 to form the annular recess 294 comprises forming a perpendicular proximal end of the annular recess defined by the proximal shoulder 284 and forming an inwardly and distally skewed distal end defined by the distal shoulder 288.

After separately forming each of the components of the suppressor 10, a manufacturer can assemble the suppressor by threadably connecting the components to one another. For example, the manufacturer could threadably connect the proximal blast baffle cup 16 to the muzzle mount 12, the distal blast baffle cup to the proximal blast baffle cup, the proximal-most intermediate baffle cup 18 to the distal blast baffle cup, each additional intermediate baffle cup to the proximally adjacent intermediate baffle cup, and the distal baffle cup 20 to the distal-most intermediate baffle cup 18. In one embodiment, the manufacturer inserts the threadably connected subassembly including the muzzle mount 12 and the baffle cups 16, 18, 20 into the interior of the shroud 22 until the proximal end portion of the shroud 22 is received over the shoulder 48 of the muzzle mount 12. The O-ring 298 is also positioned in the sealing recess 296 of the distal blast baffle cup 20. Subsequently, the manufacturer threads the distal end cap 14 onto the distal baffle cup 20 whereby the shoulder 308 of the end cap is received in the distal end portion of the shroud 22. As explained above, threading together the components of the suppressor 10 captures the shroud 22 between the shoulders 48, 308 to secure the shroud on the suppressor in radially spaced apart relationship with the baffles 16, 18, 20 to define the air gap 50. In addition, threading together the components of the suppressor 10 establishes sealed interfaces upstream of each of the threaded interfaces between the components. In the illustrated embodiment, the baffle cups 16, 18, 20 are shaped and arranged so that venting grooves 68, 168, 268 are circumferentially aligned about the suppressor axis SA when the components are threaded together at the proper tightness to establish the sealed interfaces between the components while also ensuring the suppressor 10 can be disassembled after use. Thus the venting grooves 68, 168, 268 function as circumferential alignment indicators for indicating proper tightening of the threaded connections. In one embodiment, the manufacturer hand tightens the threaded connections between the components of the connectors. However, it is to be understood that the venting groove 68, 168, 268 need not be aligned in other embodiments.

In use, the muzzle mount 12 is mounted on the distal end portion of a firearm muzzle to mount the suppressor 10 on the firearm. The firearm fires rounds through the suppressor along the projectile passage 24. As each round travels through the projectile passage, blast gas associated with the round flows into the expansion chambers 26, 28, 30, 32. The arrangement of differently sized expansion chambers 26, 28, 30, 32 has been found to limit first round pop. As blast gas travels through each of the expansion chambers 26, 28, 30, 32, it expands radially. As explained above, the gas flows through the annular space between the flange portions 64, 164, 264 of each of the baffle cups 16, 18, 20 and the inner surface of the receptacle 42 or spacer wall 80, 180, 280 of the proximally adjacent component into the annular space between the sloped distal end segment of the flange portion and the exterior surface of the conical baffle wall 60, 160, 260. In addition, gas is redirected by the proximal end of each baffle cup 16, 18, 20 and is forced to flow through and around the groove 68, 168, 268 of the vent passage 66, 166, 266. Some of the blast gas also flows radially through the vent hole 70, 170, 270 and intersects other gas flowing into the annular space between the distal end segment of the flange portion 64, 164, 264 and the exterior surface of the conical baffle wall 60, 160, 260. The paths along which the baffle cups 16, 18, 20 direct the blast gas to expand and absorb blast energy, reducing the report when the round is fired.

In one or more embodiments, the suppressor 10 is configured for suppressing many rounds (e.g., on the order of two-thousand or more) before disassembly is required for cleaning or maintenance. As explained above, the sealed interfaces upstream of the threaded interfaces limit fouling of the threads and thus extend the maintenance-free life of the suppressor. When disassembly is required, the first wrench 1002 can be engaged with the wrench flats 41, 82, 182, 282 of the muzzle mount 12 and each of the baffle cups 16, 18, 20 and the larger second wrench 1004 can be engaged with the wrench flats 310 of the distal end cap 14 to unthread the components. After, for example, cleaning the components of the suppressor 10, it can be reassembled. To reassemble the suppressor 10, the components are threaded back together and hand-tightened. In one embodiment, excessive tightening of the threads during assembly is avoided because it may cause the threaded interfaces to later seize when exposed to the heat and pressure of firearm rounds.

OTHER STATEMENTS OF THE INVENTION

A. A baffle cup for use in a firearm suppressor, the baffle cup comprising:

a generally conical baffle wall having a cone axis, a proximal end portion and a distal end portion spaced apart from one another along the cone axis, and a diameter, the diameter of the conical baffle wall increasing as the conical baffle wall extends from adjacent the proximal end portion toward the distal end portion, the conical baffle wall defining a bore extending along the cone axis;

a flange portion extending radially outward from the proximal end portion of the conical baffle wall and having a proximal end oriented transverse to the cone axis and an opposite distal end;

a vent passage extending along a venting axis oriented at a skew angle with respect to the cone axis, the vent passage including a first segment formed in the proximal end, and a second segment formed in at least one of the flange portion and the conical baffle wall, the first and second segments of the vent passage each extending along the venting axis.

B. A baffle cup as set forth in statement A wherein the first segment of the vent passage comprises a groove formed in the proximal end of the flange portion.

C. A baffle cup as set forth in statement B wherein the second segment of the vent passage comprises a vent hole having an opening through said at least one of the flange portion and the conical baffle wall, the opening being entirely enclosed by said at least one of the flange portion and the conical baffle wall.

D. A baffle cup as set forth in statement C wherein the vent hole opening has a cross-sectional shape in a plane orthogonal to the venting axis, the baffle cup having an imaginary volume defined by moving said cross-sectional shape along the venting axis over an entire length of the vent passage, the imaginary volume being free of material of the conical baffle wall and the flange portion.

E. A baffle cup as set forth in statement A wherein the vent passage opens on sides of the baffle cup that are opposite to each other with respect to the cone axis.

F. A baffle cup as set forth in statement E wherein the first segment opens to one of the sides of the baffle cup and the second segment opens to the opposite side of the baffle cup.

G. A baffle cup as set forth in statement E wherein the flange portion includes a proximal end segment adjacent the first end having a substantially cylindrical outer surface.

H. A baffle cup as set forth in statement A wherein the skew angle is in a range of from about 55° to about 85°.

I. A suppressor comprising the baffle cup of statement A.

J. A kit for forming a suppressor comprising the baffle cup of statement A.

K. A method of forming a baffle cup for use in a firearm suppressor, the method comprising:

forming a wall extending along a baffle cup axis and extending circumferentially around the baffle cup axis to define a cup passage along the baffle cup axis; and forming a vent passage in the wall having a first segment and a second segment disposed on an opposite side of the baffle cup passage from the first segment by inserting a material removing tool through the wall along a venting axis oriented at a skew angle with respect to the baffle cup axis.

L. A method as set forth in statement K wherein the step of forming the wall includes forming a proximal end of the wall and the step of forming the vent passage includes forming an open groove in the proximal end of the wall.

M. A method as set forth in statement L wherein the step of forming the groove forms the first segment of the vent passage.

N. A method as set forth in statement K wherein the step of forming the vent passage includes forming hole through the wall such that the wall extends circumferentially around the hole about the venting axis.

O. A method as set forth in statement N wherein the step of forming the hole forms the second segment of the vent passage.

P. A method as set forth in statement K wherein the step of forming the wall comprises forming a conical portion having a narrow proximal end and an enlarged distal end and forming a flange portion extending radially outward from adjacent the narrow proximal end of the conical portion, and wherein the step of forming the vent passage comprises forming at least a portion of each of the first and second segment of the vent passage in the flange portion of the wall.

Q. A baffle cup having a proximal end and a distal end spaced apart along an axis for use in a suppressor for suppressing a muzzle blast, the baffle cup comprising:

a baffle wall extending generally around the axis and having an outer end margin;

a spacer wall having a generally cylindrical shape and an interior surface defining a spacer interior and extending along the axis from a proximal end segment adjacent the outer end margin of the baffle wall to an opposite distal end segment, a radially outwardly extending annular recess being formed in the spacer wall and extending proximally along the axis from a location adjacent the distal end segment of the spacer wall.

R. A baffle cup as set forth in statement Q wherein the spacer wall has a length extending along the axis and the annular recess has a length extending along the axis and along a majority of the length of the spacer wall.

S. A baffle cup as set forth in statement Q wherein the spacer wall comprises a distal annular protrusion extending radially inward and having a proximal end defining a distal end of the annular recess.

T. A baffle cup as set forth in statement S wherein the annular recess has a diameter and the distal annular protrusion as an inner diameter that is less than the diameter of the annular recess.

U. A baffle cup as set forth in statement S wherein the proximal end of the distal annular protrusion slopes inwardly and distally.

V. A baffle cup as set forth in statement S wherein the spacer wall further comprises a proximal annular protrusion extending radially inward and having a distal end defining a proximal end of the annular recess.

W. A baffle cup as set forth in statement V wherein the annular recess has a diameter and the proximal annular protrusion has an inner diameter that is less than the diameter of the annular recess.

X. A method of making a baffle cup for use in a suppressor for suppressing a blast of a firearm, the method comprising:

forming a spacer wall having a generally cylindrical shape, an interior surface, an exterior surface, a wall thickness extending between the interior surface and the exterior surface, a proximal end segment and a distal end segment spaced apart along an axis, and a length extending along the axis from the proximal end segment to the distal end segment;

forming a baffle wall connected to the proximal end segment of the spacer wall and extending generally around the axis; and removing material from the interior surface of the spacer wall along a portion of the length of the spacer wall to define an annular recess in the interior surface of the spacer wall.

Y. A method of making a baffle cup as set forth in statement X wherein the step of removing material reduces the wall thickness of the spacer wall along said portion of the length of the spacer wall.

Z. A method of making a baffle cup as set forth in statement X wherein the step of removing material comprises forming proximal and distal ends of the annular recess, at least one of the proximal and distal ends being oriented at a skew angle with respect to the axis.

AA. A method of making a baffle cup as set forth in statement Z wherein the step of forming the distal end of the annular recess comprises forming the distal end so that it extends distally and radially inward at said skew angle with respect to the axis.

AB. A method of making a baffle cup as set forth in statement X wherein the step of removing material comprises forming a proximal end of the annular recess oriented substantially orthogonal to the axis.

Modifications and variations of the disclosed embodiments are possible without departing from the scope of the invention defined in the appended claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

The invention claimed is:

1. A method of forming a baffle cup for use in a firearm suppressor, the method comprising:

forming a wall extending along a baffle cup axis and extending circumferentially around the baffle cup axis to define a cup passage along the baffle cup axis, wherein forming the wall further includes forming a conical portion having a narrow proximal end and an enlarged distal end and forming a flange portion extending radially outward from adjacent the narrow proximal end of the conical portion, the flange portion including a proximally facing end surface having an outer peripheral edge; and forming a vent passage in the wall having a first segment and a second segment disposed on an opposite side of the baffle cup passage from the first segment by inserting a material removing tool through the wall along a venting axis oriented at a skew angle with respect to the baffle cup axis, the first segment so formed extending through the outer peripheral edge of the proximally facing end surface of the flange portion.

2. A method as set forth in claim 1 wherein the step of forming the vent passage includes forming an open groove in the proximally facing end surface of the flange portion.

3. A method as set forth in claim 2 wherein the step of forming the groove forms the first segment of the vent passage.

4. A method as set forth in claim 1 wherein the step of forming the vent passage includes forming a hole through the wall such that the wall extends circumferentially around the hole about the venting axis.

5. A method as set forth in claim 4 wherein the step of forming the hole forms the second segment of the vent passage.

6. A method as set forth in claim 1 wherein the step of forming the vent passage comprises forming at least a portion of each of the first and second segment of the vent passage in the flange portion of the wall.

7. A suppressor for suppressing a blast of a firearm, the suppressor comprising:

a baffle cup assembly including at least first and second baffle cups threaded together to form a threaded interface of the baffle cups, the baffle cup assembly having a projectile passage along which a projectile can pass along a projectile axis, the first and second baffle cups including respective shoulders in engagement with each other to form a sealed interface between the first and second baffle cups, the sealed interface being located upstream from the threaded interface with respect to the projectile passage, and a housing that houses the baffle cup assembly, wherein the housing and baffle cup assembly are arranged to define an interstitial space between the baffle cup assembly and the housing, the interstitial space extending circumferentially around the baffle cup assembly, the interstitial space being sealed from gas flow from the projectile passage at least in part by said sealed interface.

8. A suppressor as set forth in claim 7, wherein the housing includes a tube housing the first and second baffle cups, the tube being free of direct contact with the first and second baffle cups, the interstitial space defining a circumferential air gap between the tube and the first and second baffle cups to limit heat transfer from the first and second baffle cups to the tube.

9. A suppressor as set forth in claim 7 further comprising a muzzle mount at an upstream end of the baffle cup assembly configured for mounting the suppressor on the firearm so that a projectile from the firearm passes from the upstream end and through the baffle cup assembly in a downstream direction along the projectile axis.

* * * * *